US007856782B2

(12) United States Patent
Hornung et al.

(10) Patent No.: US 7,856,782 B2
(45) **Date of Patent: *Dec. 28, 2010**

(54) GRID MUNTIN RETAINING CLIPS FOR MUNTINS

(75) Inventors: Robert E. Hornung, Westport, CT (US); John S. France, Cuyahoga Falls, OH (US); Mark V. Murphy, Oak Park, IL (US); Dean A. Pettit, St. John, IN (US); Rodney V. Erdman, Princeton, MN (US)

(73) Assignee: Sashlite, LLC, Westport, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/317,645

(22) Filed: Dec. 22, 2008

(65) Prior Publication Data

US 2009/0145064 A1 Jun. 11, 2009

Related U.S. Application Data

(63) Continuation of application No. 10/683,568, filed on Oct. 10, 2003, now abandoned.

(60) Provisional application No. 60/420,147, filed on Oct. 22, 2002, provisional application No. 60/457,149, filed on Mar. 24, 2003, provisional application No. 60/459,917, filed on Apr. 3, 2003, provisional application No. 60/486,332, filed on Jul. 11, 2003.

(51) Int. Cl.
*E06B 3/64* (2006.01)
*E06B 3/66* (2006.01)

(52) U.S. Cl. ..... 52/456; 52/455; 52/458; 52/204.593; 52/786.13

(58) Field of Classification Search ..... 52/456, 52/455, 458, 204.593, 786.13, 396.05, 396.04, 52/204.63, 204.69, 207.7, 204.6, 717.04, 52/717.05, 716.8
See application file for complete search history.

(56) References Cited

U.S. PATENT DOCUMENTS

| | | | |
|---|---|---|---|
| 3,350,181 | A | 10/1967 | Miyoshi et al. |
| 3,573,149 | A | 3/1971 | Tibble et al. |
| 3,760,544 | A | 9/1973 | Hawes et al. |
| 4,115,973 | A | 9/1978 | Anderson |

(Continued)

FOREIGN PATENT DOCUMENTS

| | | |
|---|---|---|
| DE | 33 29 183 | 2/1985 |

(Continued)

OTHER PUBLICATIONS

Ashland Hardware Systems catalog pages, "GED Muntin Clips", 4 pages from http://www.ashlandhardware.com/screen glass.shtml, Jul. 2003.

(Continued)

*Primary Examiner*—Phi Dieu Tran A
(74) *Attorney, Agent, or Firm*—Lipsitz & McAllister, LLC

(57) ABSTRACT

Techniques are provided for mounting simulated muntin bars, preassembled muntin grids and the like between parallel glazing sheets in an integrated multipane window sash. Among the mounting techniques disclosed are clips for holding simulated muntin components to a spacing and mounting structure of an integrated multipane window sash. All or portions of the clips can be desiccated.

14 Claims, 46 Drawing Sheets

U.S. PATENT DOCUMENTS

| | | | | |
|---|---|---|---|---|
| 4,464,874 | A | | 8/1984 | Shea, Jr. et al. |
| 4,873,803 | A | | 10/1989 | Rundo |
| 4,882,890 | A | | 11/1989 | Rizza |
| 4,885,885 | A | | 12/1989 | Gottschling |
| 4,901,495 | A | | 2/1990 | Gottschling |
| 4,970,840 | A | | 11/1990 | Ouellette et al. |
| 5,099,626 | A | | 3/1992 | Seeger |
| 5,291,710 | A | * | 3/1994 | Golen ..... 52/311.1 |
| 5,313,761 | A | | 5/1994 | Leopold |
| 5,351,459 | A | * | 10/1994 | Kassl et al. ..... 52/656.5 |
| 5,357,727 | A | | 10/1994 | Duckworth et al. |
| 5,531,047 | A | | 7/1996 | Leopold et al. |
| 5,553,440 | A | | 9/1996 | Bulger et al. |
| 5,601,677 | A | | 2/1997 | Leopold |
| 5,644,894 | A | | 7/1997 | Hudson |
| 5,657,590 | A | | 8/1997 | Digman et al. |
| 5,678,376 | A | | 10/1997 | Poma |
| 5,678,377 | A | | 10/1997 | Leopold |
| 5,899,033 | A | | 5/1999 | Merchlewitz |
| 6,108,999 | A | | 8/2000 | Smith et al. |
| 6,192,652 | B1 | | 2/2001 | Goer et al. |
| 6,219,982 | B1 | | 4/2001 | Eyring |
| D441,875 | S | | 5/2001 | Wylie |
| 6,250,026 | B1 | | 6/2001 | Thompson, Jr. |
| 6,289,641 | B1 | | 9/2001 | McCandless |
| 6,301,843 | B1 | | 10/2001 | Silverman |
| 6,345,485 | B1 | | 2/2002 | Boone et al. |
| 6,415,561 | B2 | | 7/2002 | Thompson, Jr. |
| 6,477,812 | B2 | | 11/2002 | Boone et al. |
| 6,755,004 | B1 | * | 6/2004 | Power et al. ..... 52/845 |
| 6,868,596 | B2 | | 3/2005 | Reichert |
| 6,974,518 | B2 | | 12/2005 | Hornung et al. |
| 2002/0189743 | A1 | | 12/2002 | Hornung et al. |

FOREIGN PATENT DOCUMENTS

| | | |
|---|---|---|
| DE | 196 34 078 | 10/1997 |
| EP | 0 114 218 | 8/1984 |
| EP | 0 329 123 | 8/1989 |
| JP | 53 129432 | 11/1978 |

OTHER PUBLICATIONS

Ashland Hardware Systems catalog pages, “Muntin Clips”, 1 page from http://www.ashlandhardware.com/screen glass.shtml, Jul. 2003.

* cited by examiner

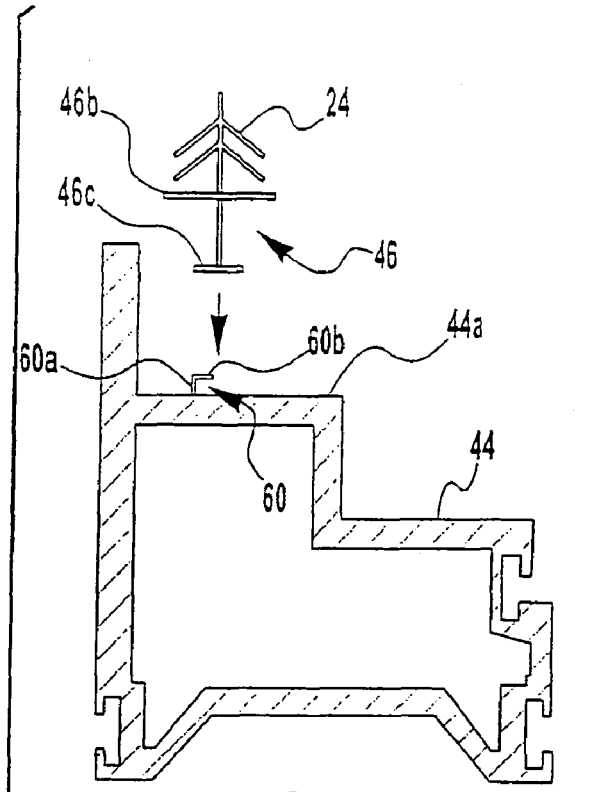
FIG. 6
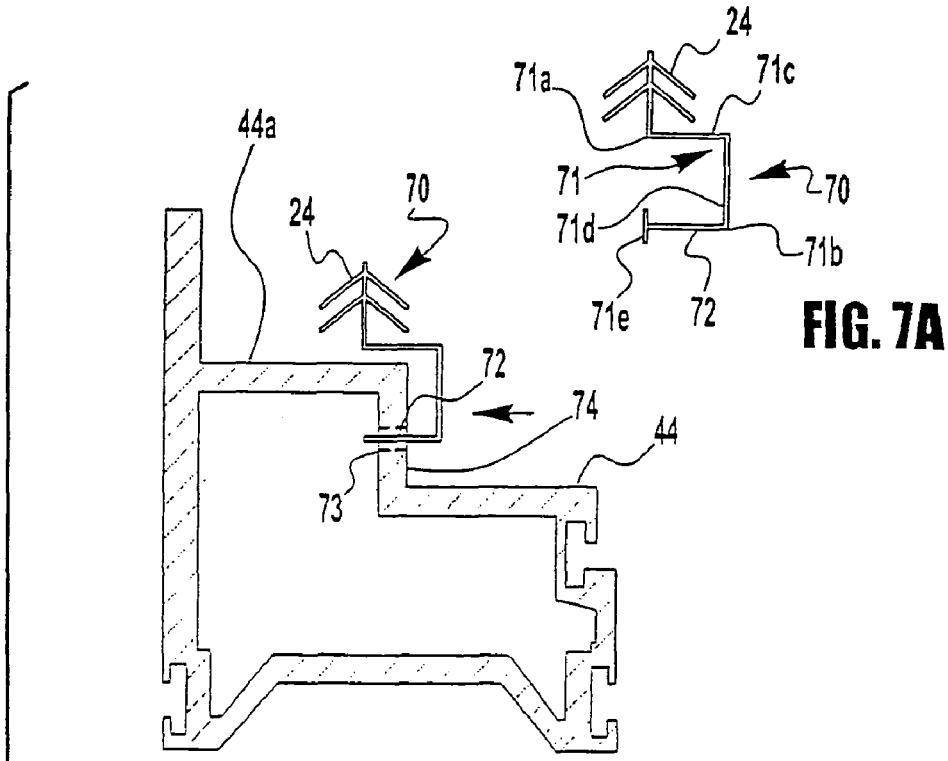
FIG. 7A
FIG. 7

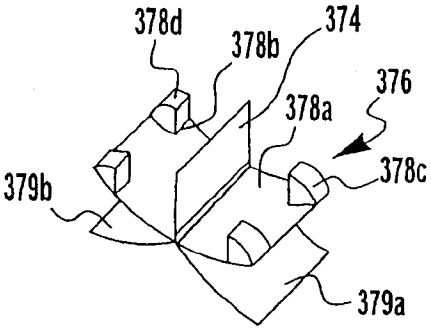
FIG. 37A
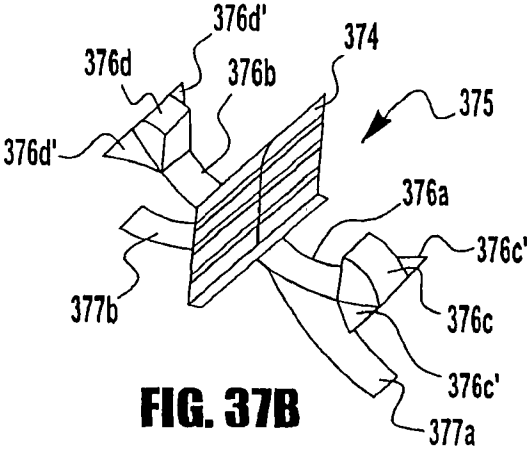
FIG. 37B
FIG. 37C
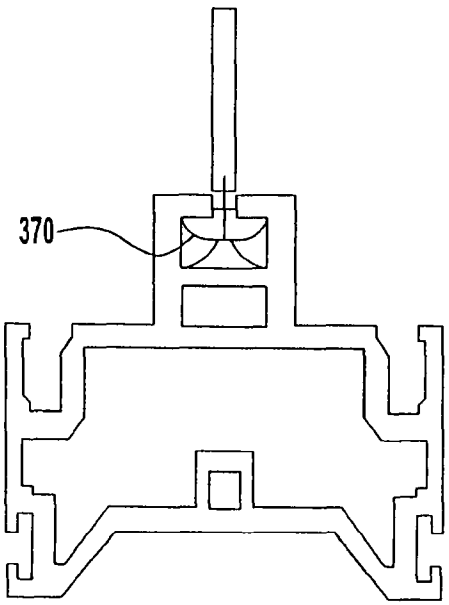
FIG. 38

GRID MUNTIN RETAINING CLIPS FOR MUNTINS

CROSS-REFERENCE TO RELATED APPLICATIONS

This application is a continuation of co-pending U.S. patent application Ser. No. 10/683,568 filed on Oct. 10, 2003 which application claims the benefit of U.S. Provisional Patent Application Nos. 60/420,147 filed on Oct. 22, 2002; 60/457,149 filed on Mar. 24, 2003; 60/459,917 filed on Apr. 3, 2003; and 60/486,332 filed on Jul. 11, 2003, all of which are incorporated herein by reference.

BACKGROUND OF THE INVENTION

The present invention relates generally to residential, commercial and architectural windows and doors, and more particularly to methods and apparatus for fabricating integrated multipane window unit and sash assemblies with simulated muntins.

The methods and apparatus disclosed herein are particularly well suited for integrated sash window designs, such as those disclosed in commonly assigned U.S. Pat. Nos. 6,286,288 and 6,536,182, both incorporated in their entirety herein by reference. In an integrated sash multipane window of the type disclosed in the aforementioned U.S. patents, a spacing and mounting structure is provided for two or more spaced, parallel glazing panes or sheets. The panes can be, e.g., glass or plastic and are typically transparent, although they may be frosted, translucent, colored, etc. as known in the art. When the panes are transparent it is often desired to provide simulated muntins in the space between the panes in order to provide a colonial or other decorative look. In manufacturing such windows, doors and the like, some means must be provided for mounting the simulated muntins (sometimes referred to as "muntin bars" or "divided lights") within the space between the glazing panes. The simulated muntins can be provided as individual bars (either straight, curved, or a combination thereof), partial assemblies of bars, or an entire prefabricated grid.

It would be advantageous to provide low-cost, reliable and easy to assemble components for mounting simulated muntins between glazing panes in a multipane window, door or the like. It would be further advantageous to provide such components that can be used in multipane windows, doors and the like which are fabricated using integrated sash technology. The present invention provides muntin mounting components and methods for using such components which enjoy the aforementioned and other advantages.

SUMMARY OF THE INVENTION

In accordance with the invention, various mounting techniques are provided for simulated muntin bars and the like, i.e., components placed between glazing sheets to provide the look of true divided lights. Hereinafter, the term "muntin" when used alone is intended to refer to a simulated muntin, rather than a true muntin which is defined as a strip of wood, metal or plastic for separating and holding panes of glass in a window. Among the mounting techniques disclosed are various muntin retaining clips for holding simulated muntin components to a spacing and mounting structure for the glazing panes (sheets) of a multipane window, door, or the like.

In a first embodiment, a clip is provided for attachment to a glazing pane mounting structure. The clip comprises a first platform and a second platform. The first platform overlaps the second platform with a space therebetween. The second platform is connected along a first end thereof to the first platform adjacent a first edge of the first platform. The first platform has a second edge opposite its first edge. The second platform extends from its first end to a second, opposite end thereof substantially all the way to the second edge of the first platform. The space between the first and second platforms extends from the first end of the second platform to the second end thereof.

The clip can further comprise a muntin retainer attached to the first platform. The muntin retainer can, for example, be perpendicular to the first platform in a direction extending away from the second platform.

At least one of the first platform, second platform and muntin retainer can be desiccated.

Either or both of the first platform and second platform can be generally rectangular.

In a second embodiment, a butterfly clip is provided for attachment to a glazing pane mounting structure. The butterfly clip comprises four tabs connected at adjoining edges thereof to form a butterfly shaped cross section. A muntin retainer extends from the joined edges of the tabs. At least one of the tabs or muntin retainer is desiccated.

In the butterfly clip embodiment, the first and second tabs can be curved to project upward, with the third and fourth tabs being curved like the first and second tabs but projecting downward.

In a preferred embodiment, the clip is desiccated. For example, the muntin retainer and/or one or more of the tabs can be impregnated with a desiccant.

BRIEF DESCRIPTION OF THE DRAWINGS

FIG. 6 illustrates an embodiment, in cross section, wherein muntin retaining clips are mounted to a stepped sash frame via a bracket secured to the frame;

FIGS. 7 and 7A illustrate an embodiment of muntin retaining clips adapted to be mounted to a stepped sash frame via a clip pin or finger inserted into a corresponding hole in a vertical wall of the sash profile;

FIG. 29 B is a cross section showing a muntin retaining clip snapped onto the mail or pin of FIG. 29A;

FIGS. 37A, 37B and 37C illustrate three different embodiments of a "Butterfly" muntin retaining clip;

FIG. 38 shows a "Butterfly" muntin retaining clip" disposed above the glazing pocket of a sash frame;

DETAILED DESCRIPTION OF THE INVENTION

Figure 1:
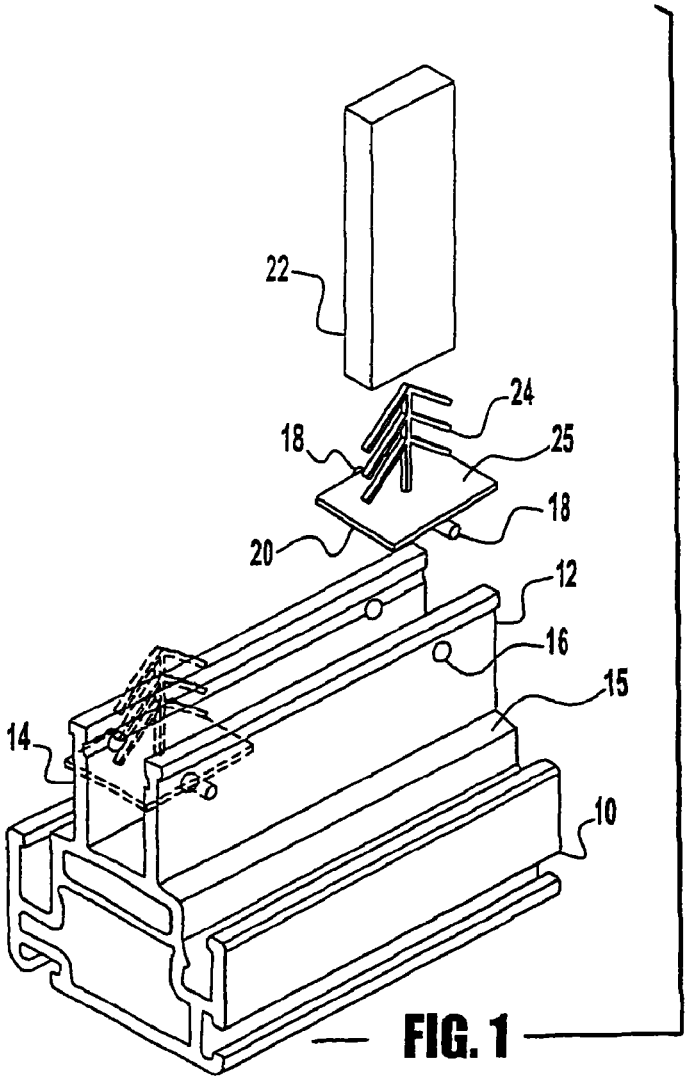
FIG. 1 illustrates an embodiment wherein muntin retaining clips are mounted to a sash frame via clip pins and corresponding holes in the sash frame.
Figure 2:
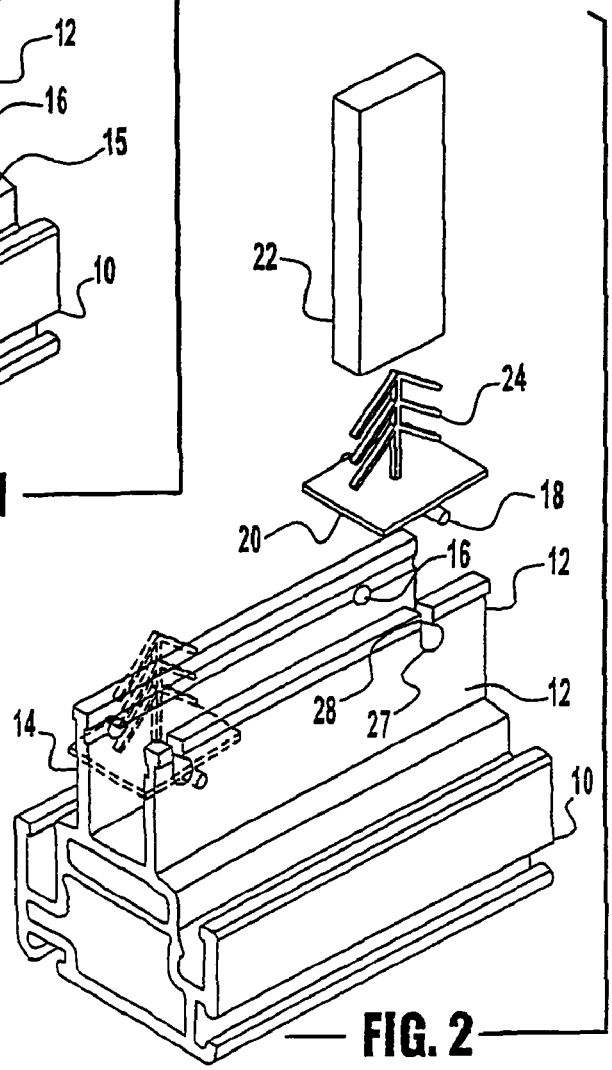
FIG. 2 illustrates an embodiment wherein muntin retaining clips are mounted to a sash frame via clip pins with a corresponding hole in one glazing leg and a corresponding notch and hole in the other glazing leg.

FIGS. 1 and 2 illustrate an integrated, multipane window sash frame 10, which may be fabricated from vinyl, e.g., polyvinyl chloride (PVC) or any other material used for window frames. Such materials can comprise, for example, aluminum, wood, other plastics and the like. The sash frame is provided for use in manufacturing an insulating glass window. The sash frame 10 can be fabricated in any known manner, for example, by extrusion or injection molding. Although only a short section of the sash frame 10 is illustrated, it should be appreciated that the frame material will be provided in various lengths necessary to assemble a complete sash frame, which may be square, rectangular, oval, circular, or any other custom window shape. The illustrated frame 10 may include a channel 15 for retaining a glazing bead or clip (not shown), as is well known in the art.

Referring to FIG. 1, a muntin retaining clip 20 is shown. The muntin retaining clip 20 includes an muntin bar retainer 24 projecting from a clip base 25 and a clip pin 18 affixed thereunder. The muntin bar retainer 24 projects outwardly from the clip base 25 for attachment to the hollow (female) end of a muntin bar 22. It should be appreciated that the reverse configuration can be used instead; i.e., a female receptacle on the clip base 25 with a corresponding muntin retainer projecting from the muntin bar 22. The clip pin 18 extends beyond the ends of the clip base 25 so that it can be interconnected with holes or notches 16 in the glazing legs 12, 14.

To mount the muntin retaining clip 20, first, one side of the clip pin 18 is inserted into a hole 16, such as for example in glazing leg 14 and then the other side of the clip pin 18 is snapped or otherwise fitted into the opposing hole in glazing leg 12.

Although the illustrated embodiment shows glazing legs 12, 14 of the same height, glazing legs of different heights ("stepped structure") can also be provided, with corresponding receptacles, such as hole(s) and/or notch(es), in one or both glazing legs to accommodate a muntin retaining clip of any of the various embodiments disclosed herein (and equivalents thereof) and/or the muntin bar itself. Such a stepped structure may be particularly suitable, for example, in a triple-pane embodiment.

The clip pins 18 can extend beyond the confines of the glazing legs 12, 14, so that if glazing sheets (not shown) are drawn against sealant disposed between the glazing sheets and the glazing legs using a vacuum or a mechanical press, the pins will serve as stops for the glazing sheets.

FIG. 2 illustrates an embodiment that is essentially the same as FIG. 1 except for the use of a combination of hole 27 and notch 28 in glazing leg 12 to receive the clip pin 18 of muntin grid clip 20. The hole 27 is formed through the body of the glazing leg 12 and the notch 28 extends upward and opens at the upper end the glazing leg. The hole 27 and notch 28 allow for the easy insertion of the clip pin 18 which preferably is shaped to snap into the hole 27. Typically, one end of the clip pin 18 is first inserted in the hole 27 in glazing leg 14 by a twisting/tilting method, then the other end of the clip pin can be pressed down or snapped into the notch 28, which may be of slightly smaller width than the diameter of the pin, and then pushed down to seat in the hole 27.

Figure 3:
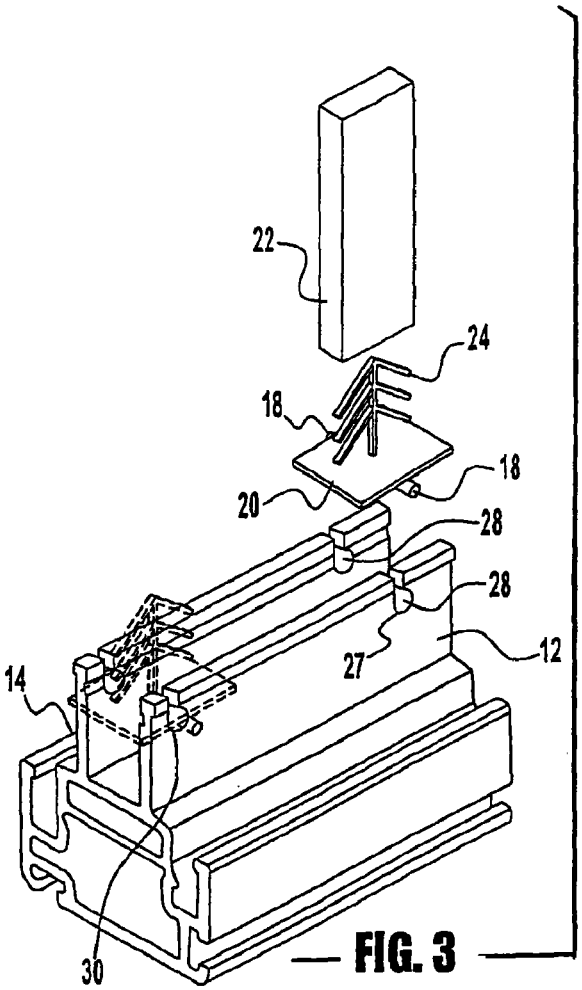
FIG. 3 illustrates an embodiment wherein muntin retaining clips are mounted to a sash frame via clip pins and corresponding notches and holes in both glazing legs.

FIG. 3 illustrates an embodiment similar to that of FIG. 2, except the combination of hole 27 and notch 28 are provided in both glazing legs 12 and 14 to receive both ends of the clip pins 18 of muntin retaining clip 20. Alternatively, holes and notches and corresponding clip pins could be provided on only one side of the sash frame/muntin retaining clip, although such an embodiment may not be as stable as the structure shown here.

Figure 3A:
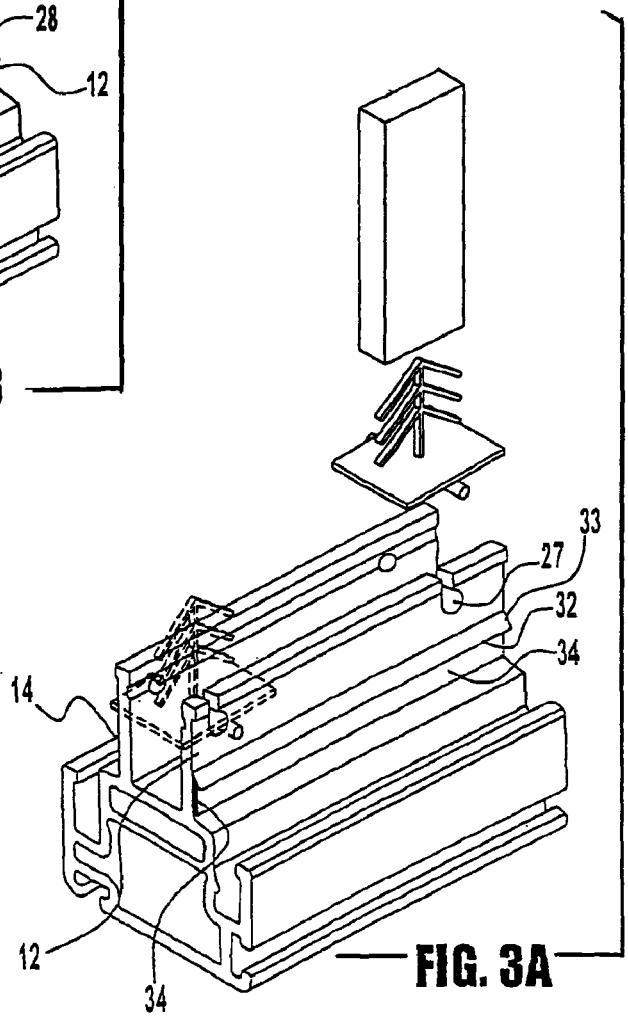
FIG. 3A illustrates an embodiment where a sealant director is provided below muntin bar retaining notches in the glazing leg, the sealant director being useful for either a clip or clipless mounting structure.

FIG. 3A illustrates an embodiment where a sealant director 32 is provided below the notches 27 on one or both glazing legs 12 and 14 to limit the whet-out of sealant and/or to prevent a sealant 34 from flowing through the notches into the space between the glazing legs and thereby into the viewing area of the glazing panes. The sealant director 32 can be formed as a separate construction and then attached to the glazing leg or alternatively, formed integrally with the leg (e.g., as the sash profile is extruded or otherwise formed). The sealant director 32 can be disposed above the sealant bead to decrease stress cracks from occurring and improve performance of the system, i.e., better sealant coverage on the glazing pane (e.g., glass) surface when the glazing pane is mounted to the glazing leg. Although the sealant director 32 is shown with a muntin retaining clip type embodiment, it is within the terms of the present invention to use it with any of the embodiments disclosed herein, including clip-less embodiments.

Figure 4A:
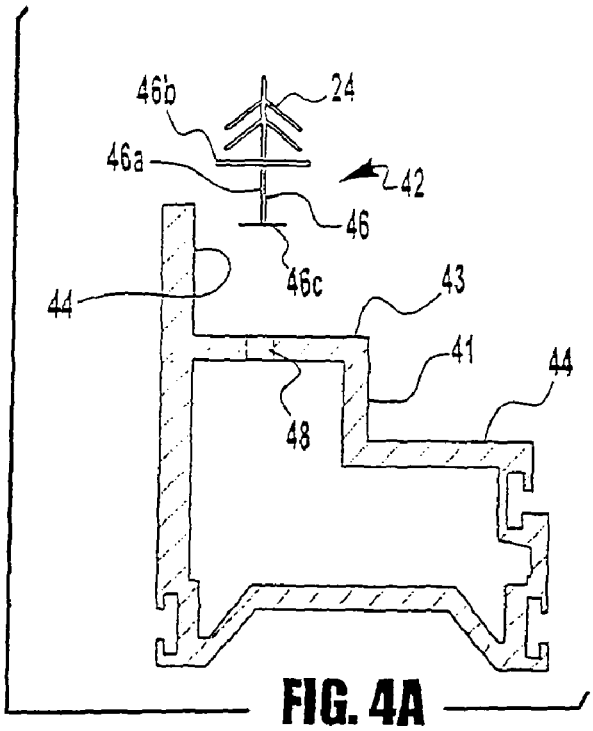
FIGS. 4A and 4B illustrate an embodiment, in cross section, wherein muntin retaining clips are mounted to a stepped sash frame via pins extending from the muntin retaining clips that engage holes in the top of the sash profile.
Figure 4B:
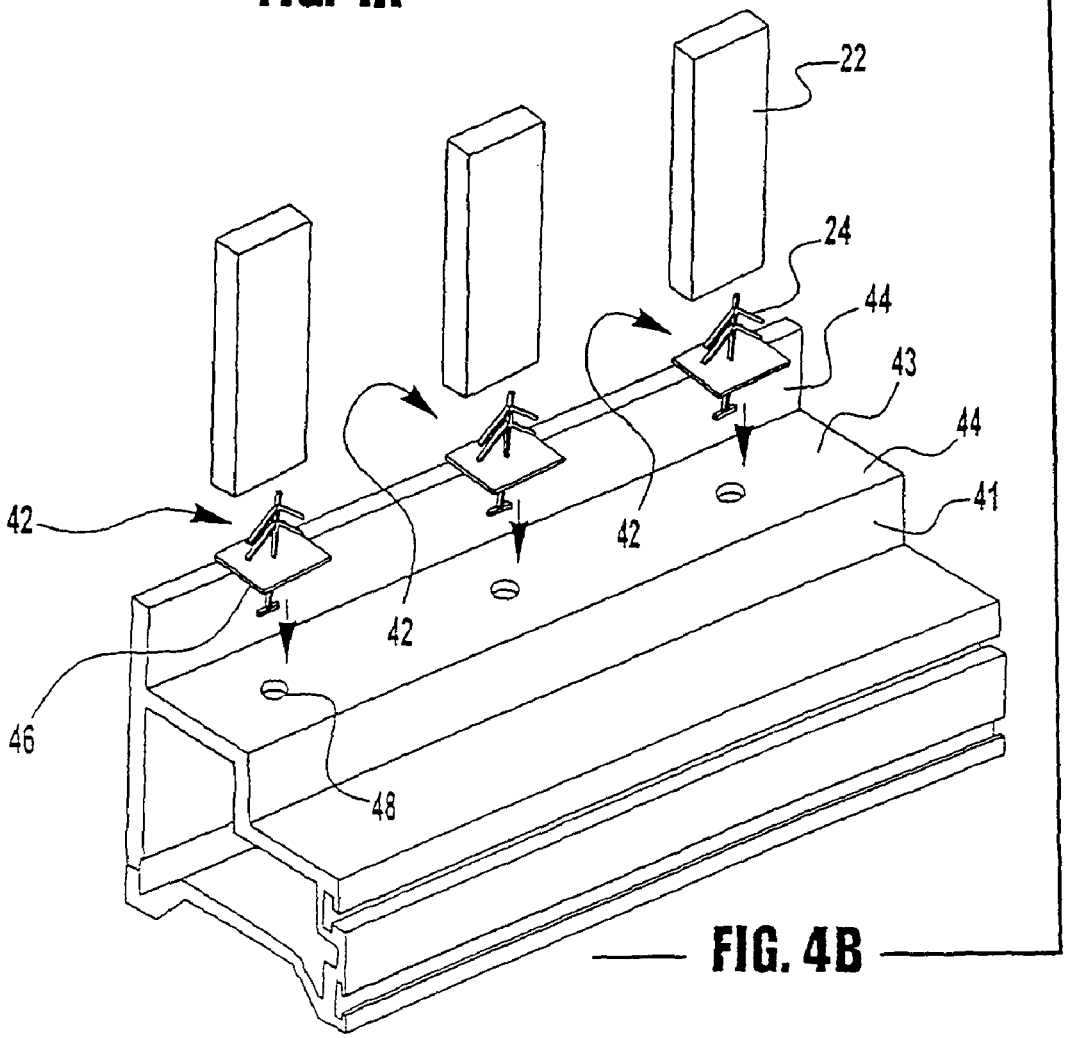

FIGS. 4A and 4B illustrates an embodiment of the invention wherein muntin retaining clips 42 are mounted to the base surface 43 of the spacing and mounting structure of a stepped sash frame 44 via clip pins 46 that project from the muntin retaining clips and engage receptacles, holes, slots, or fastening positions 48 in the base surface 43 of the sash frame. The clip pins 46 have a leg section 46*a*, a base support 46*b* that is substantially perpendicular to and integrally attached to one end of the leg section 46*a*, and an end attachment section 46*c* that extends substantially perpendicular to and is integrally attached to the opposite end of leg section 46*a*. The base support 46*b* is attached to muntin bar retainer 24 and the end attachment section 46*c* is sized to be force fitted through receptacles 48 in the base surface 43 of sash frame 44. Any other suitable configuration of the clip pins and corresponding receptacles in the base surface 43 may be used instead of the particular configuration illustrated.

As shown in FIG. 4B, any combination of muntin bars 22 and/or a pre-assembled muntin grid(s) may be mounted to the base surface 43 of the glazing chamber which is disposed between the glazing panels (not shown). Such glazing panels will be mounted (e.g., using adhesive sealant) to receiving surfaces 41, 43 of the spacing and mounting structure. Receptacles, holes, slots, or fastening positions 48 may be punched, drilled, or milled into the base surface, as required. As in the other embodiments disclosed herein, the illustrated muntin retaining clips 42 are only an example of a suitable clip and other shapes and structures of mounting clips as disclosed herein are suitable substitutes.

Figure 5A:
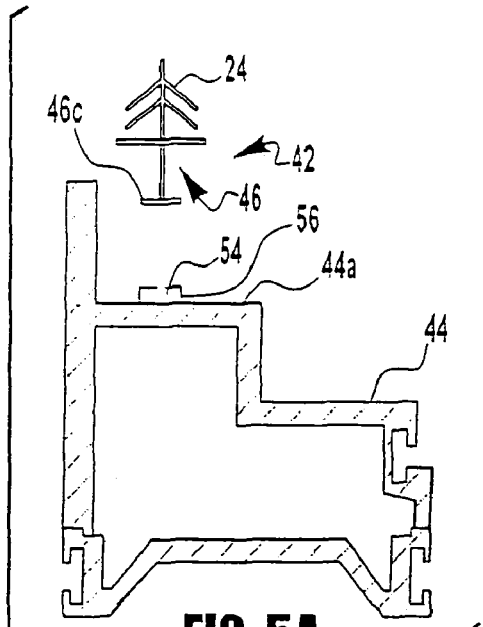
FIGS. 5A and 5B illustrate an embodiment wherein muntin retaining clips are mounted to a stepped sash frame via a slot arrangement attached to the frame.
Figure 5B:
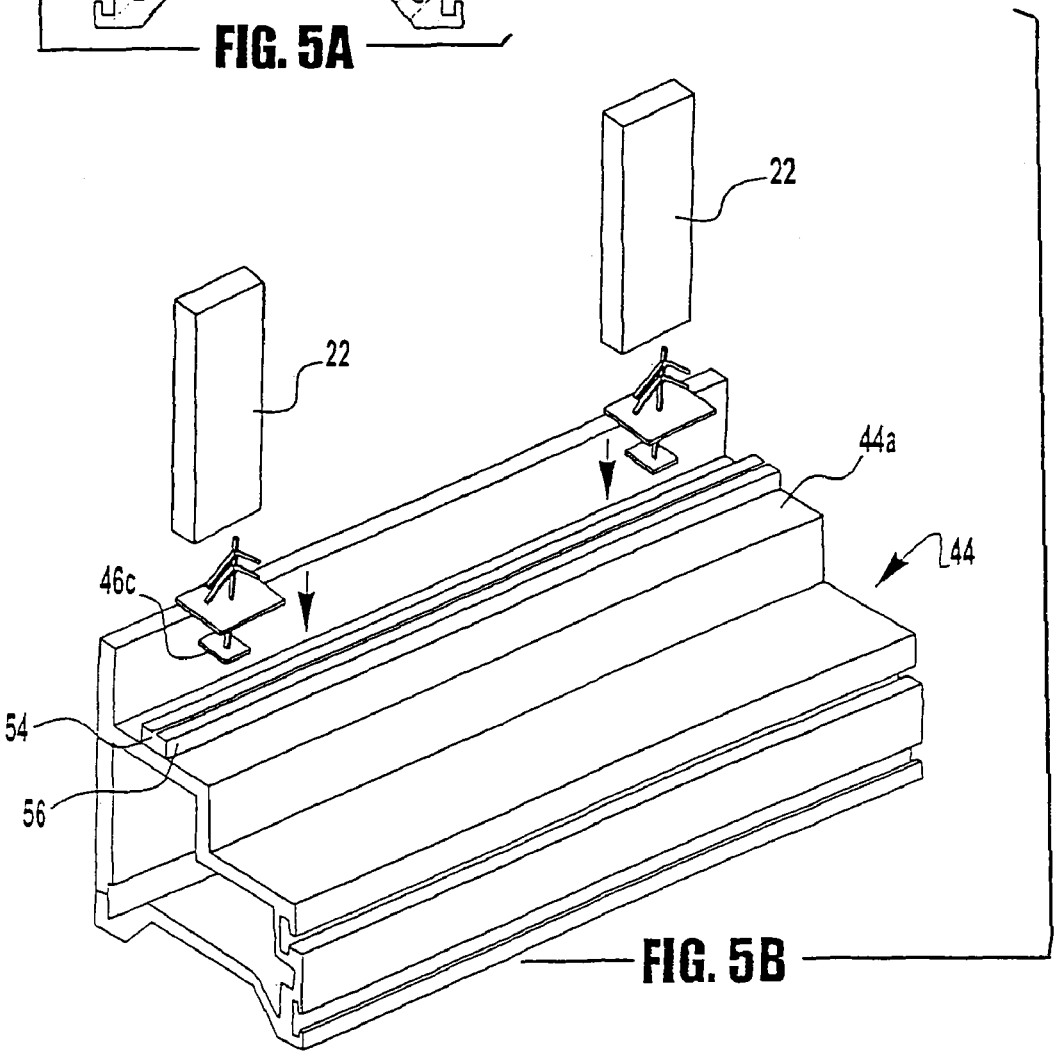

FIGS. 5A and 5B illustrate an embodiment of the invention wherein the muntin retaining clips 42 are mounted to the base surface 44*a* of the glazing chamber of a stepped sash frame 44 using clip pins 46 extending from the muntin retaining clips. The clip pins 46 are shaped so that the lower section 46*c* is adapted to engage a slot 54 in a channel 56 that may be extruded or otherwise provided on the base surface 44*a*. The lower section 46*c* can be inserted into one end of the channel 56 and moved into position or alternately forced through the slot 54. Alternatively, the slot 54 may receive a corresponding notched end formed in the end of the muntin bars (not shown, although in the manner of the embodiment shown in FIG. 51D), providing a clip-less solution for holding the muntin bars 22.

FIG. 6 illustrates a muntin retaining clip 46 adapted to mount an individual muntin bars or an entire grid assembly, as described elsewhere herein, to the base surface 44*a* of the glazing chamber of a stepped sash frame 44 using an L-shaped bracket 60 onto which the muntin retaining clip 46 attaches. The bracket 60 has one leg 60*a* attached at its free end to the base surface 44*a* of sash frame 44 and another leg 60*b* that extends substantially perpendicular to the leg 60*a*. The bracket 60 can be formed as a single partial bracket, a plurality of which are mounted individually to (or formed integrally with) the base surface 44*a* or as an extrusion member and mounted in a manner shown in FIG. 5B. The clip pin 46, as previously described, with the base support 46*b* attached to muntin retaining clip 24 and the lower section 46*c* extending from the pin, is configured in such a manner that it slips under the leg 60*b* or otherwise attaches to the bracket or extrusion member 60. As in the other embodiments disclosed herein, the muntin retaining clip 46 as illustrated is only an example, and many other shapes and structures, as for example others disclosed herein, can also be used.

In a similar embodiment (not illustrated), a slot can be recessed directly into the base surface 44*a* instead of the slot extending above the base, as shown. Again, the muntins can either be mounted to the recessed slot with or without a muntin retaining clip. Instead of a slot, a closed channel, as shown in FIG. 5B can be recessed into the base surface 44*a*.

FIGS. 7 and 7A illustrate an embodiment of a muntin retaining clip 70 that is generally formed as an L-shaped body 71 of two perpendicular disposed glazing legs 71*c* and 71*d*. The muntin retaining clip 70 includes a muntin retainer 24 or other suitable mounting structure attached to one end 71*a* for attachment to a muntin bar 22 and a clip pin or finger 72 attached to an opposite end 71*b* of leg 71*d*. The pin 72 is adapted to be inserted into corresponding receptacles or holes 73 in a side wall 74 of the glazing chamber of a stepped sash frame 44. The free end of the pin 72 can include an optional end section 71*e* sized to prevent the pin 72 from being easily removed from the receptacle 73 into which the pin 72 is inserted. The muntin retaining clips 70 may be stamped, roll formed, pressed or molded and can be fabricated from any suitable material such as metal, plastic or foam. Advantageously, muntin retaining clips 70 can be installed on a pre-assembled muntin grid (not shown), and the whole grid and muntin retaining clip assembly can be placed on top of the sash frame 44 when the sash frame is laid down horizontally on a work surface with the holes 73 facing up. The pins 72 will then slide into the corresponding holes 73 of the sash frame 44 with the help of gravity. The muntin retaining clip 70 will provide improved support for the muntin bars because the leg 71*c* of the L-shaped body 71 rests against the base surface of the frame 44. It is also with the terms of the invention to assemble the sash frame 44 and muntin bar structure in a vertical or any other desired position.

Figure 8:
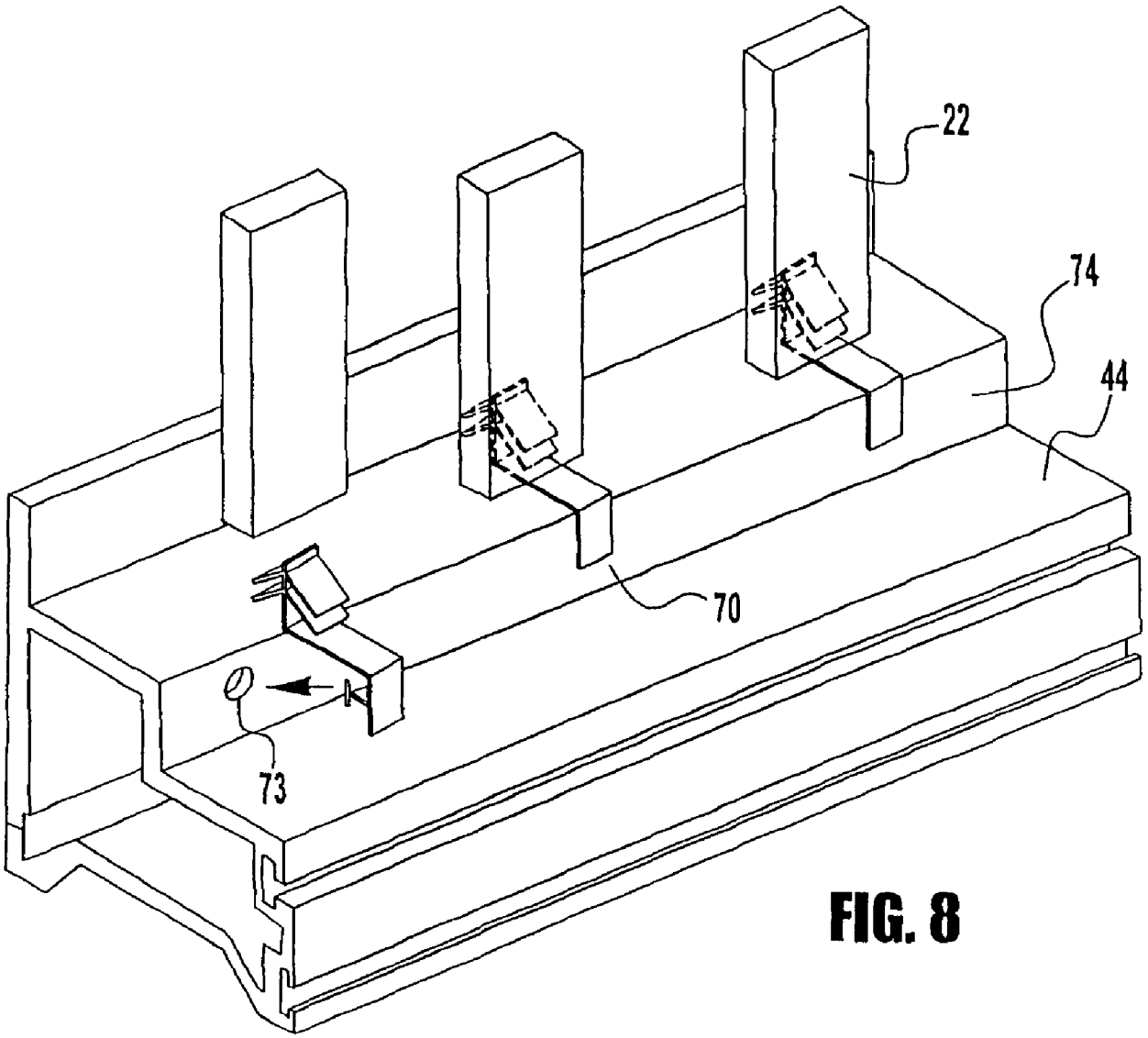
FIG. 8 illustrates a stepped sash frame with a plurality of muntin retaining clips of the type shown in FIG. 7 mounting muntin bars.

FIG. 8 illustrates a plurality of muntin retaining clips 70, as shown in FIGS. 7 and 7A, fitted into or attached to a corresponding hole, receptacle, punched slot or opening 73 in the side wall 74. The design of the muntin retaining clip 70 enables it to be mounted to the sash frame by the application of a double-sided tape or liquid adhesive on the sash frame facing side of legs 71*c* and/or 71*d* without a locating hole 73, or with a combination of a locating hole and the liquid adhesive or tape. In an embodiment without locating holes 73, indicia (e.g., dots) can be printed or otherwise marked onto the sash profile at predefined locations to assist an assembler in placing the clips 70 in proper locations.

Figure 9A:
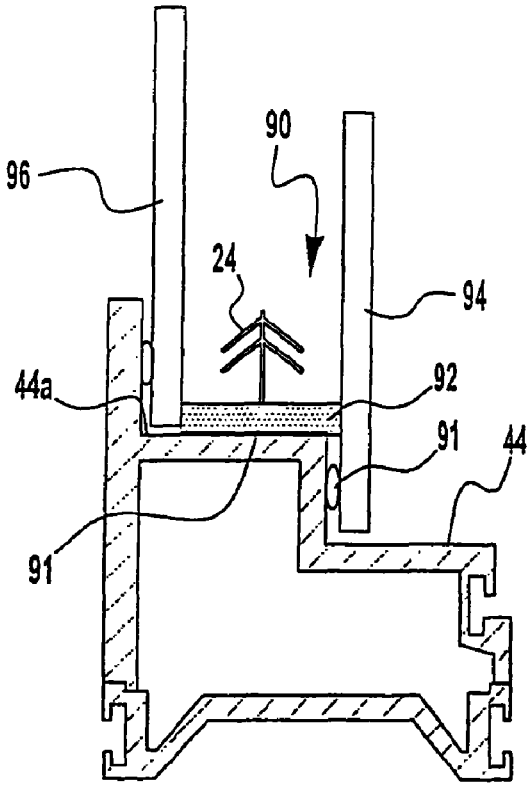
FIGS. 9A to 9C illustrate an alternate muntin bar mounting structure.
Figure 9B:
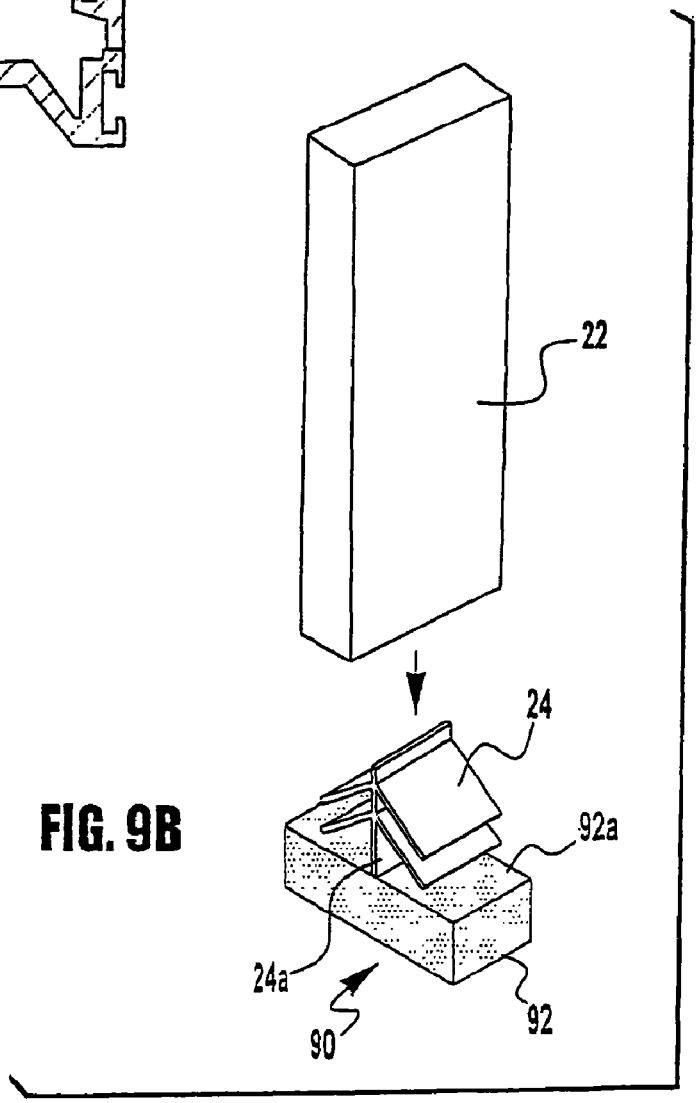
Figure 9C:
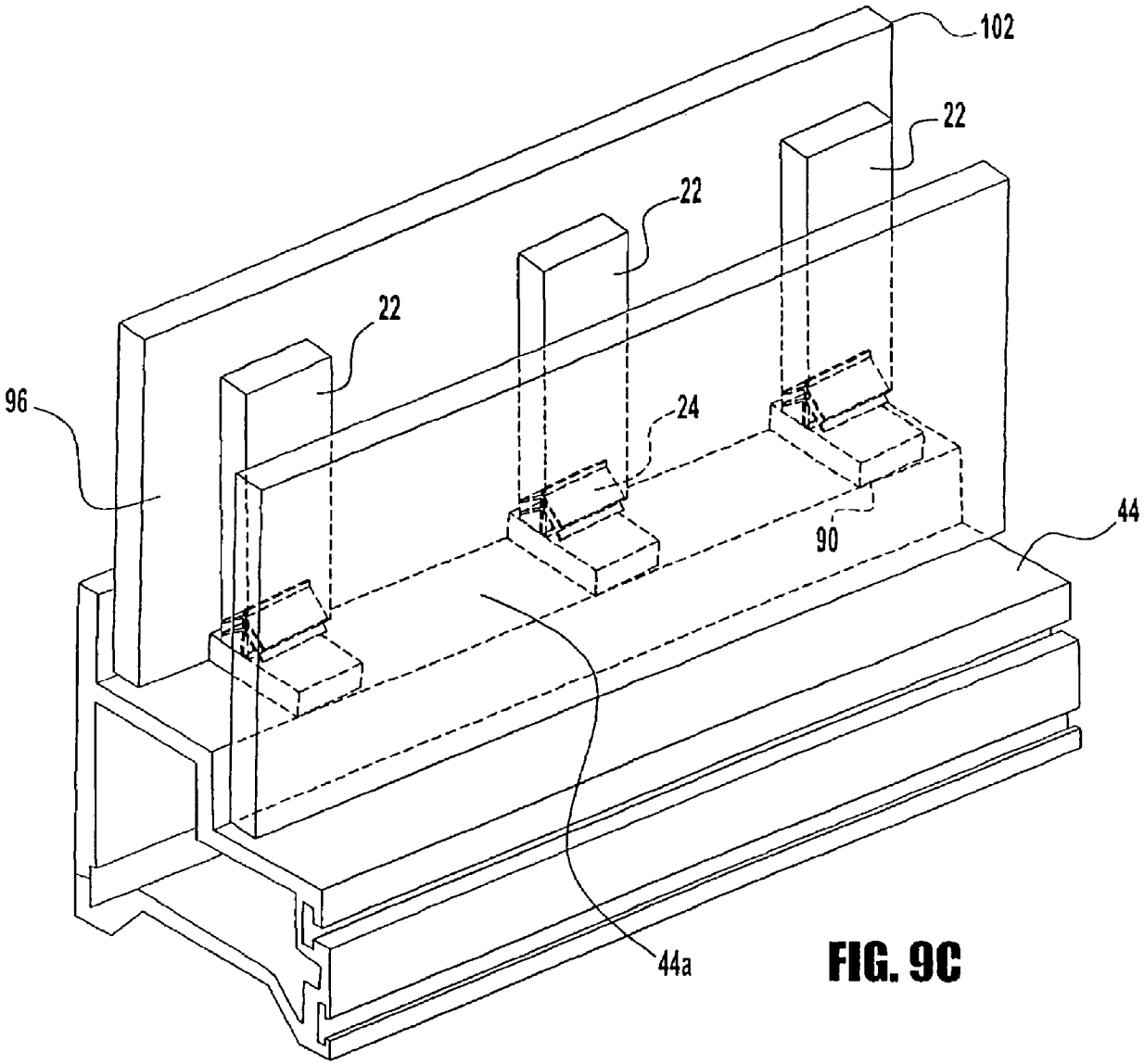

FIGS. 9A, 9B, and 9C illustrate that a plurality of mounting mechanisms 90 can be provided for retaining a muntin bar or grid. Such mounting mechanisms 90 may comprise, for example, clips or blocks 92 that include a muntin retaining clip retainer 24. The blocks 92 can be of any suitable dimensions and shape, and can be made out of any one or combination of various materials, such as an adhesive foam. In one advantageous implementation, the blocks are formed from a material (e.g., adhesive foam) that includes a desiccant. As described hereinabove, the clip retainer 24 is secured to the mounting mechanism 90 by any means such as its upright leg 24*a* being secured within a slot (not shown) formed from the upper surface 92*a* of the muntin retaining block 92. The muntin retaining block 92 and the clip retainer 24 or other suitable mounting structure is attached to the female opening in muntin bar 22. In the embodiment shown, the muntin retaining clip 92 is adhered to the glazing chamber surface 44*a* of the sash frame 44 or to a surface one or both of the glazing panels 94 or 96. As noted above, instead of providing the retainer 24 on the retaining block 92, a female opening can be provided to receive a corresponding retainer projecting from the muntin bar 22.

The muntin mounting structure (e.g., muntin retaining block 92) may be glued, taped bonded, spot welded, sonically welded, heat welded, tacked, or pressure fit into position. Sealant, adhesive, peelable tape or any other suitable means for attaching the muntin retaining clip 90 to the glazing panels 94, 96 and/or the glazing chamber surface 44*a* can be used, including hardware fasteners. In the embodiment shown in FIG. 9A, sealant 91 is illustrated as an example only. As noted above, the muntin retaining block 92 itself can be desiccated. For example, if the muntin retaining clip or block is made of a foam material, it can be desiccated by impregnating it with a desiccant. A desiccated adhesive foam can be used to fabricate the muntin retaining clips or blocks 92, and may reduce cost and facilitate the simple manufacture of windows using the integrated sash technology. The muntin bar 22 can be inserted onto the muntin retainer 90 either before or after the muntin retainer is mounted.

Figure 10:
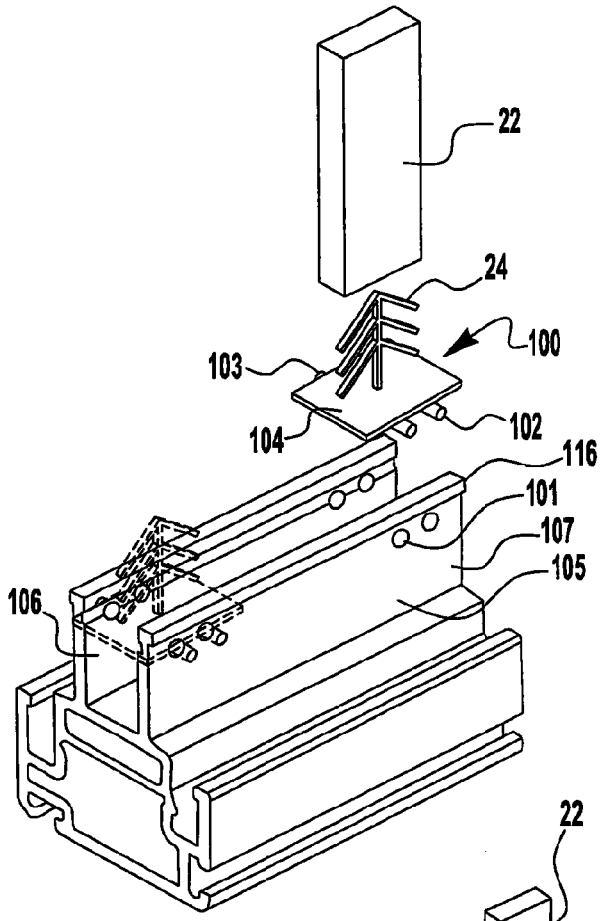
FIG. 10 illustrates a variation of the embodiment of FIG. 1, in which multiple clip pins are provided on each muntin retaining clip.

FIG. 10 illustrates a muntin retaining clip 100 having a plurality of clip pins 102, 103 disposed in parallel relationship and secured to the bottom surface of muntin retaining clip base support 104, in a manner similar to the embodiment shown in FIG. 1. The muntin retaining clip 100 includes a clip retainer 24 or other suitable mounting structure (e.g., a female receptacle) for attachment to a muntin bar 22. Receptacles such as holes 101 corresponding to the spacing between clip pins 102, 103, are provided on the glazing legs 105,106 of the spacing and mounting structure 107 to receive the clip pins 102,103. This design provides additional stability for the muntin retaining clips 100, preventing any pivotal rotation about the pins 102, 103. As shown in and described with regard to FIGS. 2 and 3, the holes 101 can be replaced by holes and slots, as desired.

The clip pins 102, 103 can extend beyond the confines of the glazing legs 105,106, so that if glazing sheets (not shown) are drawn against sealant disposed between the glazing sheets and the glazing legs using a vacuum or a mechanical press, the clip pins will serve as stops for the glazing sheets.

Figure 11B:
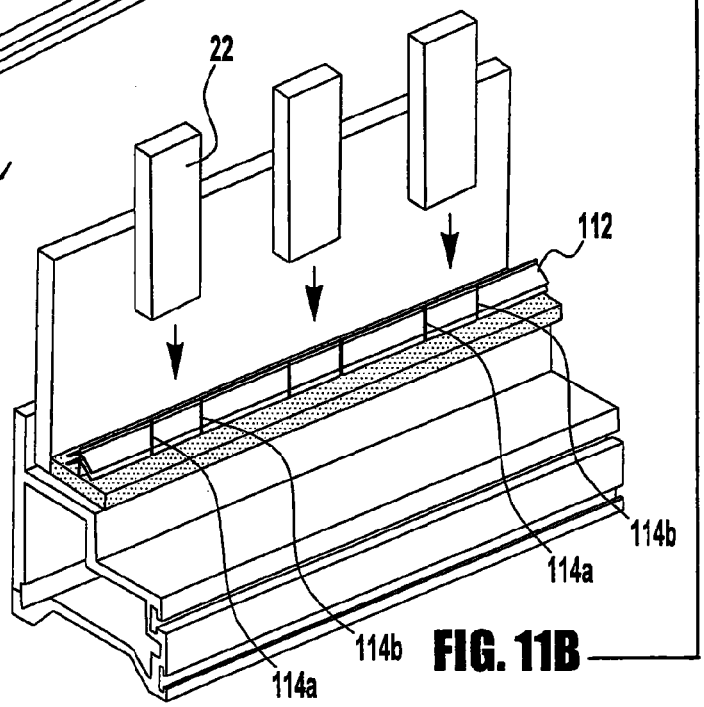
FIGS. 11A and 11B illustrate an embodiment wherein muntin mounting projections are formed along a continuous strip that is secured to a continuous muntin retaining clip.
Figure 11A:
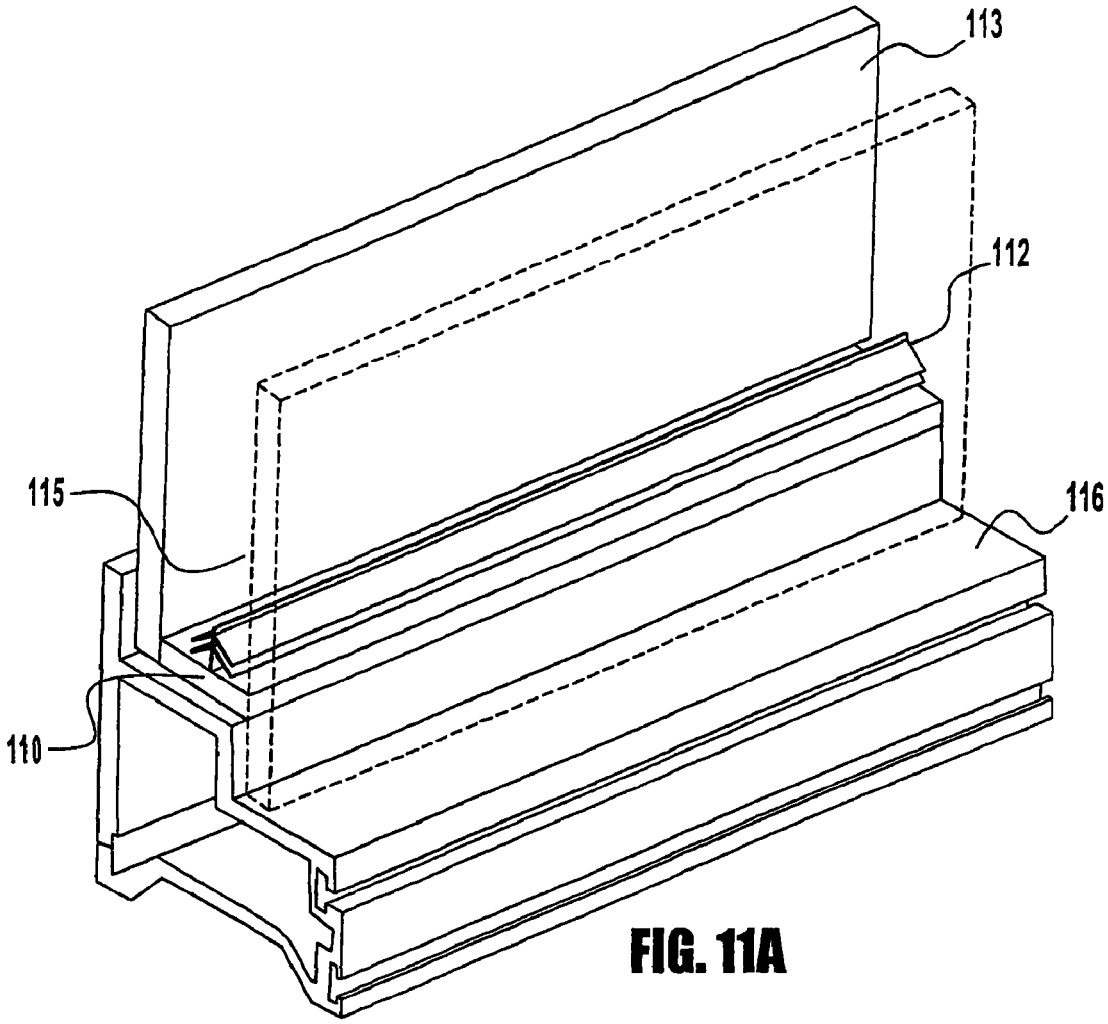
Figure 11C:
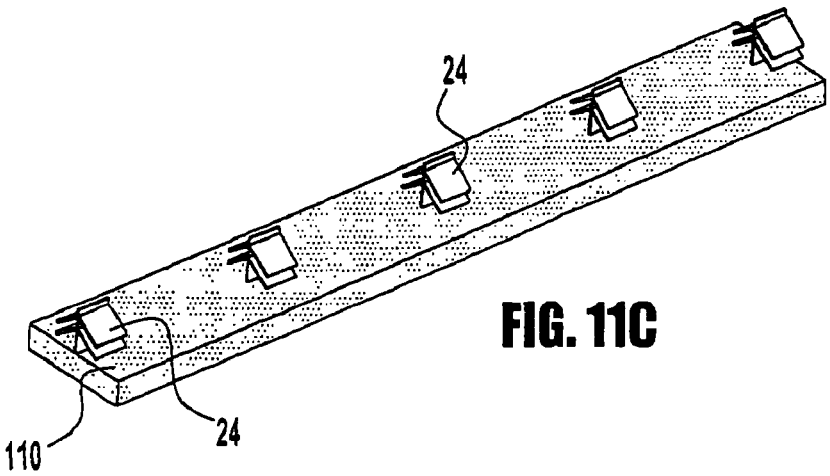
FIG. 11C illustrates an embodiment similar to that of FIGS. 11A and 11B but wherein individual muntin mounting projections are secured to a continuous muntin retaining clip.

FIGS. 11A, 11B, and 11C illustrate an embodiment wherein instead of individual muntin retaining clips as described hereinbefore, an elongated clip strip 110 (e.g., adhesive foam) can be provided with a muntin clip retainer 112 for mounting a muntin grid or individual muntin bars. The clip strip 110 can advantageously include adhesive and/or sealant properties, so that it can serve to mount the glazing panels 113, 115 to the sash frame 116 as well as to mount the muntin bars or grids between the glazing panels. Additional sealant(s) and/or adhesives can be used on the clip strip 110, as required, to provide a structure with the desired functionality. The clip strip 110 may also be desiccated. Extending and secured to clip strip 110 is the elongated muntin clip retainer 112 that has the same cross section as retainer 24 but has a length that can extend substantially the length of the clip strip 110. The clip strip 110 can be extruded, injection molded or otherwise fabricated, with pairs of spaced notches 114*a*, 114*b*, as shown in FIG. 11B, in order to mount a plurality of muntin bars 22. As in the previous embodiments, the muntin clip retainer 112 fits within the opening in the muntin grid or muntin bars 22.

Although a continuous, elongated retainer 112 has been described, a plurality of discrete muntin retainers 24, as described hereinabove, can be attached to the strip 110, at appropriate spacings, for insertion into corresponding openings in the muntin grid or bars, see FIG. 11C.

The elongated muntin retainer 112, as shown in FIGS. 11A and 11B, and the individual muntin retainers 24 of FIG. 11C, can be formed from the same material as clip strip 110, or from a different material. For example, the muntin retainers may be extruded or injection molded of the same material together with the clip strip 110. Alternatively, similarly shaped retainers can be extruded or injection molded directly into the sash frame itself, in which case they are integral with the sash frame and not separate component parts. In such an embodiment, the clip strip 110 is not required.

Figure 12A:
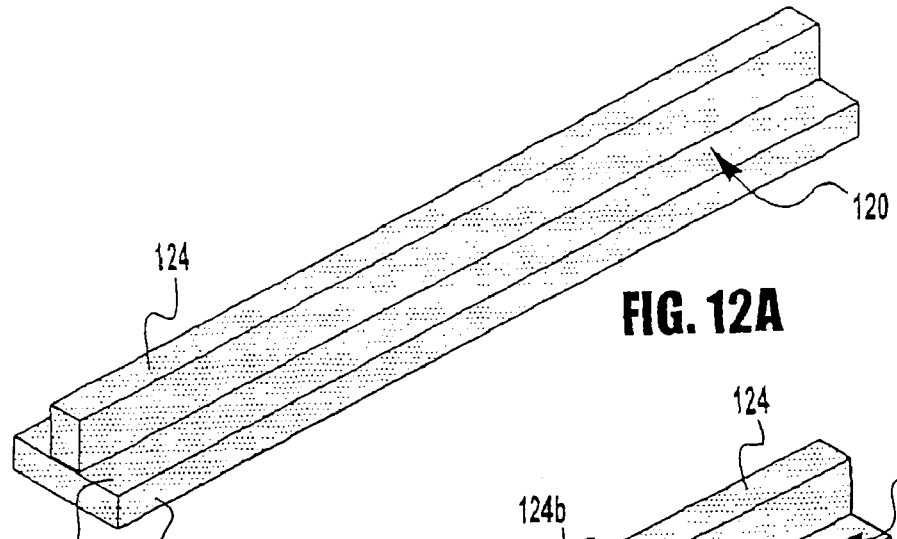
FIGS. 12A, 12B and 12C illustrate an embodiment wherein muntin bar receiving channels are provided on a continuous muntin retaining clip.
Figure 12B:
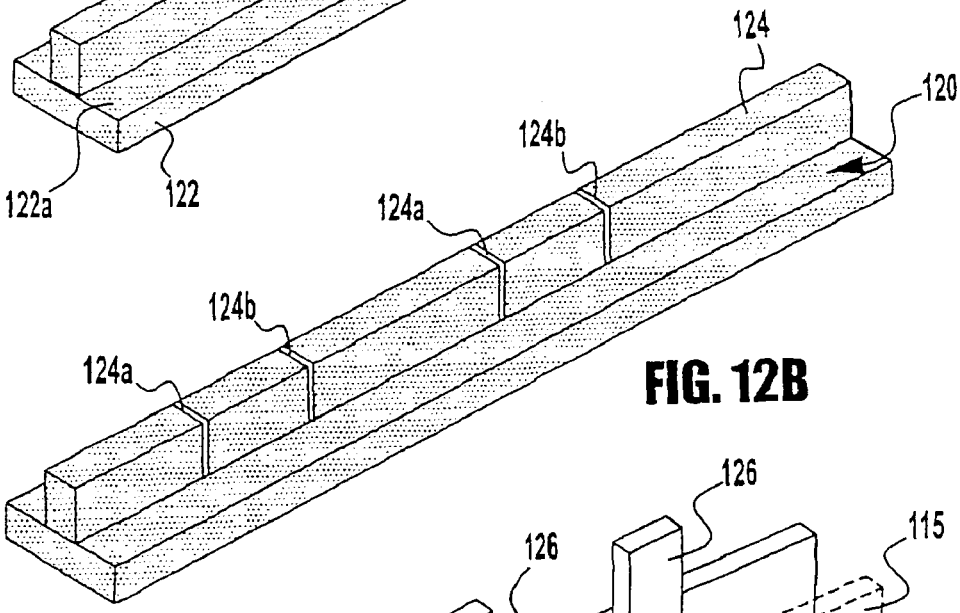
Figure 12C:
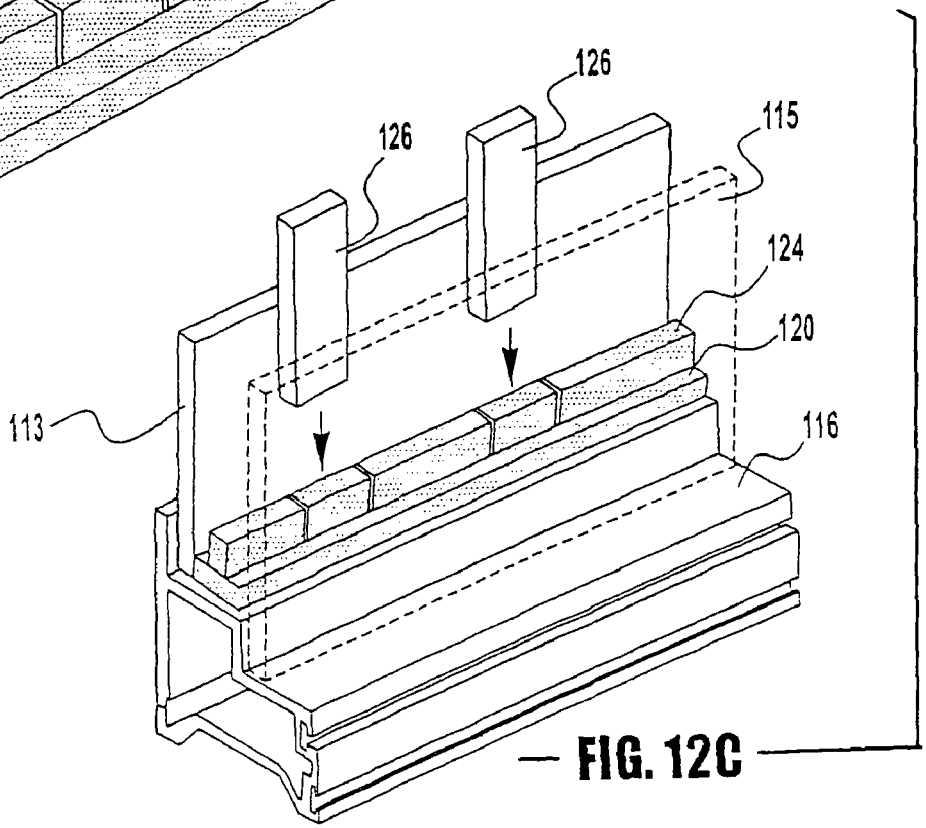

FIGS. 12A, 12B, and 12C illustrate a muntin retaining strip 120 shown having an inverted T-shaped cross section with a base section 122 and an upstanding leg section 124 disposed on the upper surface 122*a* of the base section. The strip 120 can be extruded, injection molded or otherwise fabricated with pairs of spaced notches 124*a*, 124*b* (See FIG. 12B) formed in the upstanding strip 124. The spaced notches 124*a*, 124*b* are adapted to mount a plurality of muntin bars (which can be separate or part of a prefabricated muntin grid assembly). Referring to FIG. 12C, there is shown the retaining strip 120 secured to the surface of a sash frame 116. The end of the muntin bar 126 can be held in the spaced notches 124*a*, 124*b* by friction, adhesive, a snap fit, or simply by a pressure fit of the muntin bar between the spaced notches. As with the embodiments of FIGS. 11*a* and 11*b*, the strip 120 may be made of adhesive foam or other material, which may be desiccated and used to mount the glazing panes as well as the muntins.

Figure 13:
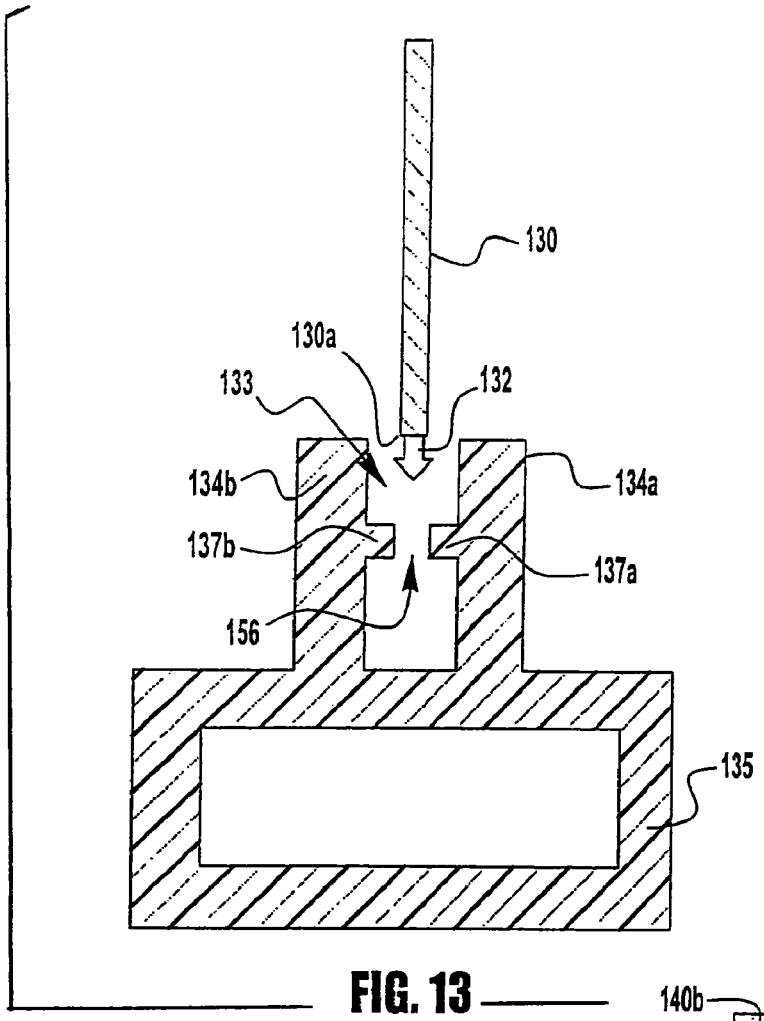
FIG. 13 is a cross sectional view of an embodiment for mounting a muntin bar to a sash frame without a muntin retaining clip.

FIG. 13 illustrates a clip-less embodiment, wherein muntin bar 130 (which can be part of a prefabricated muntin grid assembly) has a projection 132 extending outward from one end 130*a* thereof. In a preferred embodiment, the projection 132 is formed integrally with the muntin bar 130, although it could alternatively be a separate element such as a pin that mounts to the one end 130*a* of muntin bar 130. The projection 132 is configured (e.g., with a pointed head as shown) to lock into a notch, slot or other suitable opening 133 formed in or between the glazing legs 134*a*, 134*b* of a sash frame 135. In the illustrated example shown in FIG. 13, a slot 136 is provided between opposed projections 137*a*, 137*b* that can be extruded or otherwise fabricated into the sash frame 135. The slot 136 receives the projection 132 and secures the muntin bar 130 in place. Other clip-less structures can be realized by forming the sash frame in an appropriate manner and/or using a notch, routed receptacle, punched configuration or an injection molded sash element in conjunction with a muntin bar having a projection, for example as shown in FIG. 13.

Figure 14:
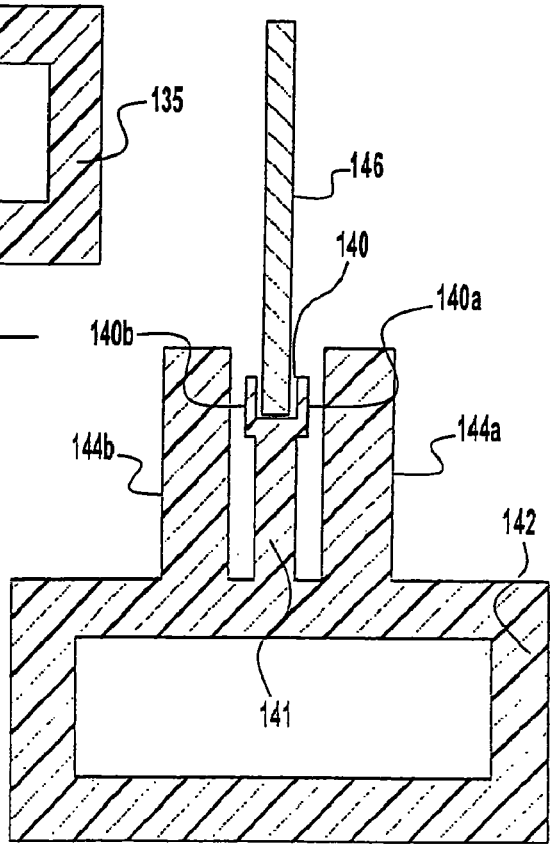
FIG. 14 is a cross sectional view of another embodiment for mounting a muntin bar to a sash frame without a muntin retaining clip.

FIG. 14 illustrates a clip-less embodiment where one end of a muntin bar 146 (which can be part of a prefabricated muntin grid assembly) is mounted to a post 141 that projects from the sash frame 142 between the glazing legs 144*a*, 144*b* of the sash frame 142. The muntin bar 146 is inserted into a channel 140, formed with spaced side walls 140*a*, 140*b*, disposed at the free end of the post 141. Instead of a plurality of separate posts 141 disposed along the length of the sash frame 142, one for each separate muntin bar 146, an elongated post with a continuous channel (not shown) can be provided along the entire length of the sash frame. In either case, the spaced posts 141 or the elongated post with a continuous channel can be manufactured as an integral part of the sash frame 142 when the sash frame itself is molded, extruded, etc. Alternatively, the plurality of posts 141 or the continuous channel can be a separate component attached to the sash frame 142 using adhesive, hardware fasteners, ultrasonic or chemical welding, or the like. The end of the muntin bar 146 can be held in the channel 140 by friction, adhesive, a snap fit, or simply by a pressure fit of the muntin bar between the channel shown and a similar channel in the sash frame at the opposite end of the bar (not shown). Where the muntin bar or grid is held by pressure fit between opposite channels, it may be necessary to bow the muntin bar or grid slightly to insert both ends thereof into their respective channels. Once the muntin bar or grid is seated in the opposite channels, it will straighten back out. For such an embodiment, it will be necessary for the muntin bar or grid to be resilient enough to enable the bowing to occur without breaking.

Figure 15:
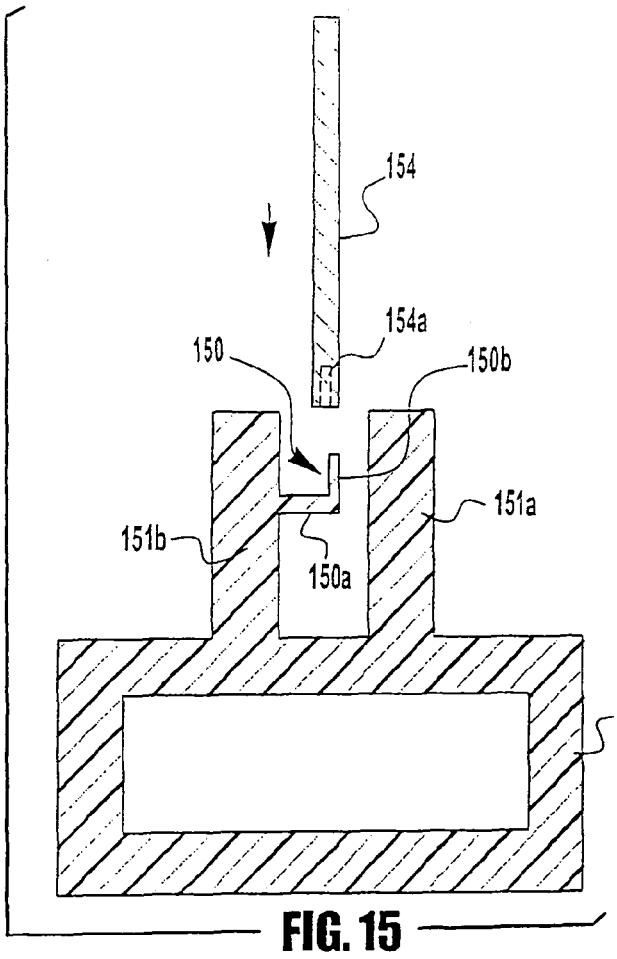
FIG. 15 is a cross sectional view of another embodiment for mounting a muntin bar to a sash frame without a muntin retaining clip.

FIG. 15 illustrates a clip-less embodiment where a muntin bar retainer 150 extends from glazing leg 151*b* of the sash frame 152. The muntin bar retainer 150 can be constructed of a retainer base 150*a* secured, e.g., at one end to the glazing leg 151*b*. The opposite end of the retainer base 150*a* has an upstanding retainer tip 150*b* of any desired shape to be inserted into the bottom of the muntin bar 154. In the example shown, the hollow end 154*a* of muntin bar 154 simply fits over the retainer tip 150*b*. However, the retainer tip 150*b* could be shaped to frictionally engage the inside of the muntin bar with a press fit, or could provide a snap fit or the like. As noted above, the design can be reversed such that a female receptacle is provided for the retainer 150 and a corresponding male part is provided on the muntin bar. Moreover, the muntin bar retainer 150 can be attached at any suitable point along the glazing leg 151*b* or to both glazing legs 151*b* and 151*a*. Alternatively, the retainer muntin bar 150 could be attached to the bottom wall (base) of the sash frame 152. The muntin bar retainer 150 can be integrally formed with the sash frame 152, e.g., as part of the glazing leg 151*b* when the sash frame is fabricated. Such fabrication can be done using injection molding or extrusion techniques, or any other suitable manufacturing method. Any number of variations to the structure and fabrication/mounting of the muntin bar retainer 150 within the scope of the invention will be apparent to those skilled in the art. Structures that are clip-less (as shown), as well as structures that use clips are envisioned. For example, a muntin bar retaining clip can be used to connect the end of a muntin bar to the retainer 150, although such a design is less desirable in that it requires the use of an additional part (i.e., the clip). At least one surface of the retainer 150 could be notched to accept a clip or a mating element of a muntin bar.

Figure 16:
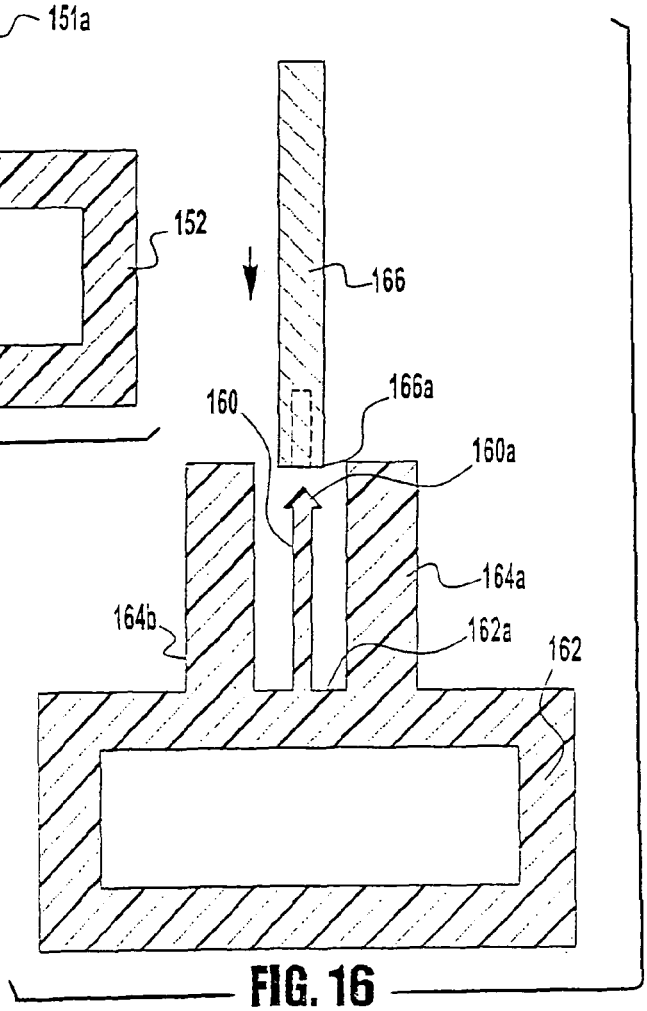
FIG. 16 is a cross sectional view of another embodiment for mounting a muntin bar to a sash frame without a muntin retaining clip.

FIG. 16 illustrates a clip-less embodiment where a muntin bar retainer 160 with a barbed, pointed tip 160*a* extends from the bottom wall (base surface) 162*a* of the sash frame 162 between the glazing legs 164*a*, 164*b*. The retainer 160 shown can be one of a plurality of such retainers (e.g., posts) that extend from the base surface 162*a* of the sash frame 162 along its length, in registration with the hollow end 166*a* of a muntin bar 166 that simply fits over the retainer tip 160*a*. Moreover, the retainer tip 160*a* could be shaped to frictionally engage the hollow inside of the muntin bar with a press fit, or could provide a snap fit or the like. The retainer 160 can be attached at any suitable point along the base surface 162*a*, and can be integrally formed with the sash frame 162, e.g., as part of the base 162*a* when the sash frame is fabricated. A plurality of muntin bars 166 (which can be part of a refabricated muntin grid assembly) can be provided to be held within the sash frame between the glazing sheets. Alternatively, the retainer 160 can comprise a continuous wall that runs along the length of the sash frame 162, with periodic barbed, pointed tips 160*a* or the like for engagement with the ends of corresponding muntin elements. The design can alternatively be reversed, such that a female receptacle is provided for the retainer 160 and a corresponding male part is provided on the muntin bar.

Figure 17A:
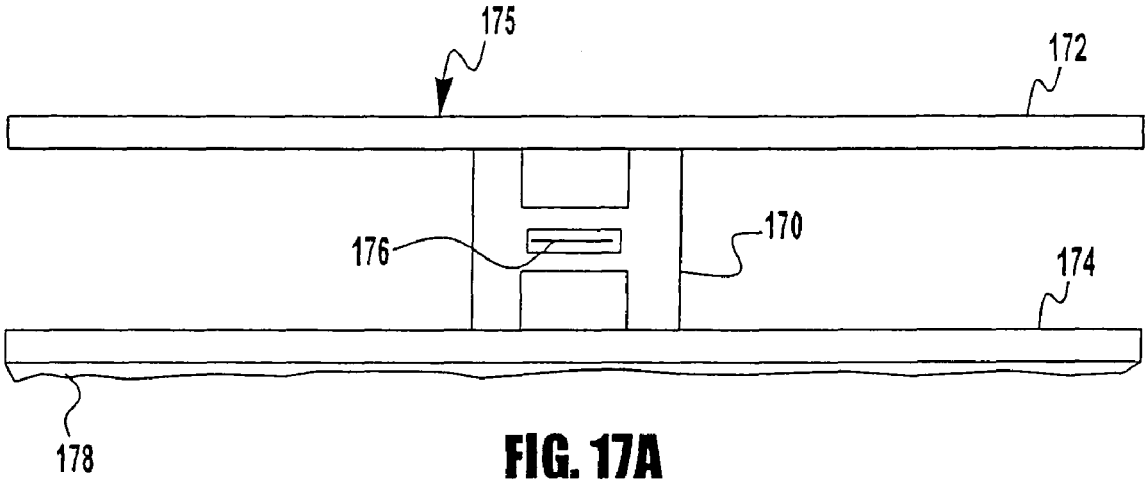
FIGS. 17A and 17B illustrate a top view and a front view, respectively, of an embodiment where muntin retaining clips are fabricated integrally with the sash frame.
Figure 17B:
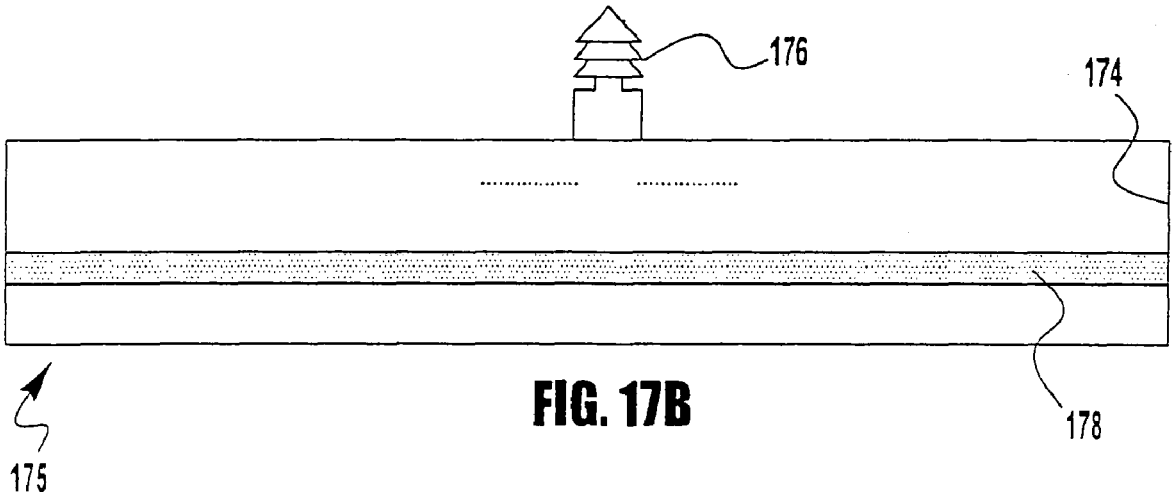

FIGS. 17A and 17B illustrate an embodiment where muntin retaining clips 170 are formed integrally with the glazing legs 172, 174 of the spacing and mounting structure 175 of a sash frame. Although a leg structure is shown for the spacing and mounting structure, other designs can be substituted, such as a block or stepped configuration. Each of the integral muntin retaining clips 170, which can be fabricated together with the sash frame (e.g., by injection molding), includes a retaining element 176 for securing a muntin bar that will be attached thereto. As with the other embodiments discussed herein, the retaining element 176 can be a plug as shown, or it can be a pocket, a snap, an opening for a corresponding pin on the muntin bar, or any other suitable structure. The retaining element 176 can also be a surface that simply holds the muntin bar by frictional or spring force between a corresponding retaining element on the opposite side of the sash frame. Sealant 178 on the side wall of the leg 174 is provided for mounting a glazing sheet. It is noted that the sealant does not have to be applied to the leg during manufacture of a window or the like; it can be applied directly to the glazing sheet, or to both the glazing sheet and the leg. A second glazing sheet can be mounted to the leg 172 in a similar manner.

FIGS. 17A and 17B illustrate an integral (e.g., injection molded) sash frame that includes a muntin retaining clip 176. Alternatively, the sash member could be fabricated without the clips, but with structure such as ribs, notches, pockets, snaps or the like for accepting a separate clip element or for accepting the end of a muntin bar directly. The sash frame can also be manufactured as one integral unit together with muntin grids. In another embodiment, muntin grids can be manufactured as a separate one piece unit that simply lays or snaps into the sash frame prior to completion of the glazing step.

Figure 18A:
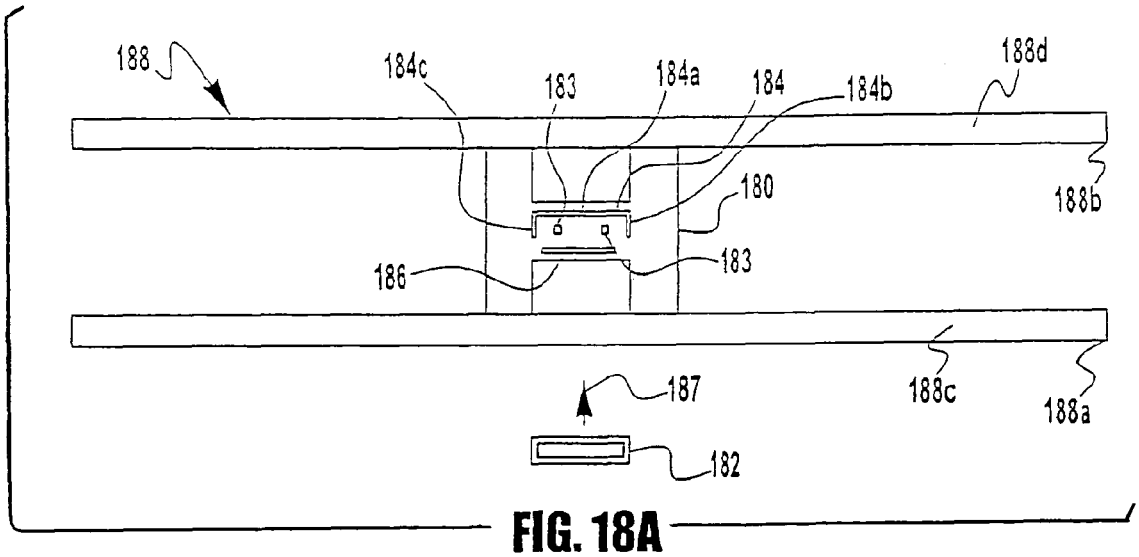
FIGS. 18A and 18B illustrate a top view and a front view, respectively, of another embodiment where muntin retaining clips are fabricated integrally with the sash illustrates an embodiment of a sash frame having pockets or the like for receiving, e.g., the ends of muntin bars, a prefabricated muntin grid, or muntin retaining clips.
Figure 18B:
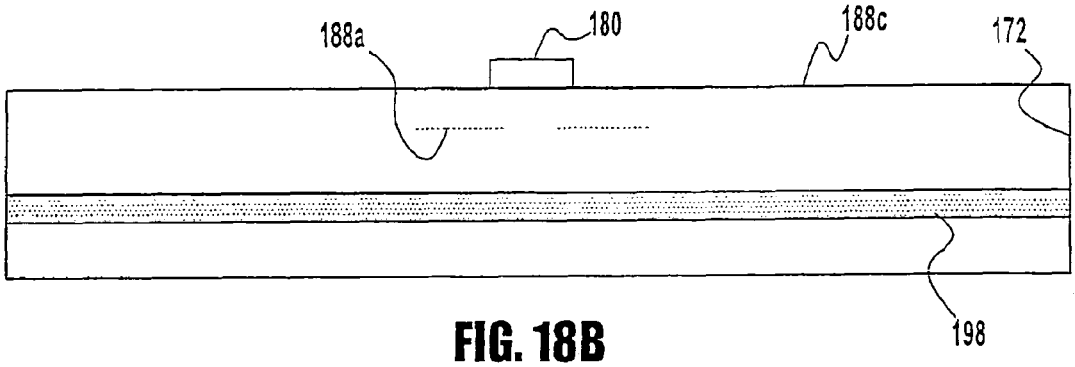

FIGS. 18A and 18B illustrate an embodiment where an integral muntin retaining clip 180 is shown which receives the end of muntin bar 182 by a press in or snap fit. The muntin retaining clip 180 comprises upstanding nubs or projections 183 and a back stop 184 with a back wall 184*a* and two side supports 184*b* and 184*c*. An optional front retaining wall 186 can also be provided to frictionally press the muntin bar 182 in place once it is pressed past the ridge 186 in the direction of the arrow 187. The muntin retaining clip 180, including nubs 183, back stop 184 and ridge 186 can be molded integrally with the sash frame, e.g., between glazing legs 188*a* and 188*b* of a spacing and mounting structure 188 as shown. Note that the muntin retaining clip 180 is shown extending above the top of side 188*a* in FIG. 18B.

Instead of fabricating the muntin retaining clip 180 as part of the spacing and mounting structure, it can be provided as a separate component that is attached to the sash frame at a location between the glazing sheets. The muntin retaining clip 180 is intended to support the muntins and/or the muntin grid and keep them from sagging over time. Although the muntin retaining clip 180 is shown positioned between spaced glazing legs 188*a*, 188*b*, a similar type of muntin retaining structure can be used with a stepped or continuous spacing and mounting configuration. Moreover, the top of muntin retaining clip 180 could be recessed below the top ends 188*c*,188*d* of glazing legs 188*a*, 188*b* so that the muntin retaining clip would not be noticeable when looking through the glazing panes from the side (i.e., from the perspective of FIG. 18B). Indeed, virtually any of the embodiments disclosed herein can be adapted to recess the muntin bar mounting means into the sash frame, for example between glazing legs to which glazing sheets are mounted, so they are not visible from the side view.

Figure 19:
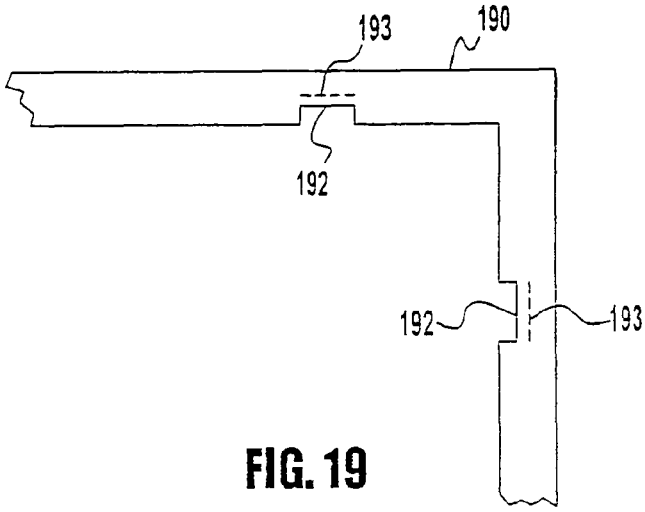
FIG. 19 illustrates an embodiment where a corner of a sash frame has notches or pockets provided therein.

FIG. 19 illustrates an embodiment where a corner of a sash frame 190 has notches or pockets 192 provided therein. The sash frame 190 may, for example, be injection molded. The pockets 192 are designed to accept corresponding muntin bars of a prefabricated muntin grid, which can be simply pressed into the pockets 192. The pockets are designed to insure that the muntin bars or muntin grid is located in exactly the desired location. Alternately, indicia such as for example colored dots or dashed lines can be used to locate the muntin bars or muntin grid. For example, the pockets 192 can be designed to accept the ends of the muntin bars that form the grid. The muntin grid elements may alternatively snap into the pockets 192, or be frictionally or adhesively secured within the pockets. Another option is to mount the muntin grid via muntin retaining clips (not shown) that are attached to the pockets. Such muntin retaining clips could be desiccated to provide a desiccant for the insulating space between the glazing sheets that are mounted to the sash frame.

Figure 20B:
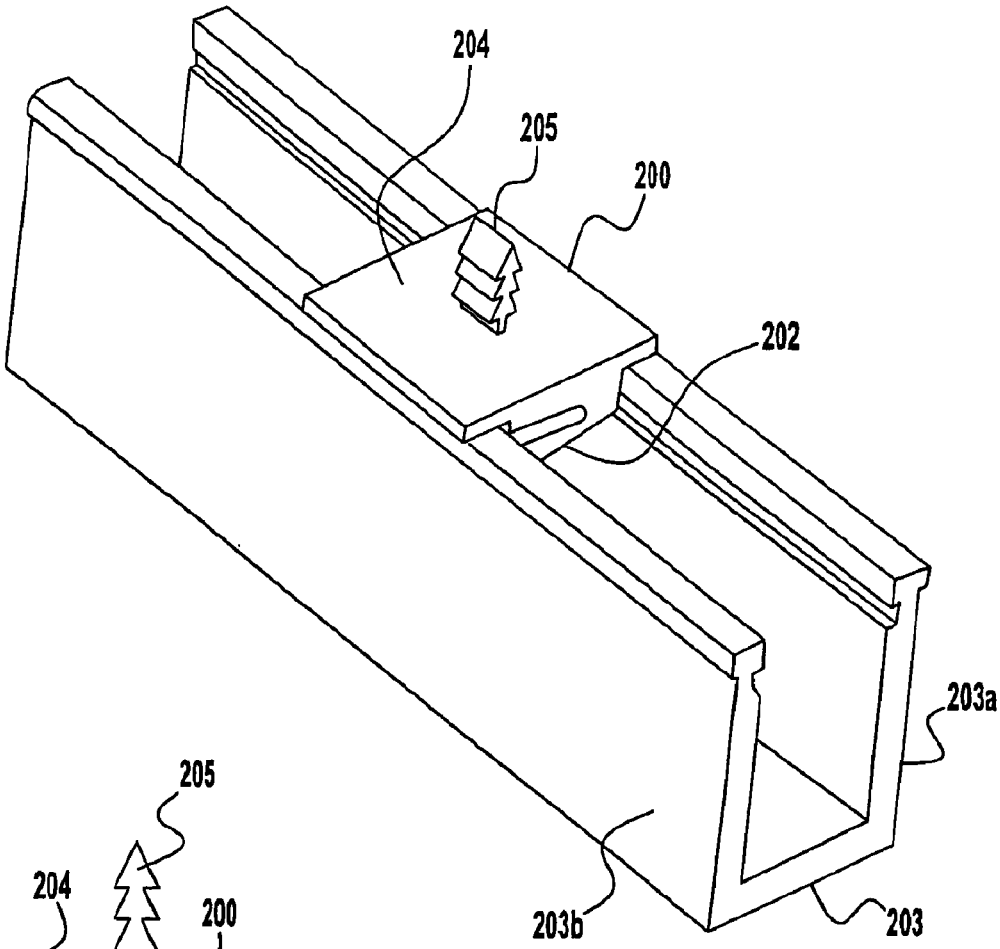
FIGS. 20A and 20B illustrate a side view in cross section and a front elevational view, respectively, of an embodiment of a muntin retaining clips that snaps into attachment between two upstanding glazing legs of an integrated sash frame.
Figure 20A:
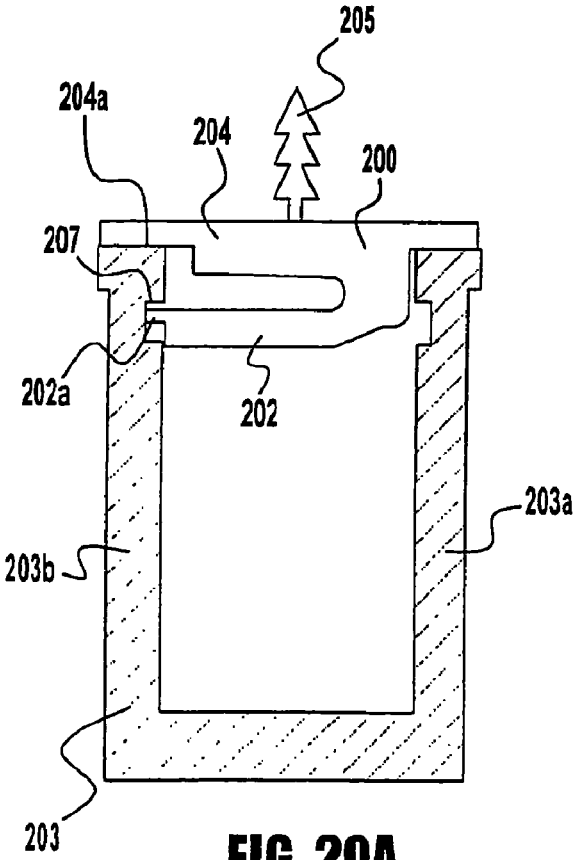

FIG. 20A illustrates an embodiment where a muntin retaining clip 200 has a lower resilient finger 202 attached at one end to one end of an upper resilient finger 204. The muntin retaining clip 200 is adapted to snap between glazing legs 203*a*, 203*b* of the sash frame 203 so that the upper finger 204, which has a notched out portion 204*a* on a lower side, is supported by the upper surface of leg 203*b* as best seen in FIG. 20A. The muntin bar retainer 205 is inserted into the end of a muntin bar (not shown). The muntin retaining clip 200 can be provided in different widths, depending on the mechanical and/or aesthetic requirements of the window or door design. A locating notch 207 can also be provided in one or both glazing legs 203*a*, 203*b*, if desired, to receive an end portion 202*a* of the lower resilient finger 202 so that the muntin retaining clip 200 is securely held in a proper position. As with the other embodiments described herein, a female receptacle can be substituted for the muntin bar retainer 205, in which case the muntin bar would contain structure that engages with the female receptacle.

Figure 21B:
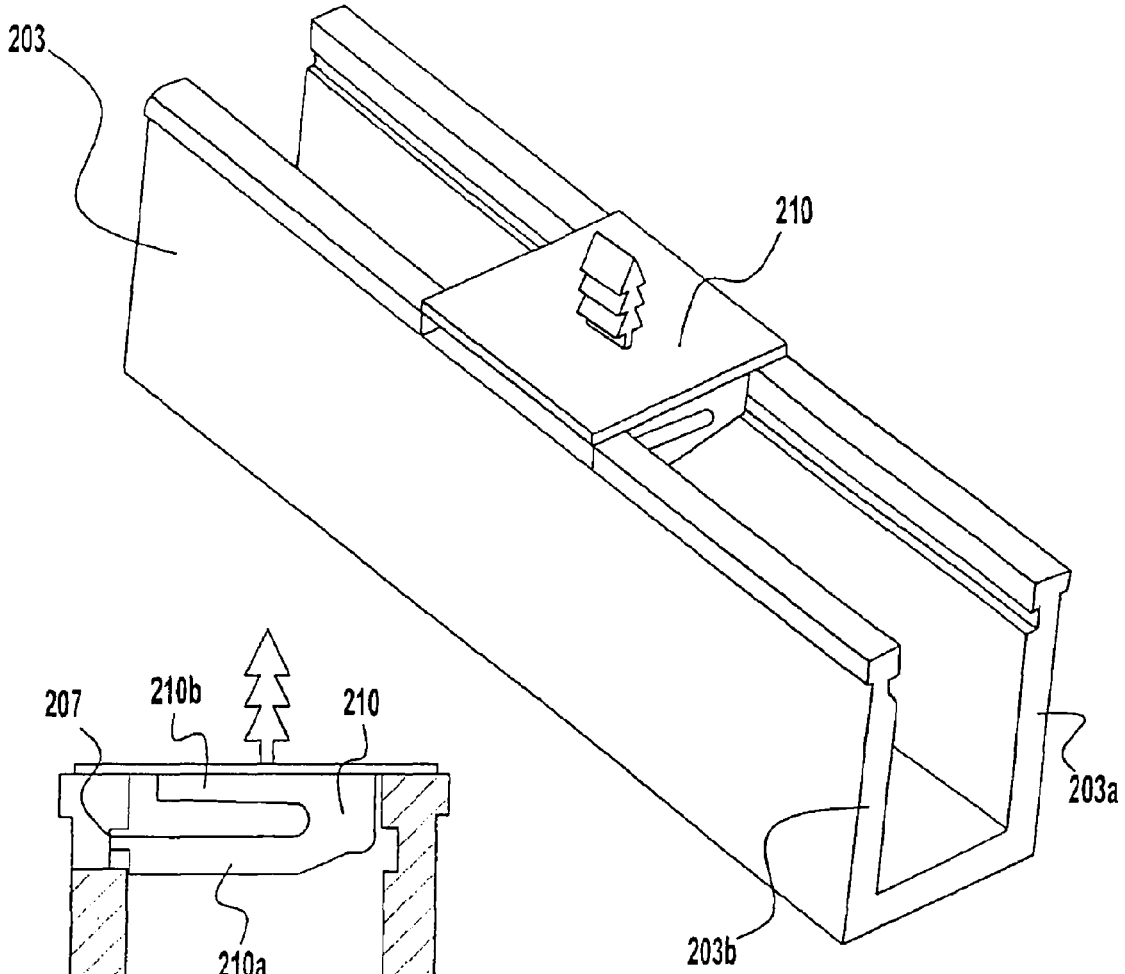
FIGS. 21A and 21B illustrate a side view in cross section and a front elevational view, respectively, of an another muntin retaining clip that snaps between two upstanding glazing legs of an integrated sash frame.
Figure 21A:
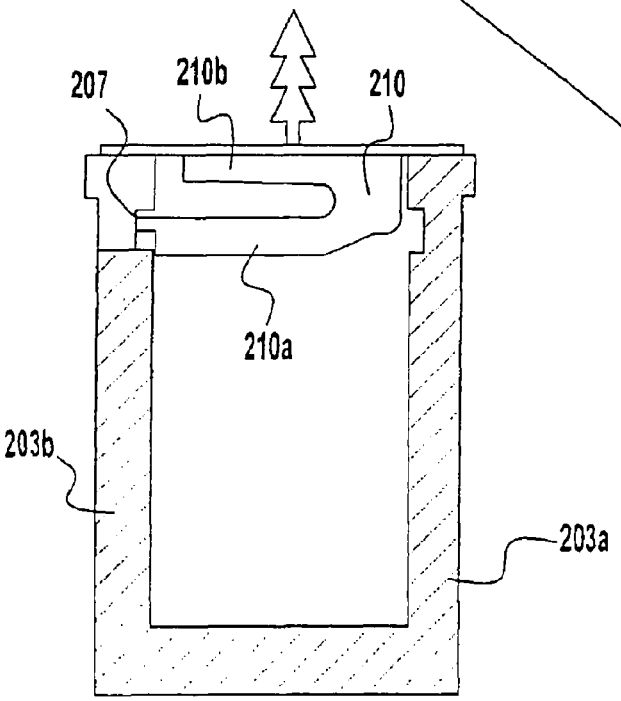

FIGS. 21A and 21B illustrate an embodiment where the muntin retaining clips 210 snap between the glazing legs 203*a* and 203*b* that form the spacing and mounting structure 203. In this design, as compared to the embodiment illustrated in FIGS. 20A and 20B, however, there is no extension which overhangs the leg 203*b*. Instead, the lower portion 210*a* of the muntin retaining clip 210 fits within a locating notch 207 provided in one of the glazing legs, as in the embodiment illustrated in FIGS. 20A and 20B, while the upper portion of the muntin retaining clip 210*b* does not extend the width of the spacing between glazing legs 203*a* and 203*b*, as best shown in FIG. 21A.

Figure 22B:
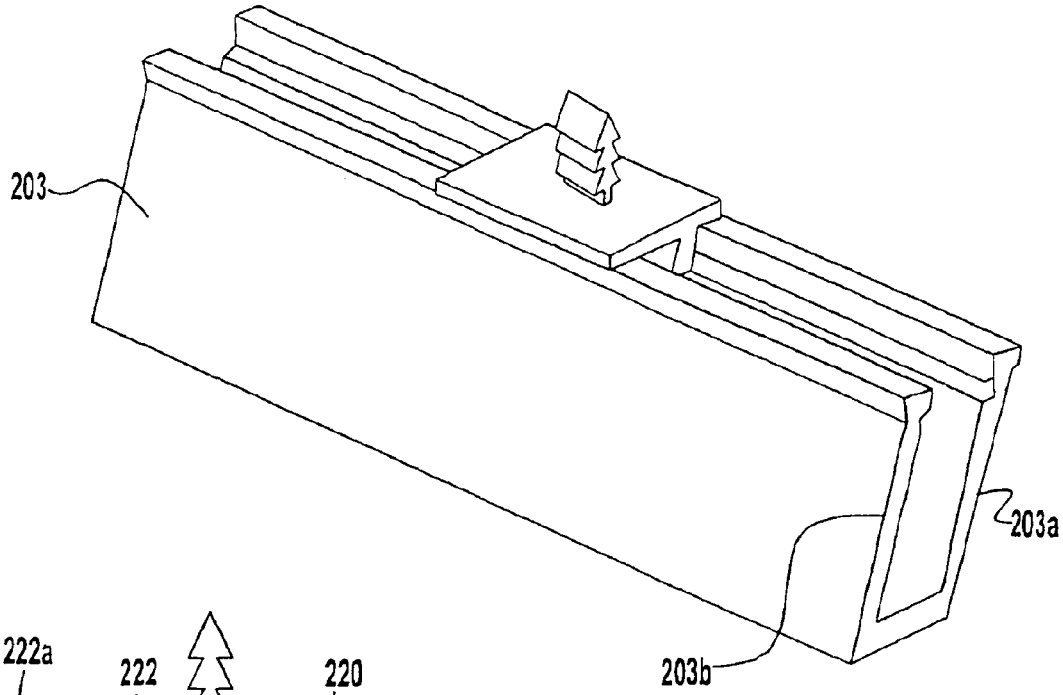
FIGS. 22A and 22B illustrate a side view in cross section and a front elevational view, respectively, of still another embodiment of a muntin retaining clip that snaps between two upstanding glazing legs of an integrated sash frame.
Figure 22A:
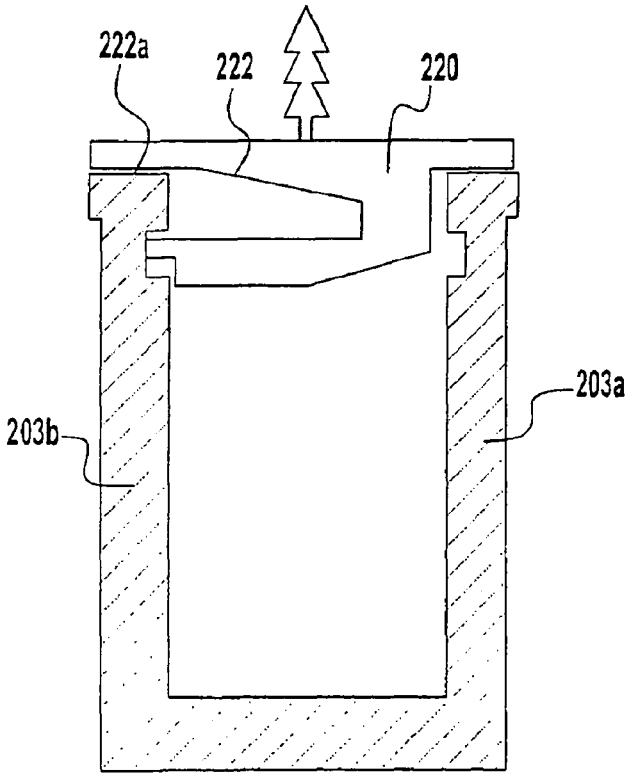

FIGS. 22A and 22B illustrate an embodiment where the muntin retaining clips 220 are similar to those of FIGS. 20A and 20B, but the design of the upper resilient finger 222 is slightly different from the upper resilient finger 204 of FIGS. 20A and 20B. Since finger 222 does not have a notch on its lower surface 222*a*, it rests on the top of wall 203*b* and therefore has a different resiliency for the snap-in action.

Figure 23B:
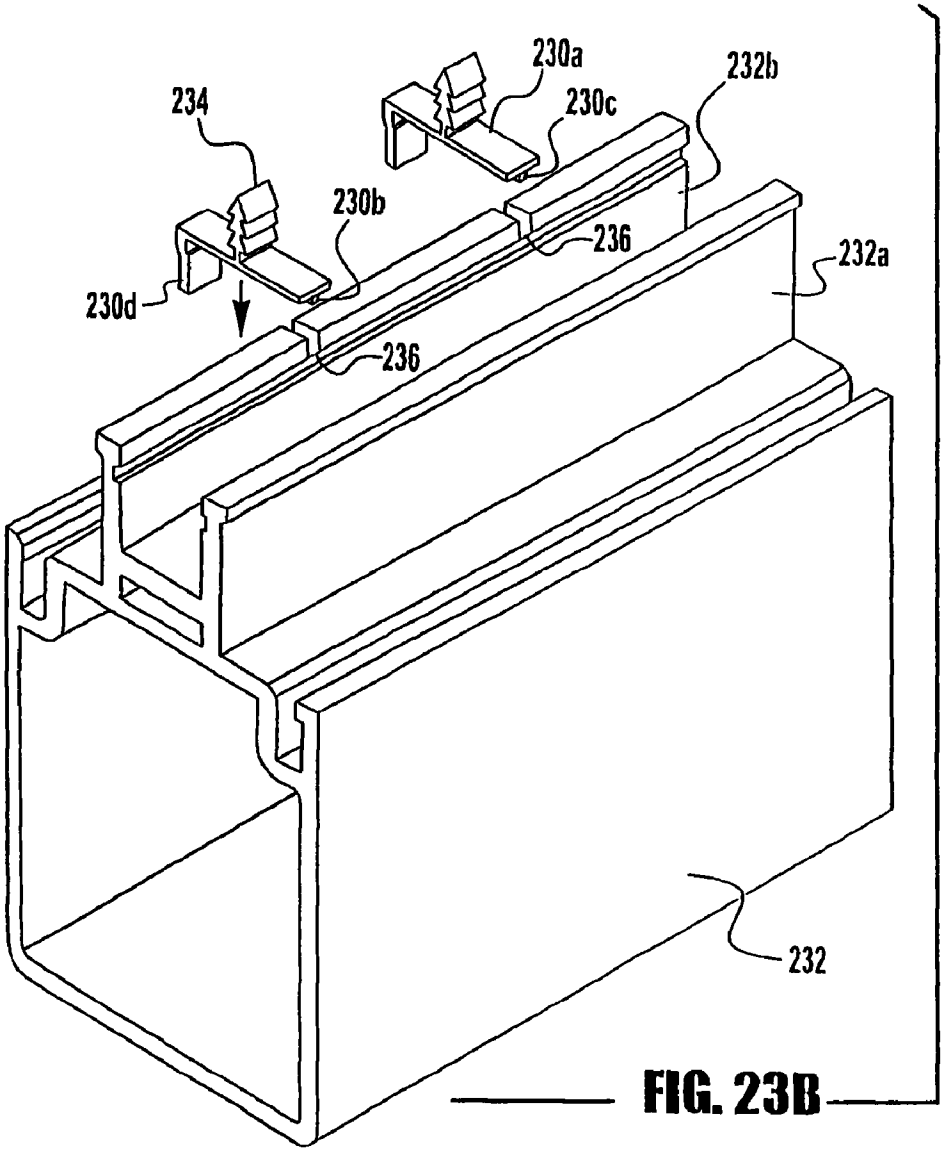
FIGS. 23A and 23B illustrate a side view in cross section and a front elevational view, respectively, of still another embodiment of a muntin retaining clip which mounts to one glazing leg and rests on the adjacent glazing leg of the integrated sash frame.
Figure 23A:
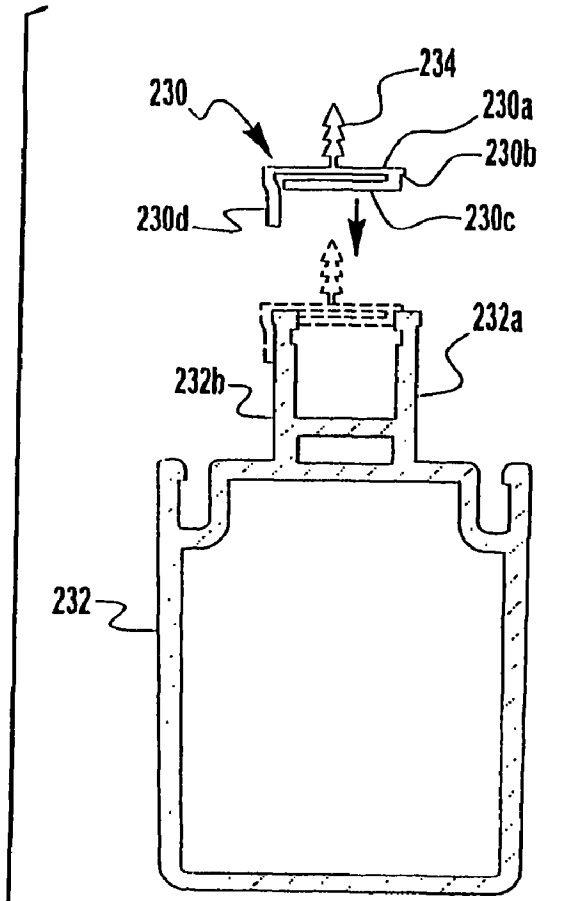

FIGS. 23A and 23B illustrate an embodiment of a muntin retaining clip 230 that is secured to one glazing leg 232*b* of the sash frame 232 and merely rests on the upper surface of a second glazing leg 232*a*. The muntin retaining clip 230 has a base portion 230*a* with a narrow ridge-like protrusion 230*c* extending along the length of the bottom surface of the base portion. The narrow ridge 230*c* has a notched out portion 230*b* at one end. At the other end of the clip 230 is a retaining wall 230*d* that projects substantially perpendicularly downward from the bottom surface of the base portion 230*a*. A muntin bar retainer 234 projects upwardly from the base portion 230*a* in the opposite direction from the ridge 230*c*. A locating notch 236 can be provided in the upper end of the leg 232*b* to receive the ridge 230*c*, as shown in FIG. 23B, whereby the retaining wall 230*d* rests against the outer surface of leg 232*b* and the notch 230*b* rests against the inner surface of wall 232*a*, as shown in FIG. 23A, so that the base portion 230*a* rests upon the top of wall 232*a* for maintaining the muntin retaining clip in a proper position.

Figure 24A:
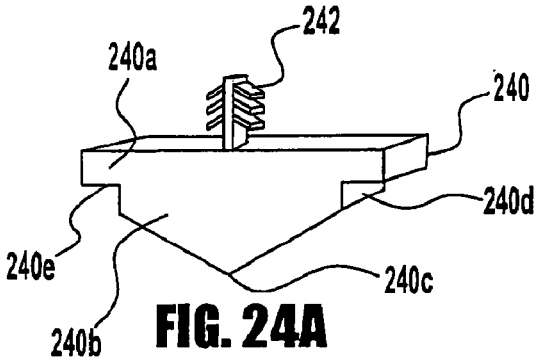
FIGS. 24A and 24B illustrate a side view and a front elevational view, respectively, of a muntin retaining clip that overhangs both glazing legs of a sash frame, and tapers to a point which can rest on the base of the sash frame between the glazing legs.
Figure 24B:
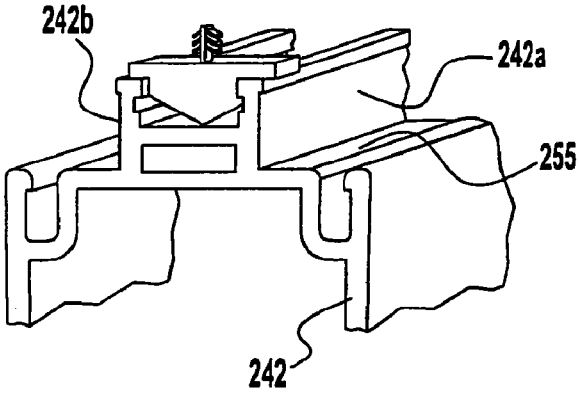

FIGS. 24A and 24B illustrate an embodiment where a muntin retaining clip 240 is constructed of a flat upper section 240*a* and a triangular shaped integrally connected bottom section 240*b* that tapers to a point 240*c*. Two notches 240*d* and 240*e* separate the flat upper section 240*a* from the triangular section 240*b*. An upstanding retainer 242 is disposed on the upper surface of upper section 240*a* for holding the end of a muntin bar. As best seen in FIG. 24B, the muntin retaining clip 240 can be mounted on the sash frame 242 so that the notches 240*d* and 240*e* are disposed upon the top surface of glazing legs 242*a* and 242*b* whereby the ends of the upper section 240*a* overhang both glazing legs of the sash frame. Also if desired, the point 240*c* of the muntin retaining clip 240 can rest on the base of the sash frame between the glazing legs 242*a* and 242*b*.

Figure 25A:
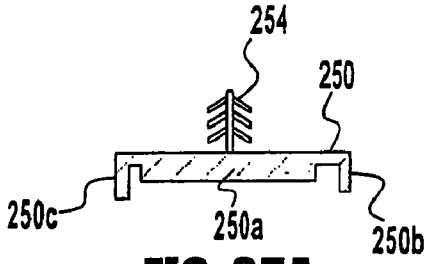
FIGS. 25A and 25B illustrate a muntin retaining clip with a central clip body adapted to fit within the space between the glazing legs that are integral with the sash frame.
Figure 25B:
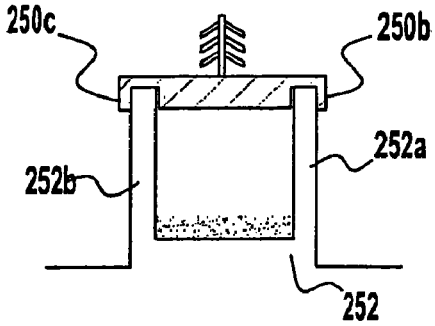

FIGS. 25A and 25B illustrate an embodiment where a muntin retaining clip 250 has a central body portion 250*a* and two L-shaped glazing legs 250*b*, 250*c* extending therefrom. An upstanding retainer 254 is disposed on the upper surface of central body portion 250*a* for holding the end of a muntin bar. The width of the central body portion 250*a* is selected to fit within the space between glazing legs 252*a* and 252*b* of the sash frame 252 as shown in FIG. 25B. The two L-shaped legs 250*b*, 250*c* overhang and engage the glazing legs 252*a* and 252*b*.

Figure 26:
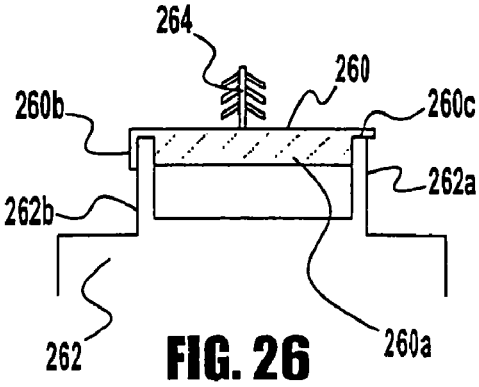
FIG. 26 illustrates a muntin retaining clip that overhangs a single glazing leg of a sash frame, and that has an extending clip support which rests against the base of the sash frame for stabilization and retention of the muntin bar.

FIG. 26 illustrates an embodiment somewhat similar to that of FIGS. 25A and 25B, but in which a muntin retaining clip 260 has a central body portion 260*a*, one L-shaped leg 260*b* and one projecting leg 260*c*. An upstanding retainer 264 is disposed on the upper surface of central body portion 260*a* for holding the end of a muntin bar. The width of the central body portion 260*a* is selected to fit within the space between glazing legs 262*a* and 262*b* of the sash frame 262. The L-shaped leg 260*b* of the clip 260 overhangs and engages the leg 262*b* of the sash frame spacing and mounting structure. The other projecting leg 260*c* is disposed on top of leg 262*a* of the spacing and mounting structure.

Figure 27:
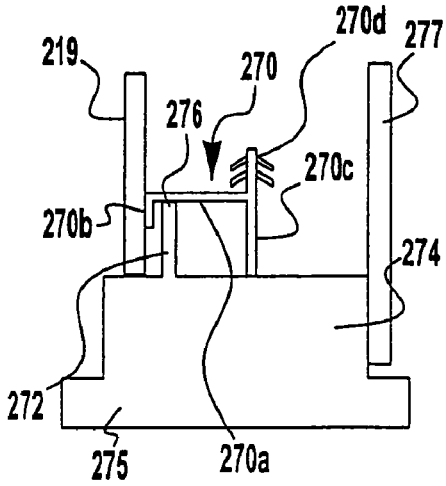
FIG. 27 illustrates an embodiment of a muntin retaining clip somewhat similar to that of FIG. 26, but which only overhangs one of the glazing legs that extend from the sash frame and which includes a central support.

FIG. 27 illustrates an embodiment of a muntin retaining clip 270 that has a horizontally disposed platform 270*a* with a downward extending lip 270*b* at one end that overhangs a single glazing leg 272 extending upward from the base of the sash frame 274. The muntin retaining clip 270 also has an extending support leg 270*c* that rests against the base of the sash frame for stabilization and retention of the muntin bar and an upstanding retainer 270*d* for holding the end of a muntin bar.

Figure 28:
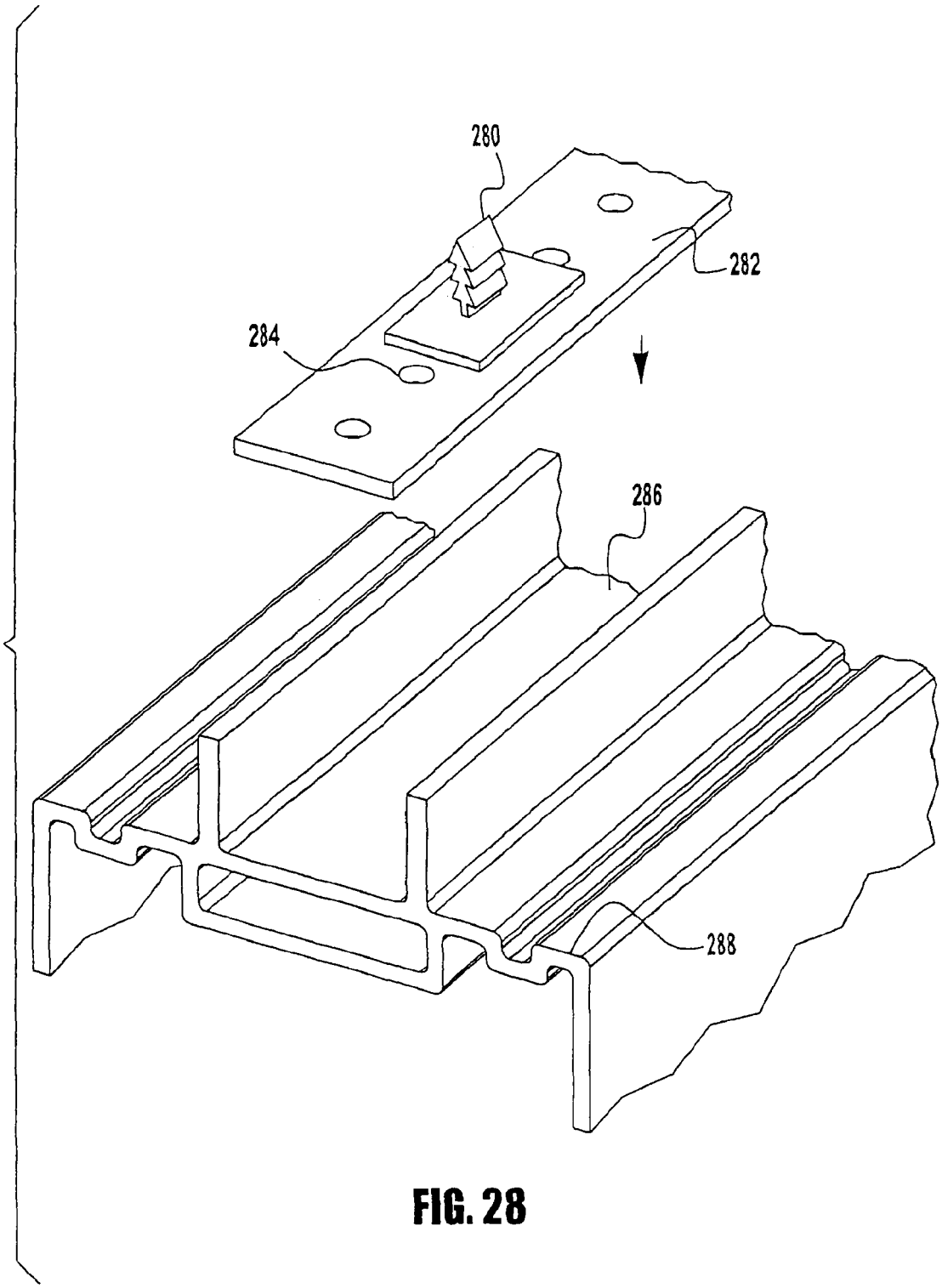
FIG. 28 illustrates an embodiment of a muntin retaining clip that can be secured to a strip with a plurality of spaced holes or slots, and wherein the strip can be disposed on the base of the sash frame between the glazing legs.

FIG. 28 illustrates an embodiment of a muntin retaining clip 280 which is secured to a strip 282 of any desired material such as plastic and/or metal with a plurality of spaced receptacles, holes or slots 284 extending the length of the strip of material 282. The retaining clips 280 are secured to the strip 282 by any desired means, such as a protrusion (e.g., pin) on the bottom of the retainer that is secured to the hole or slot by means of a friction fit or any other typical means of attachment. The strip 282, with the clip(s) secured thereto, is then placed and/or mounted on the bottom surface 286 of the sash frame 288. For example, the strip 282 may be adhesively secured to the bottom surface 286, or held in place adjacent bottom surface 286 by a friction fit within the channel between the glazing legs.

Figure 29A:
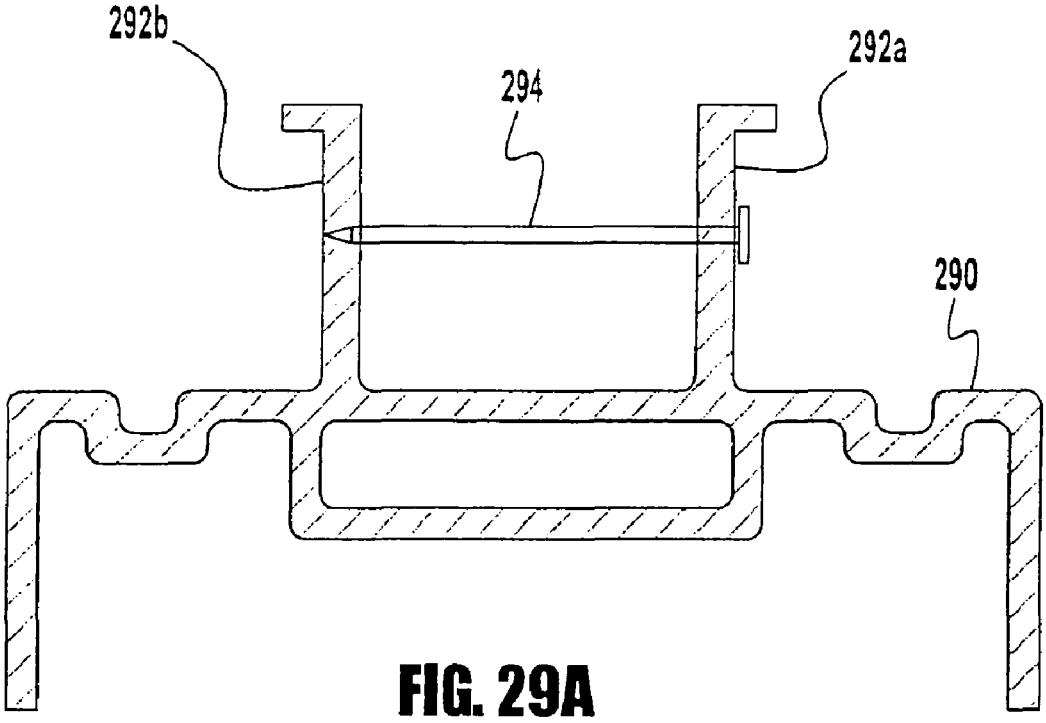
FIG. 29 A shows a sash frame in cross section with a nail or pin extending between glazing legs for snapping on a muntin retaining clip.
Figure 29B:
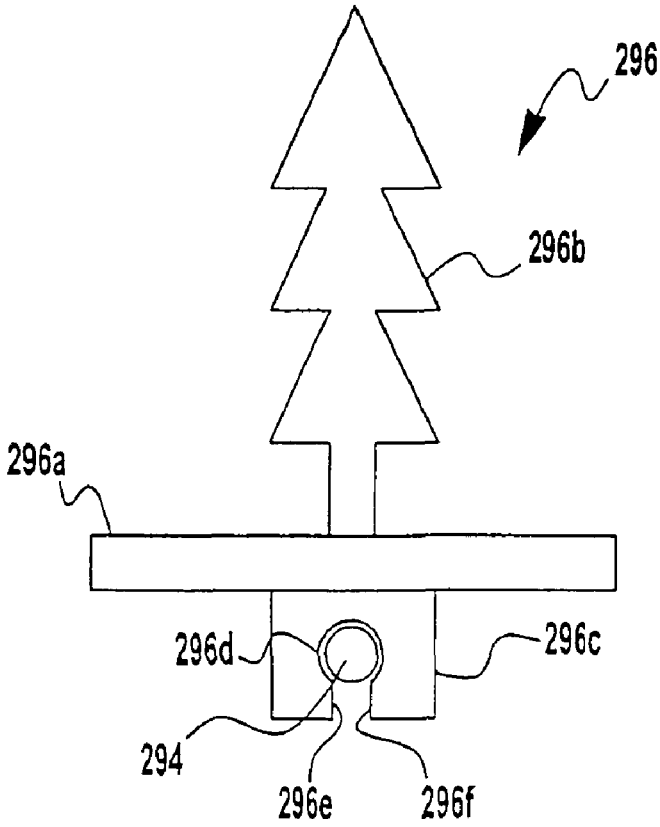

FIG. 29A illustrates a sash frame 290 with glazing legs 292*a*, 292*b* having a nail (e.g., plastic or metal) or pin 294 extending therebetween. It should be understood that a plurality of nails or pins 294 can extend along the length of the glazing legs and spaced as desired. A muntin retaining clip 296, as shown in FIG. 29B, includes a base 296*a* from which the retainer 296*b* extends. An attachment support 296*c* projects downward below the base support 296*a* and includes a substantially circular channel 296*d* and slot having opposite facing projections 296*e*, 296*f*, which create a reduced space between them as compared to the rest of the channel 296*d*. This configuration causes the muntin retaining clip 296 to snap onto the pin or nail 294 and the ends of the base support 296*a* to be disposed between the two glazing legs 292*a*, 292*b*. Alternatively, the ends of the base support can be dimensioned to sit on top of the respective legs 292*a*, 292*b*.

Figure 30A:
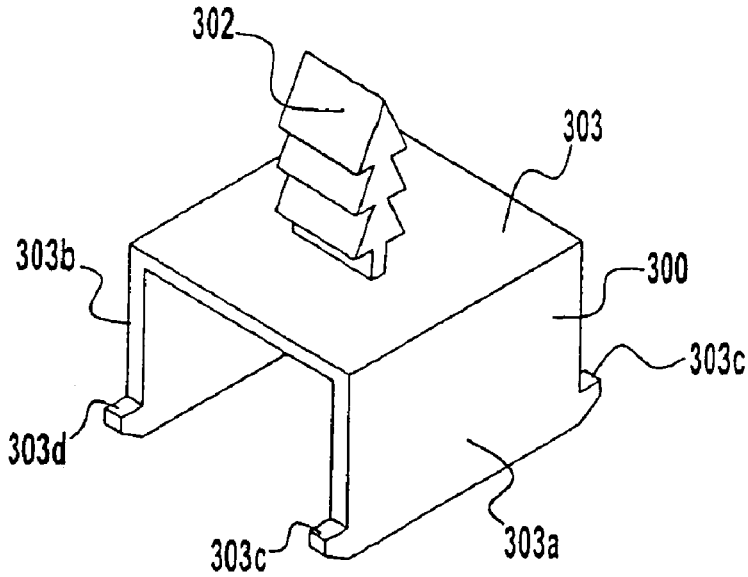
FIG. 30A illustrates a muntin retaining clip having a muntin bar retainer attached to a clip support surface for attachment to a muntin bar.
Figure 30B:
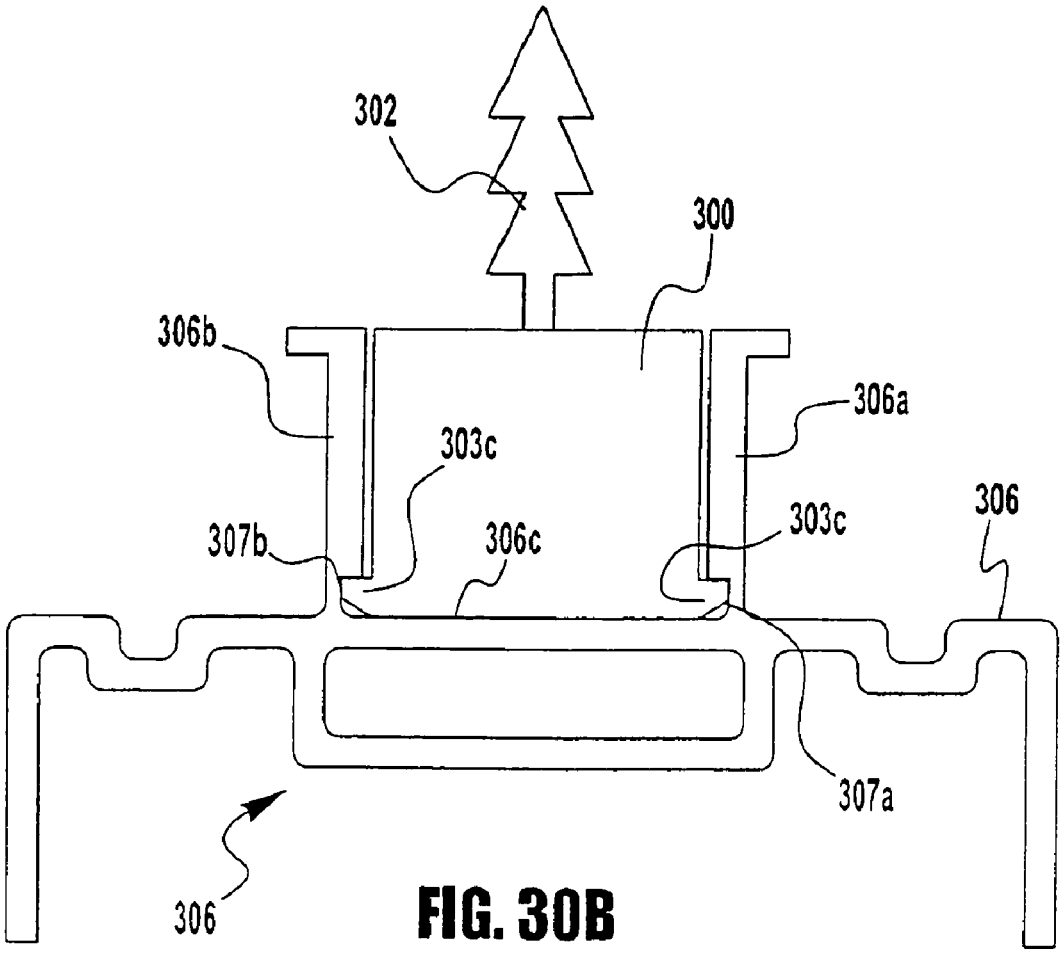
FIG. 30B illustrates the muntin retaining clip of FIG. 30A mounted between two glazing legs of a sash frame.

FIGS. 30A and 30B illustrate a muntin retaining clip 300 having a muntin retainer 302 or other suitable mounting structure (e.g., a female receptacle) attached to a support surface 303 for attaching a muntin bar. The support surface 303 has two support legs 303*a*, 303*b*, which extend downwardly therefrom. Each of the legs 303*a*, 303*b* has two projections 303*c*, 303*d*, respectively, at each end thereof. As shown in FIG. 30B, the sash frame 306 has two glazing legs 306*a*, 306*b*, each of which has a small recess 307*a*, 307*b* therein adjacent the base surface 306*c* to receive the extensions 303*c*, 303*d* at the bottom of the clip support walls. Thus, the muntin retaining clip 300 can be inserted between the two glazing legs 306*a*, 306*b* and secured therein by the mating of the ends of the muntin retaining clip 303*c*, 303*d* with the two indents 307*a*, 307*b* in the glazing legs.

Figure 31:
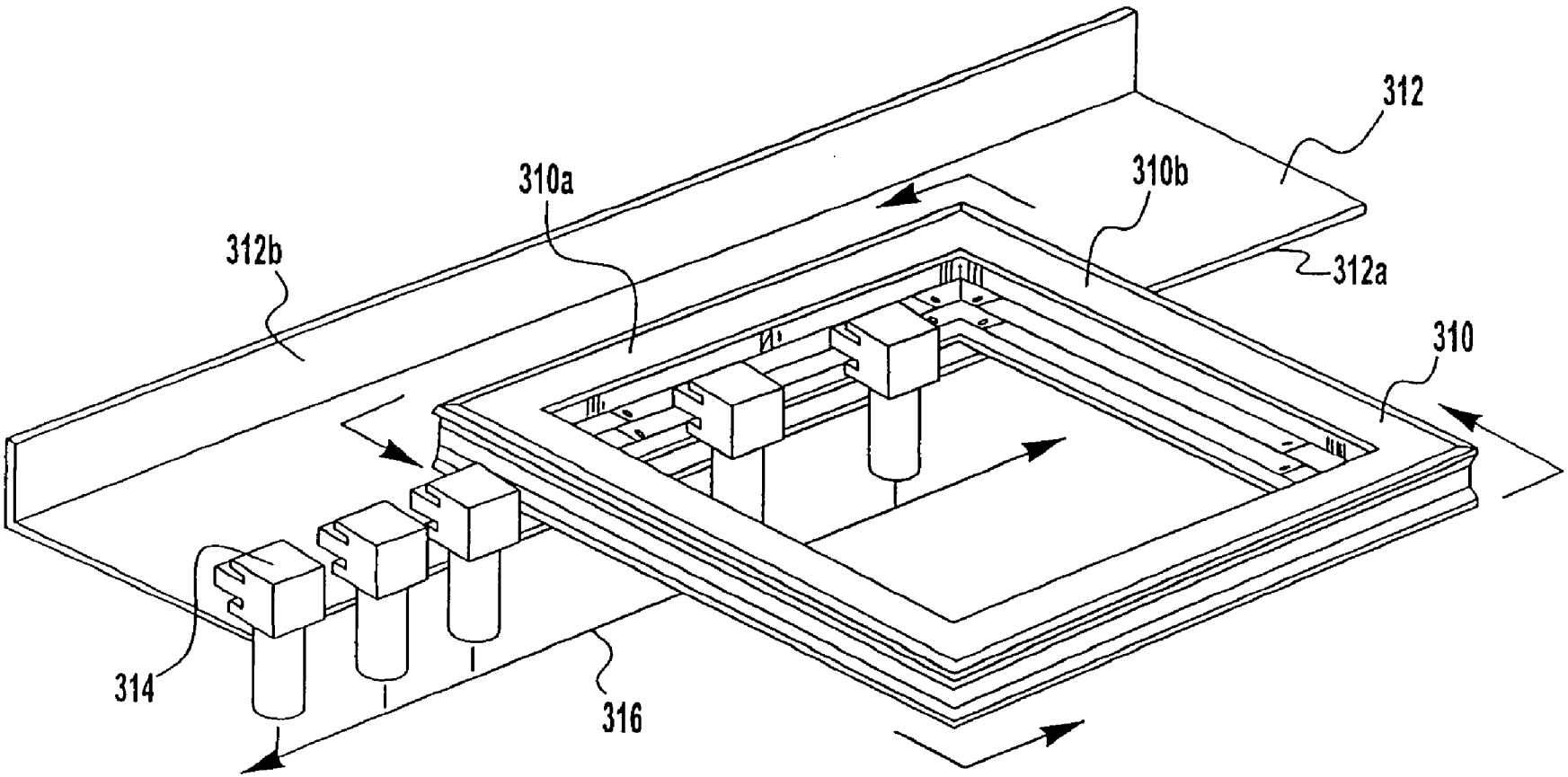
FIG. 31 illustrates a production system with a plurality of muntin grid punching stations for forming a series of singular or multiple holes or slots in a leg or other portion of a sash frame.

FIG. 31 illustrates a production system for forming a series of singular or multiple receptacles, holes or slots in a leg or other portion of a sash frame 310. The holes may be circular, oval, square, rectangular, or combinations thereof. The corresponding nipples or catch points on the muntin retaining clips, as described hereinabove but not shown in FIG. 31, may be of any shape, depth, material, flexibility, or dimension so as to fix, attach, ensnare, entrap, grasp, and/or hold the muntin retaining clip to the sash leg, within the sash leg, or against the sash leg. The pattern of holes and grid catch points may be singular, dual, tri, quad, or any combination on one, two, or both sides of the sash frame 310. The nipples or locating points formed on the muntin retaining clips can protrude to the exterior of the sash frame 310 or simply partially engage the corresponding locating holes. The locating points or holes may be milled, drilled, punched, grooved, melted or formed from any combination of these or other manufacturing techniques. This method may be in combination with the spirit of U.S. Pat. No. 6,286,288, which is incorporated in its entirety by reference herein. The support portion of the muntin retaining clip may be of any shape or not present. The muntin bar mounting retainer is envisioned to be the customarily accepted means of attaching to the muntin grid or muntin grid member.

Although not illustrated, it is envisioned that the sizing will be automatically controlled by the order sequence and data supplied to and available to glass cutting machinery, order entry software programs, and/or muntin grid punching stations.

Figure 32:
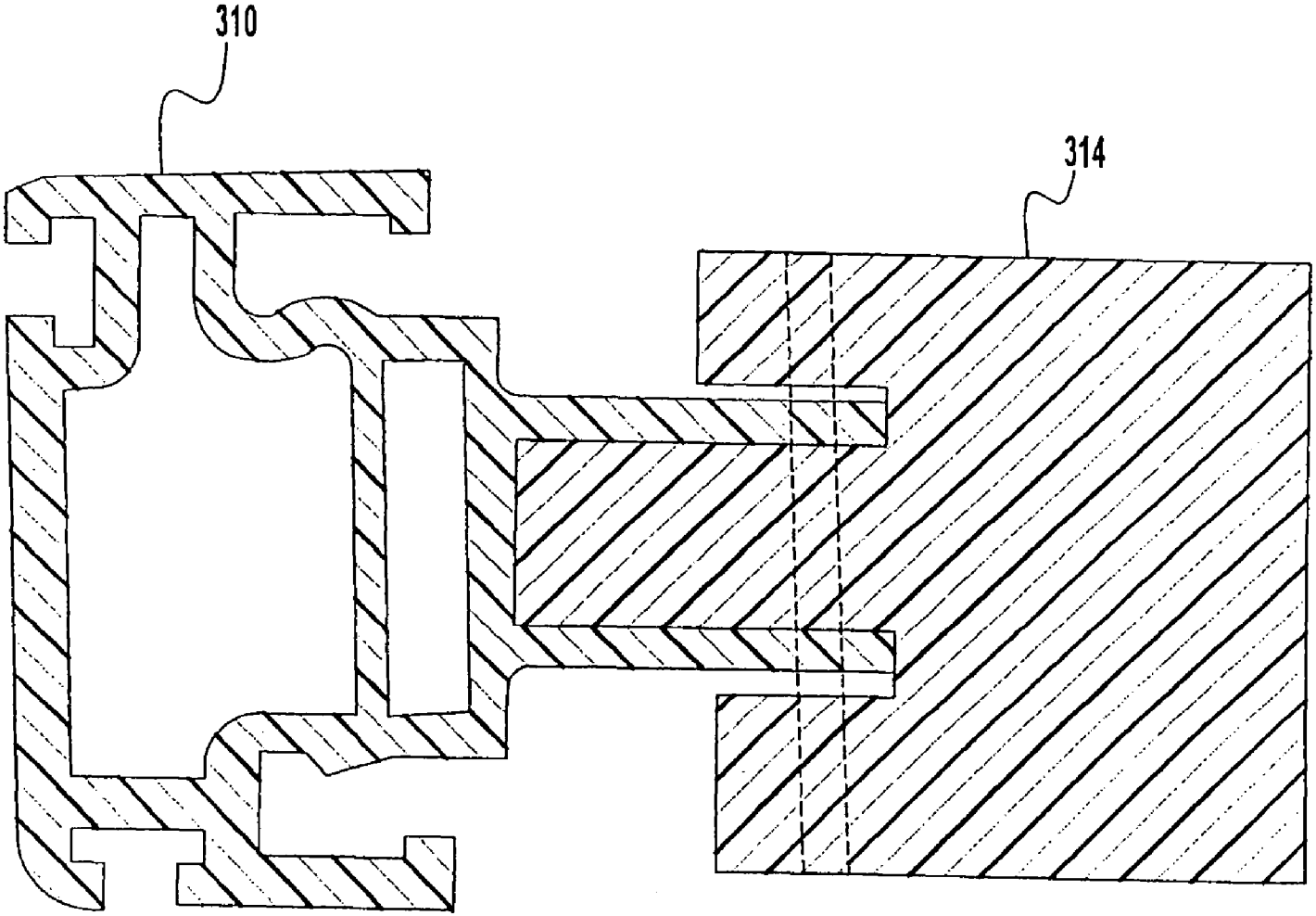
FIG. 32 illustrates a cross section of a sash frame disposed in a muntin grid punching station of the type shown in FIG. 32.

As shown in FIG. 31, the sash frame 310 can be placed on a work surface 312, which has a plurality of muntin grid drill, punch or notching stations 314 disposed along the front portion 312*a* of the work surface. The sash frame 310 is disposed so that the portion of the sash frame being worked on (310*a* in FIG. 31) is first moved closer to the rear section 312*b* of the work surface and then pulled back in the direction of the front section 312*a* so that the frame is aligned in the station 314 as shown in FIG. 32. The stations 314 are located so that receptacles, holes, notches or other openings for the muntin retaining clips can be positioned along the length of the side 310*a*. Then, the sash frame is pushed back in the direction toward the back section 312*b* and rotated ninety degrees so that the sash section 310*b* is positioned and moved into contact with the tools 314 as previously described. This process can continue with the sash frame 310 turning for 360 degrees in the direction shown, or if desired, in the opposite direction. Then the sash frame 310 can be moved down the assembly line to the next work station in either direction as indicated by arrow 316.

Figure 33:
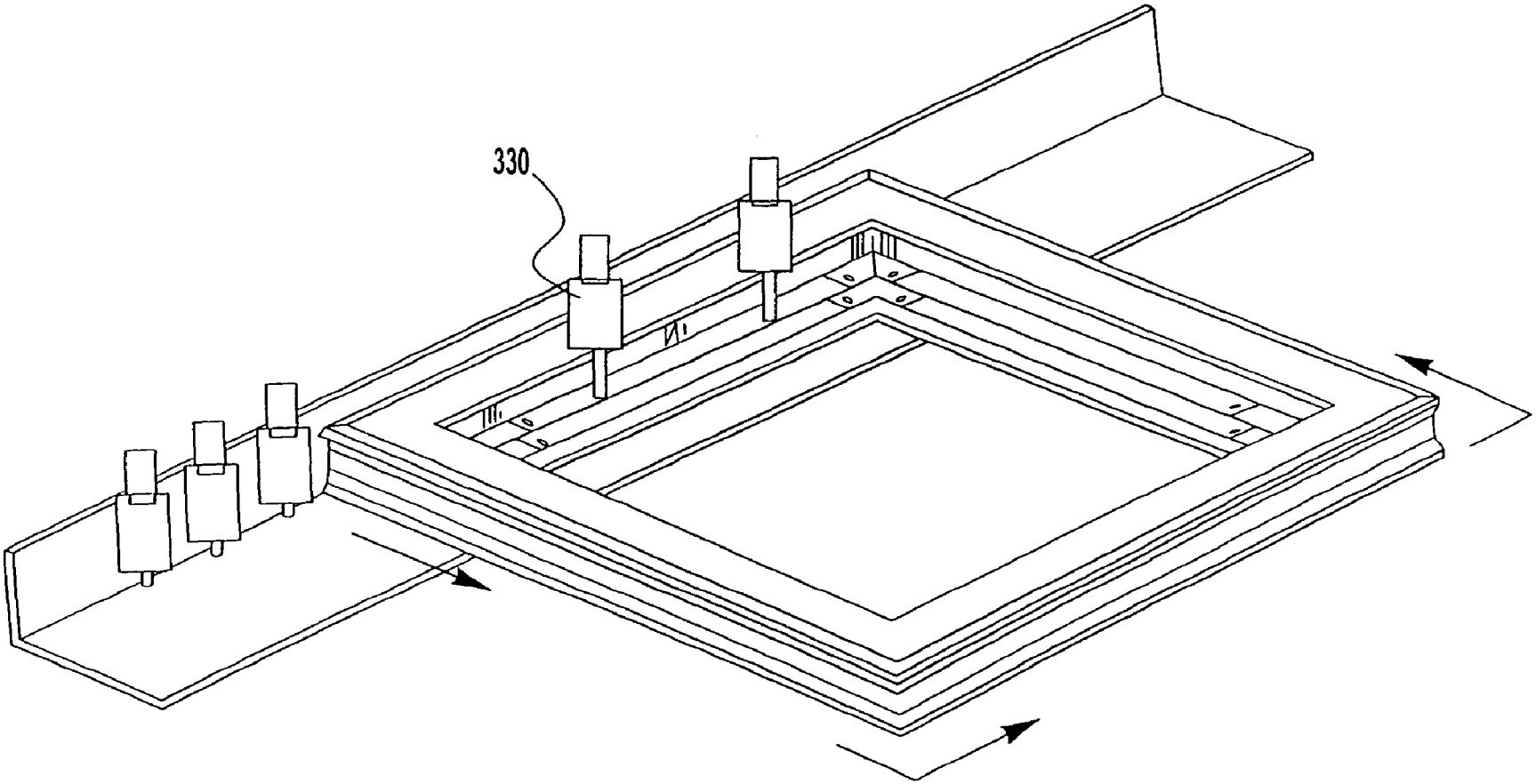
FIG. 33 illustrates a similar production system to that shown in FIG. 31, except that the tools are of a different type.

FIG. 33 illustrates an embodiment similar to the arrangement of FIG. 31, except that the tools 330 are of a different type, such as a simple top or side drill, a punch, or a milling device, to cut the holes, slots or whatever is necessary to locate and/or retain the muntin clips in the sash frame.

Figure 35:
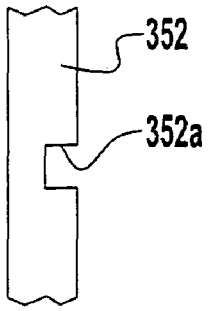
FIG. 35 illustrates a groove in a muntin bar whereby the muntin bar can be secured to the sash frame shown in FIG. 34.
Figure 34:
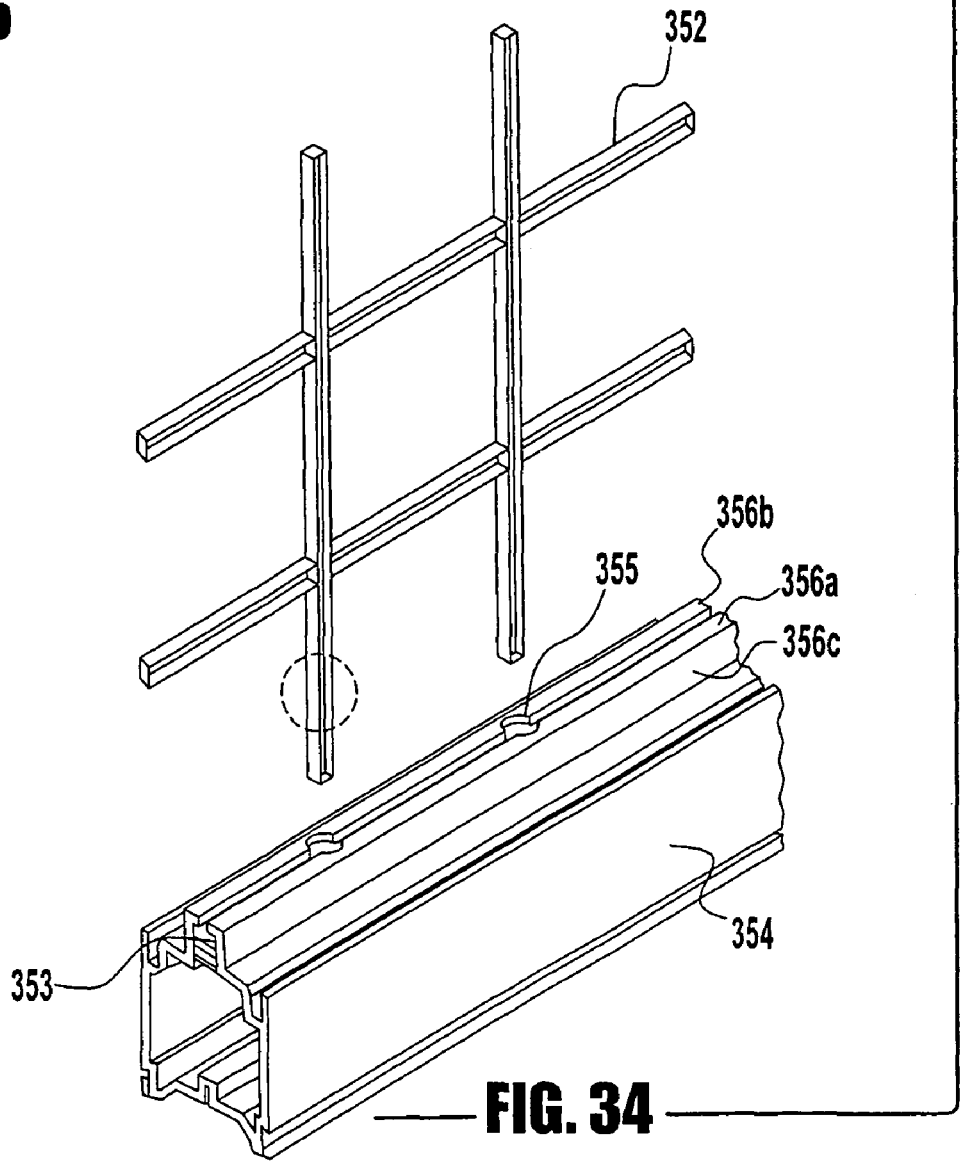
FIG. 34 illustrates a method for securing muntin bars in the sash frame of an Integrated Sash Technology (IST) unit.

FIG. 34 illustrates a method for securing muntin bars 352 in an IST unit according to the present invention with a complementary interconnect, such as a muntin retaining clip, between the muntin bar 352 and the IST glazing pocket 353 of the sash frame 354. If no clip (as described hereinbefore) is used, then a slot 355 can be placed in the upper lips 356*a*, 356*b* of the glazing pocket 353 to attach to corresponding notches 352*a* located at the end of the muntin grid 352, as shown in FIG. 35. These notches or punched holes 352*a* at the end of the muntin grid 352 may vary in shape and dimension. Punches or notches 352*a* may be on both legs, one leg, or on the top of a cross bridge if the spacing structure extends across the top of the glazing legs. The notches 352*a* may also only be in or in combination with other horizontal or vertical features that are part of the glazing legs 356*c*.

Figure 36:
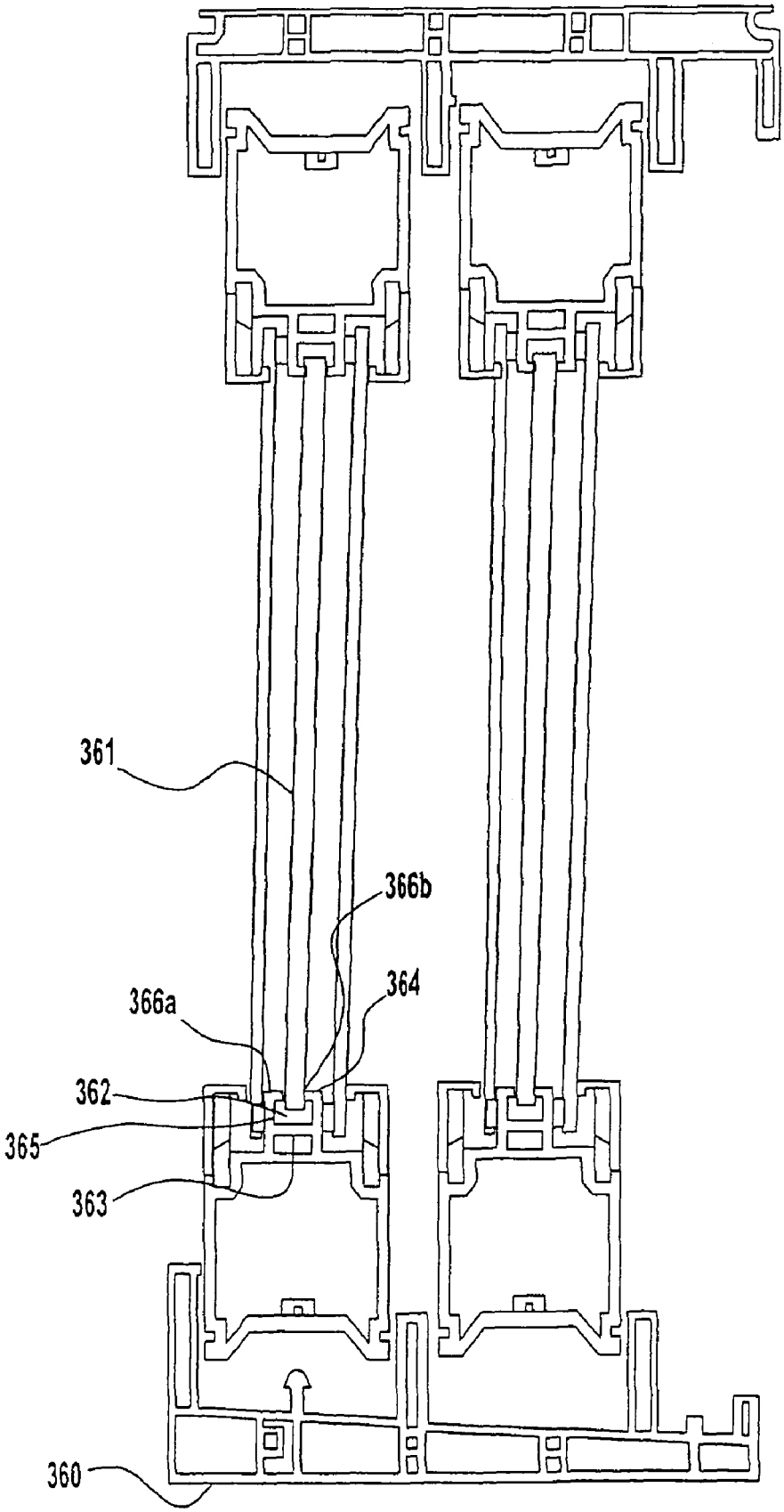
FIG. 36 is a cross-sectional view of an IST unit having simulated muntin bars mounted between the glazing panes.

FIG. 36 depicts an end view of the frame of the extrusions for an IST unit 360. Note that the sash and frame profiles are samples of numerous shapes and dimensions prevalent in the fenestration industry. IST focuses attention on integrating glazing legs and structures with corresponding air space integral to (with) the sash profile. The unique integrated glass-to-sash concept highlights the interaction or play that occurs between glass, sealant/adhesive and sash extrusion. The sealant/adhesive becomes a shock absorbing entity between the glass and the extrusion profile.

FIG. 36 demonstrates at the lower extrusion detail the end(s) of the muntin bar 361 (which is typically part of a grid) embedded into sealant and/or desiccant matrix 362 within the cavity 363 of the glazing chamber 365. Note that the matrix 362 may be on the top of a shelf or box 364 of the glazing chamber 365 onto which the ends of the muntin bars 361 may likewise be embedded or adhered within or upon or with a sealant that is designed to adhere the grid to the spacing structure formed in the glazing chamber. Clips of the type described before for attaching the muntin bar 361 to the lips 366*a*, 366*b* or any part of the IST glazing chamber 365, will preferably be positive locking in nature, although a positive lock is not required. These clips may be attached to a top bridge, shelf, leg, or any part of the glazing chamber.

FIGS. 37A, 37B and 37C illustrate a "Butterfly" muntin retaining clip that is designed to perform a primary function for two glazing scenarios: 1) Integrated Multipane Window Unit, i.e. IST; and 2) C-shaped or U-shaped insulating glass spacer, as shown in FIG. 38. The first embodiment or basic "Butterfly" muntin retaining clip 370, as shown in FIG. 37A, includes a set of wings or tabs 371*a*, 371*b*, 372*a*, 372*b* with a perpendicular muntin retainer 374 that runs parallel to the spacer face. Two of the tabs 371*a*, 371*b* are curved to project upward and two of the tabs 372*a*, 372*b* are curved like tabs 371*a*, 371*b* but project downward. The muntin retainer 374 is intended to be of various shapes and dimensions in order to receive a corresponding muntin or grid type.

In a second embodiment of a "Butterfly" Muntin retaining clip 375, as shown in FIG. 37B, the sets of upward wings or tabs 376*a*, 376*b* have a protrusion 376*c*, 376*d*, respectively, projecting upward from their free ends for engagement with a notch in another member such as a glazing chamber. Both protrusions 376*c* and 376*d* have wings 376*c*' and 376*d*' extending outwardly from opposite sides in the general plane of the wings 376*a* and 376*b*, respectively. Both the sets of upward and downward wings or tabs 376*a*, 376*b*, and 377*a*, 377*b*, respectively, are generally more narrow than those in the embodiment shown in FIG. 37A. As with the embodiment shown in FIG. 37A, there is a perpendicular protruding muntin retainer 374 for attachment to a muntin bar.

In a third embodiment of a "Butterfly" muntin retaining clip 376, as shown in FIG. 37C, the sets of upward wings or tabs 378*a*, 378*b* have a protrusions 378*c* and 378*d* on the upper side of each of the upper wings 378*a*, 378*b* that project upward for engagement with a notch in another member such as a glazing chamber. Both the sets of upward and downward wings or tabs 378*a*, 378*b*, and 379*a*, 379*b*, respectively, are generally the same as those in the embodiment shown in FIG. 37A. As with the embodiment shown in FIG. 37A, there is a perpendicular protruding muntin retainer 374 for attachment to a muntin bar.

Figure 39A:
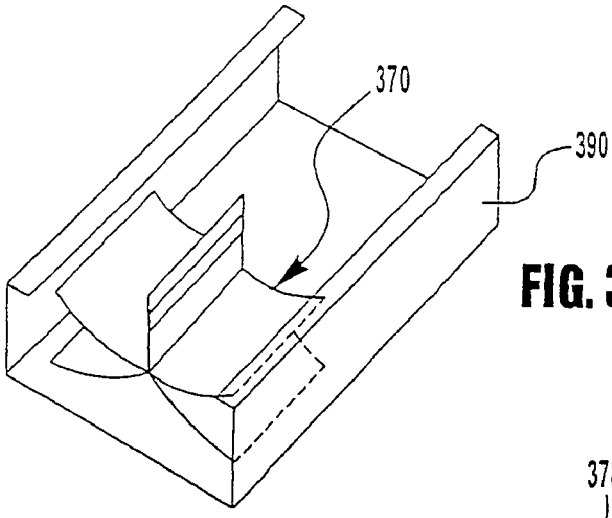
FIGS. 39A, 39B and 39C depict the Butterfly Clip designs of FIGS. 37A, 37B and 37C, respectively, for use in C-shape and U-shape members.
Figure 39C:
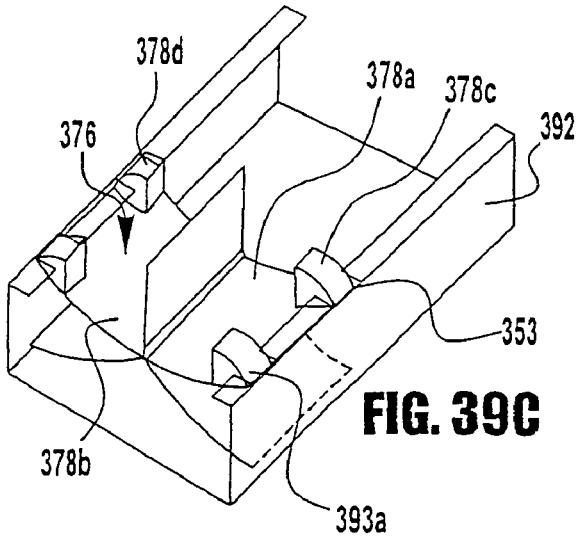
Figure 39B:
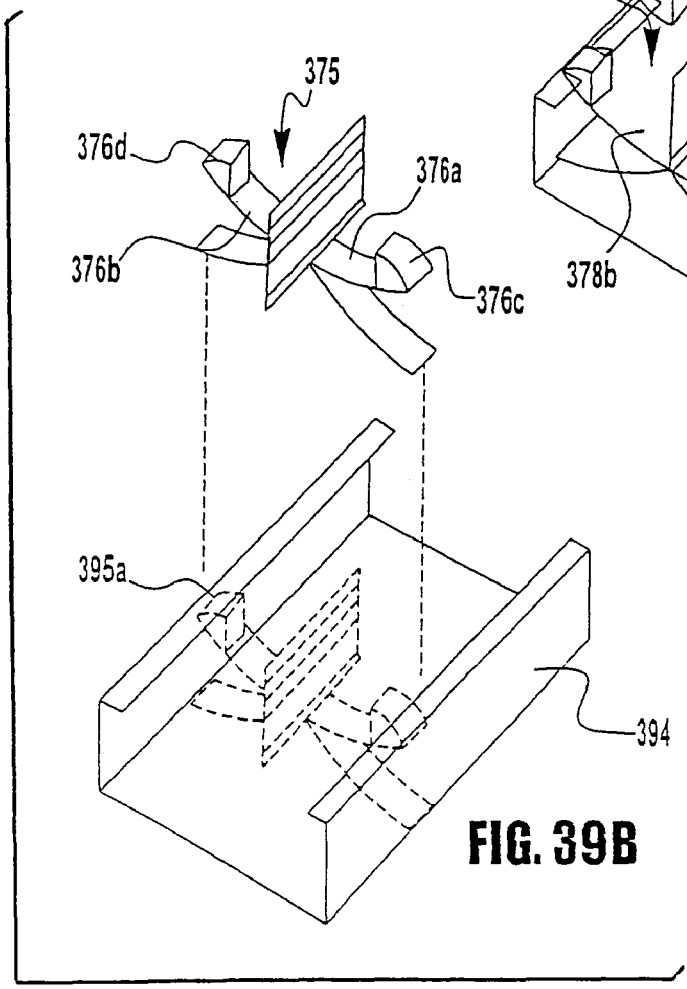

FIGS. 39A, 39B and 39C illustrate the "Butterfly" muntin retaining clip designs of FIGS. 37A, 37B and 37C, respectively for use in C-shape and U-shape spaces. In FIG. 39A, retaining clip 370 is shown installed in a U-shaped spacer 390. In FIG. 39B, the muntin retaining clip of 375 of FIG. 37B is shown in dotted lines installed in a U-shaped spacer 394 which has two notches 395*a* to receive protrusions 376*c* and 376*d* on the upper side of each of the upper wings 376*a* and 376*b*, respectively. In FIG. 39C, the muntin retaining clip of 376 is shown installed in a U-shaped spacer 392 which has four notches 393*a* to receive protrusions 378*c* and 378*d* on the upper side of each of the upper wings 378*a* and 378*b*, respectively.

Figure 40:
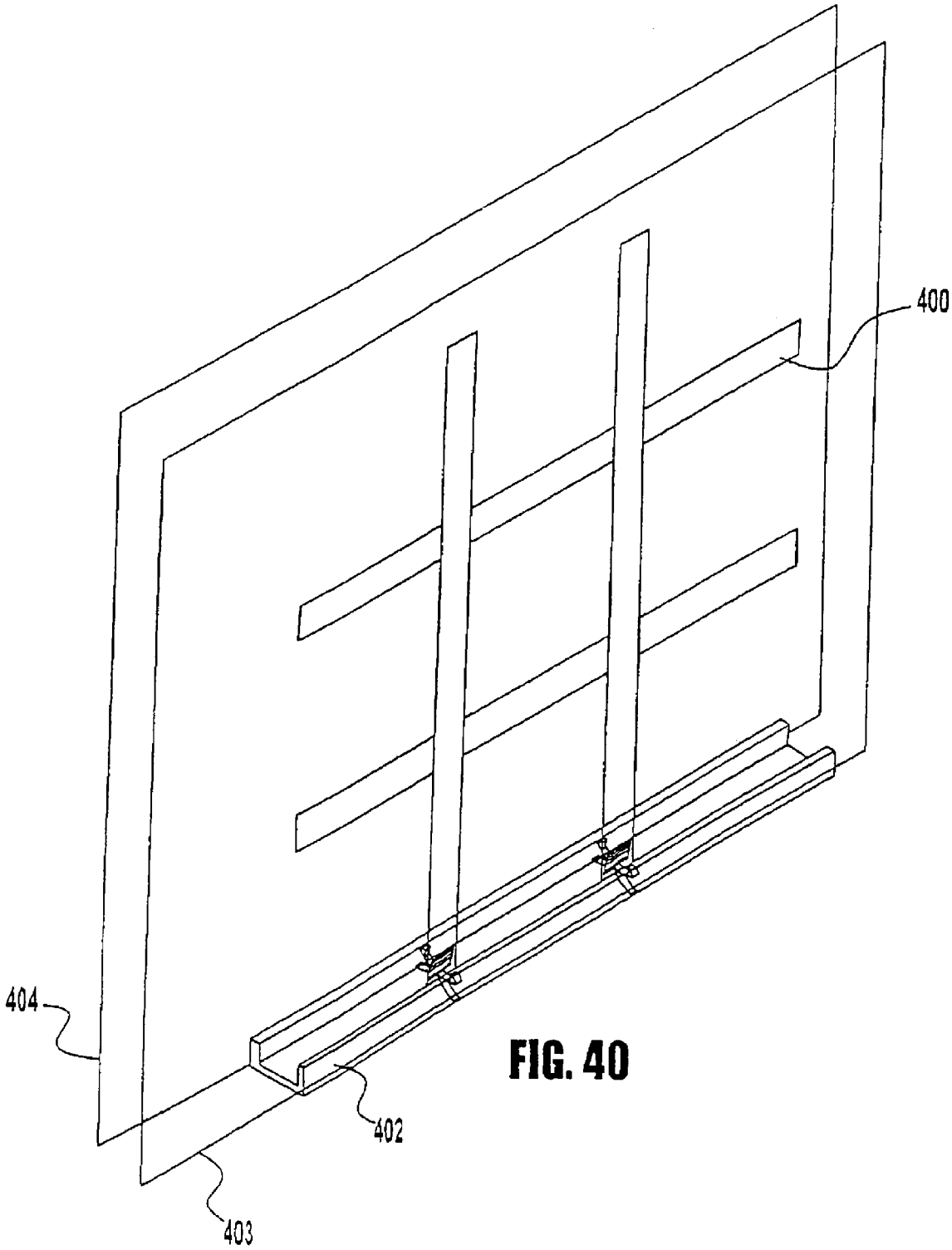
FIG. 40 shows a muntin grid mounted into a U-shaped member, of the type shown in FIGS. 39A, 39B and 39C.

FIG. 40 shows a muntin grid 400 mounted into a U-shaped spacer 402 with a "Butterfly" muntin retaining clip, in a manner as shown in FIGS. 39A, 39B and 39C. The muntin grid 400 and U-shaped spacer 402 is disposed between two panes of glass 403, 404.

Figure 41A:
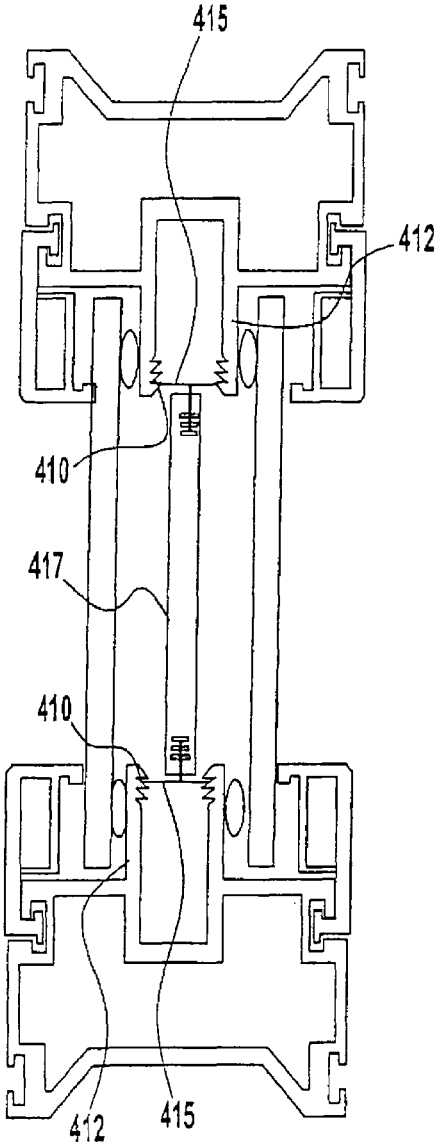
FIGS. 41A and 41B depict the end view of two embodiments of an IST unit with a "ratchet clip" for mounting muntin bars.
Figure 41C:
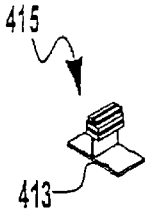
FIGS. 41C and 41D depict ratchet type, muntin retaining clips that are adapted to be attached to the sash frame as shown in FIGS. 41A and 41B.
Figure 41D:
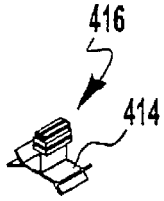
Figure 41B:
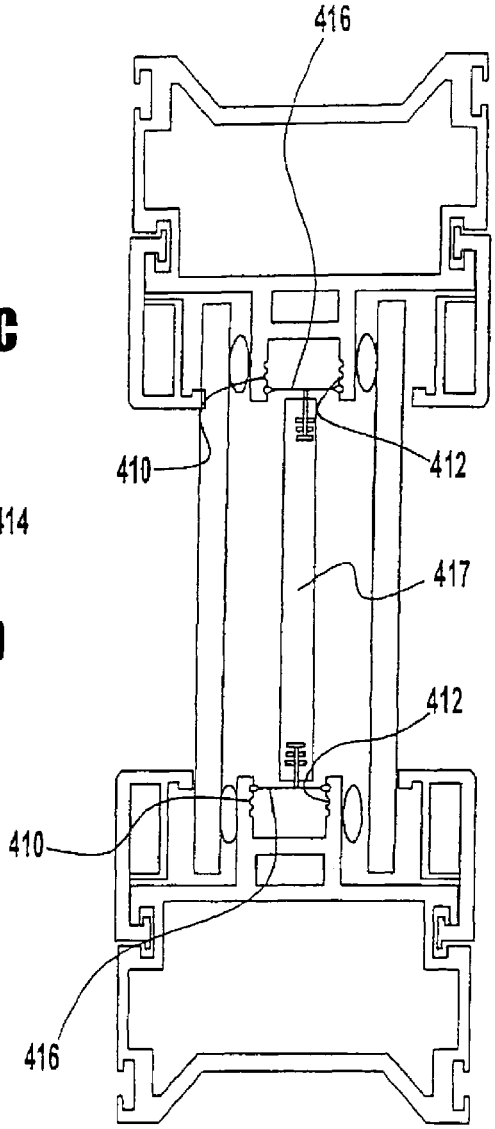

FIGS. 41A and 41B depict the end view of two embodiments of a sash frame with a "ratchet muntin retaining clip." In both embodiments, ridges, ratchets, or notches 410 extend as indentations on the inner face of the glazing leg/channel 412. The ridges or ratchets 410 will communicate with the grid muntin retaining clip platform 413 and 414 of the ratchet muntin retaining clips 415 and 416, respectively, as shown in FIGS. 41C and 41D, respectively. The grid muntin retaining clip platform 413, as shown in FIG. 41C, is substantially planar while the grid muntin retaining clip platform 414, as shown in FIG. 41D, has a v-shaped end on either side shaped to fit into two spaced ratchets. The communication of the ratchet 410 and the grid muntin retaining clip platform 413, 414 allows for the muntin bar 417 to remain in a fixed location. The grid muntin retaining clip platform 413, 414 will snap or lock into the appropriate ridge/ratchet level. The ridges and/or notches may curved, directed upward, downward, or in such a manner so as to provide a secure means of receiving and retaining the grid muntin retaining clip. They may be singular, multiple or numerous along the inside or outside surface of the glazing leg. A clip-less version of assembly may be incorporated wherein the end of the muntin bar is punched or shaped in such a manner that it itself is received into the ridged or ratcheted area of the sash glazing leg(s). It is also within the scope of the invention that one, two or more glazing legs may be ratcheted or notched, instead of the embodiment illustrated wherein a pair of legs is ratcheted or notched. Structure as shown in FIGS. 41A and 41B may be designed to accommodate any shape clip, such as illustrated by example in FIGS. 39A, 39B and 39C.

Figure 42:
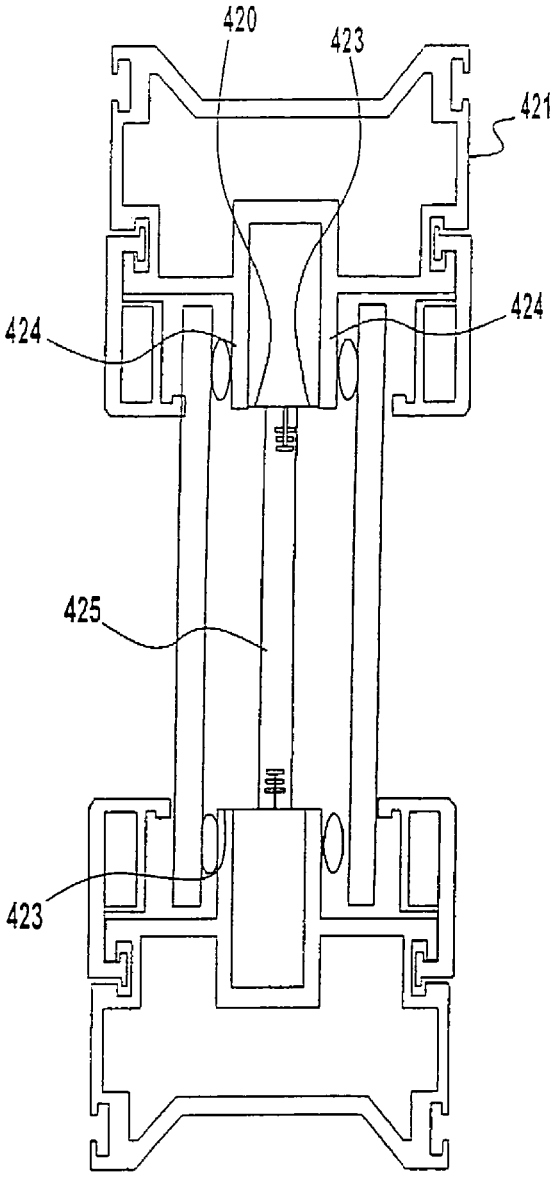
FIG. 42 illustrates a floating muntin retaining clip incorporated with an integrated sash frame.

FIG. 42 illustrates a floating grid muntin retaining clip 420 incorporated with an integrated sash 421. As shown in FIG. 42A, the grid muntin retaining clip 420 can be constructed with a flat base 421 and an upstanding muntin retainer 422. The grid muntin retaining clip 420 floats against the terminal end 423 of the glazing legs 424. Pressure caused by the cut to length dimension of the muntin bar 425 causes the grid muntin retaining clip to remain in position. In any of the concepts disclosed herein, the grid muntin retaining clip can be adhered by adhesive, glue, sealant, desiccant matrix, or embedded within such materials so as to fix the location of the muntin grid at its appropriate horizontal and/or vertical position as viewed in FIG. 42.

Figure 42B:
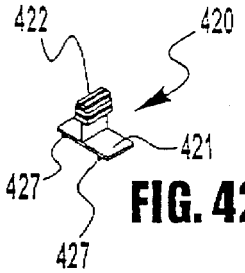
FIG. 42B illustrates a floating muntin retaining clip that incorporates a pair of legs projecting from the clip base.
Figure 42A:
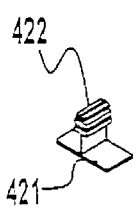
FIG. 42A illustrates a floating muntin retaining clip.

As shown in FIG. 42B, the grid muntin retaining clip 426 can be constructed identical with the muntin retaining clip of FIG. 42A except it may also incorporate a set of legs or fins 427 perpendicular to the flat base. These legs or fins 427 are disposed against opposite inner surfaces of the opposing glazing legs and assist in preventing side-to-side movement of the muntin retaining clip toward the glazing legs.

Figure 43A:
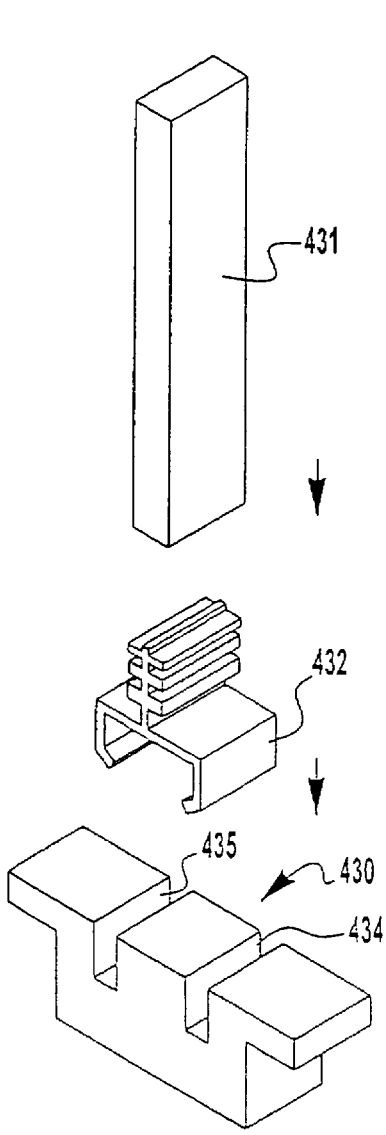
FIG. 43 illustrates an exploded view of a glazing leg support that incorporates a muntin clip support adapted for use with an IST unit.
Figure 43B:
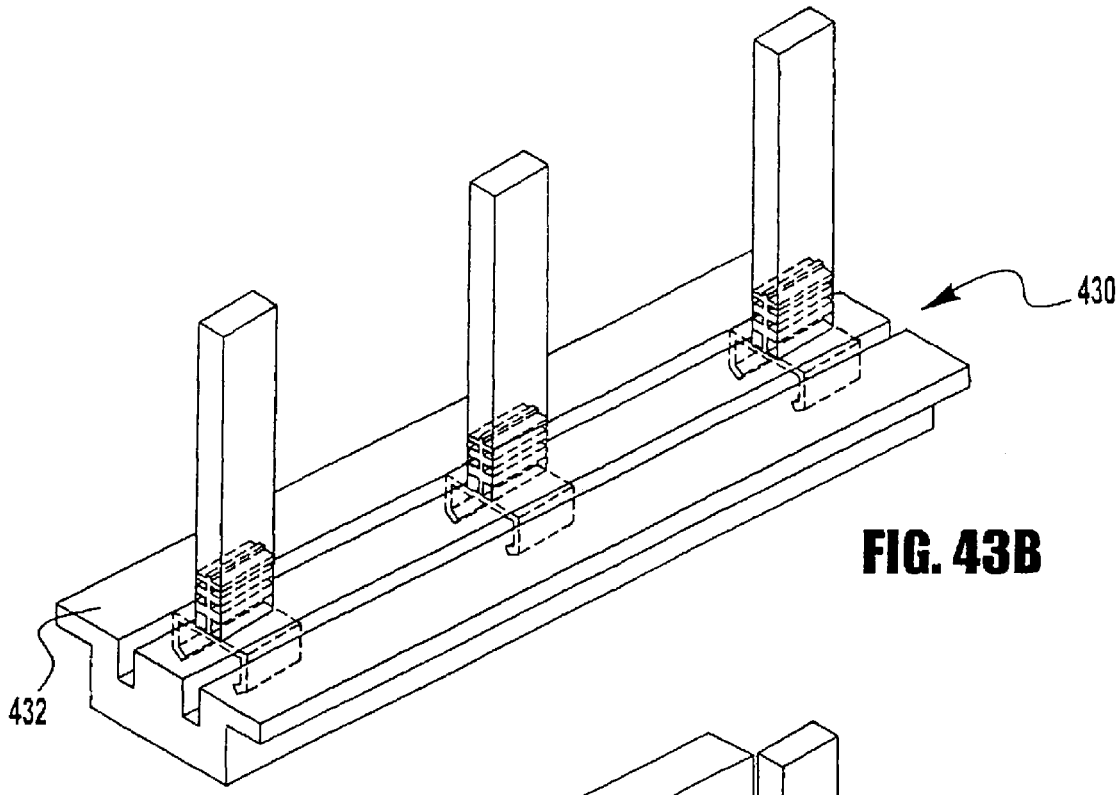
Figure 43C:
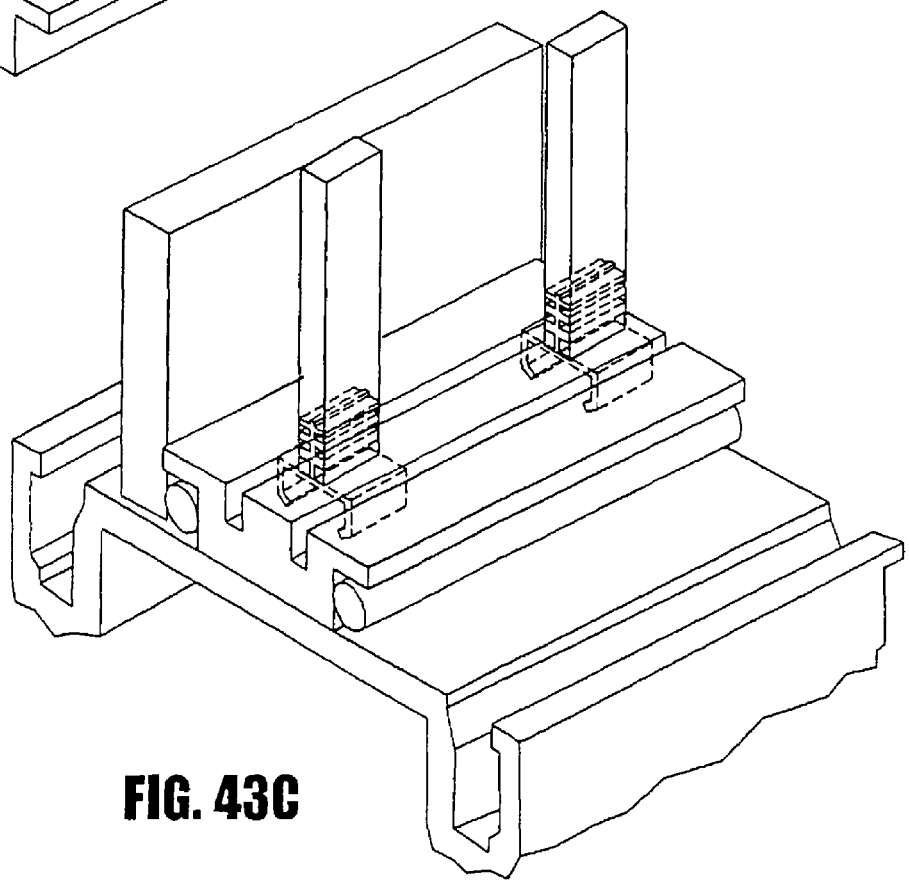

FIG. 43 illustrates an integral spacing structure 430 that is of a different substance, material, compound, or manufacture than the sash frame. The spacer 430, as shown in FIG. 43, can be fabricated from foam or any other suitable material. The spacer may be provided in any shape that is capable of receiving a muntin bar or muntin bar clip. In the illustrated embodiment, the spacing structure 430 is configured with two spaced channels 434 and 435 to receive a muntin bar 431 or grid assembly that can be attached by a muntin clip 432.

Figure 44A:
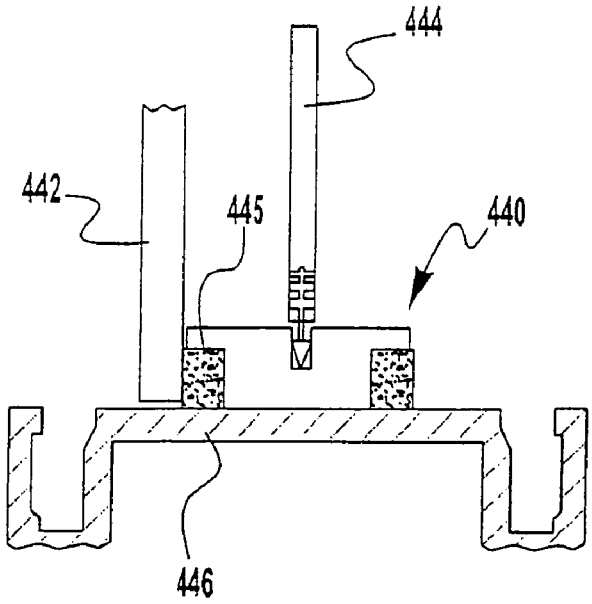
FIG. 44A illustrates a cross sectional view of another embodiment of a glazing leg support disposed on an IST unit to which a muntin bar with an attachment member of the type shown in FIG. 13 can be mounted.

FIG. 44A illustrates an integral spacer 440 that also functions as a sealant director when a glazing pane 442 is applied. In particular, when the glazing pane 442 is pushed (or vacuum drawn) towards the spacer 440, the sealant 445 will whet-out within the channel provided between flange 447 and the base 449 of the sash profile 446. The flange 447 will prevent the sealant from oozing into the insulating air space above the spacer 440. A muntin bar 444 or grid assembly can be secured to the spacer 440 as shown. The muntin bars seated into the spacer 440 can be incorporated in a sash frame 446 as shown.

Figure 44B:
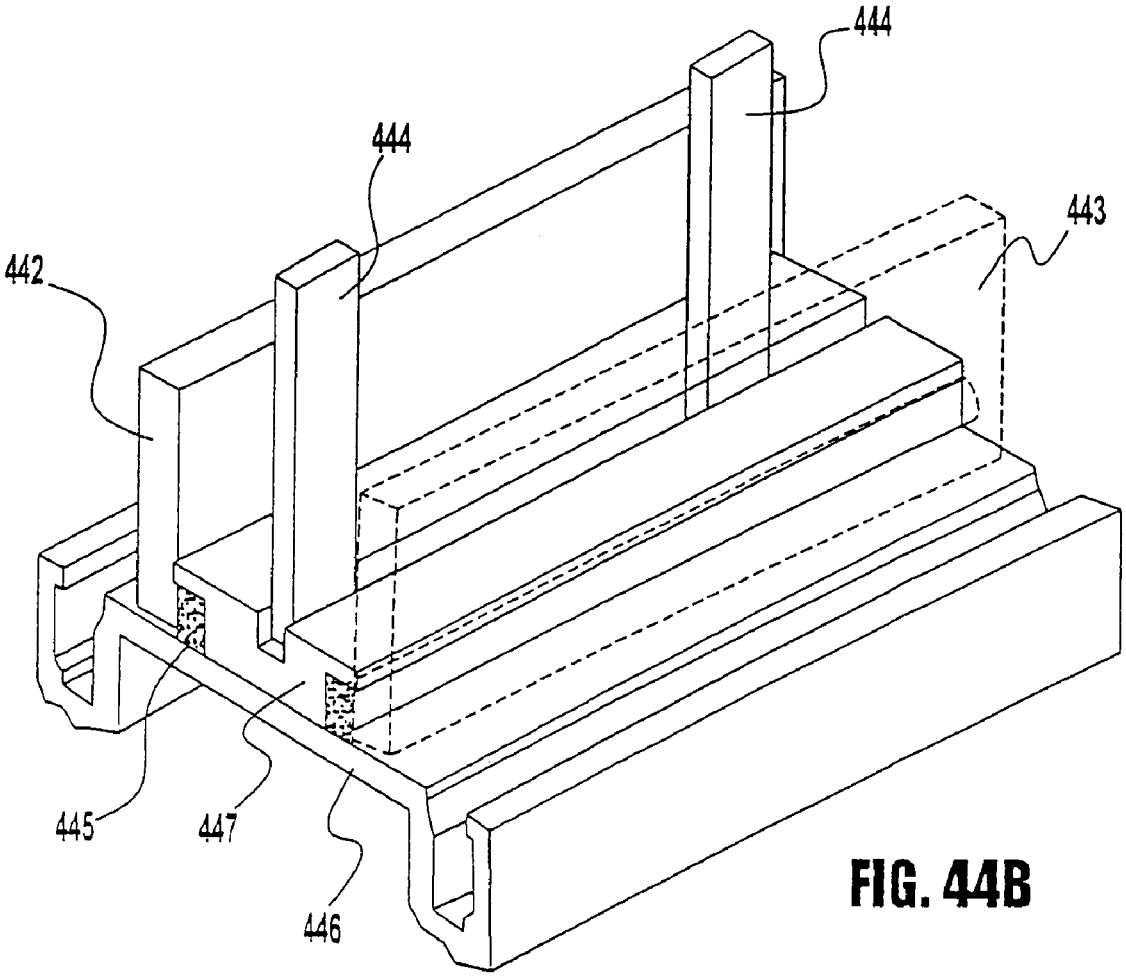
FIG. 44B illustrates a plurality of muntin bars of the type shown in FIG. 44A mounted in a glazing leg support of an IST unit.

FIG. 44B illustrates an integral spacer 447 that functions as a sealant director like the spacer 440 of FIG. 44A. Glazing panes 442, 443 are mounted to the spacer with sealant. Alternatively, the spacer itself can be sufficiently adhesive to render the sealant optional. Muntin bars 444 or a grid assembly are secured to the spacer 440 as shown.

Figure 45A:
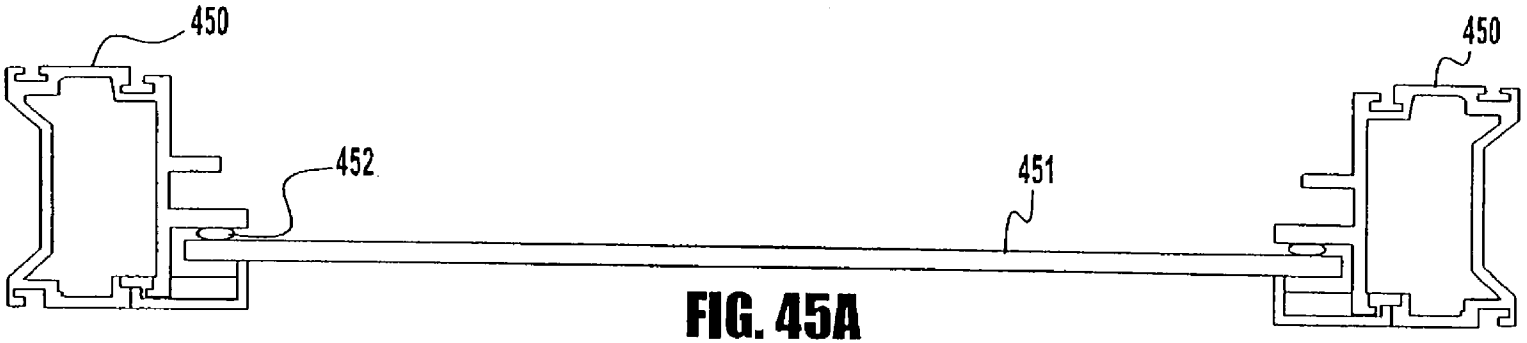
FIGS. 45A, 45B and 45C illustrate a method for assembling an insulating window with an integral spacing structure and muntin bar assembly.
Figure 45B:
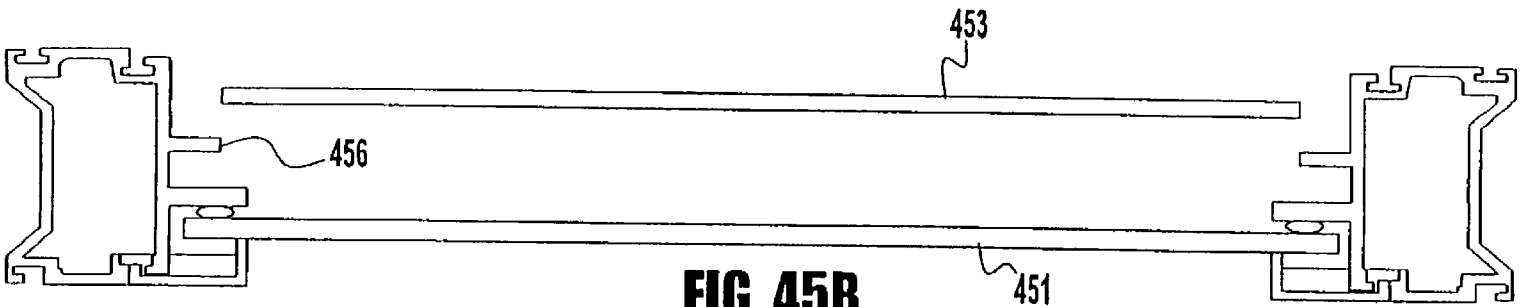
Figure 45C:
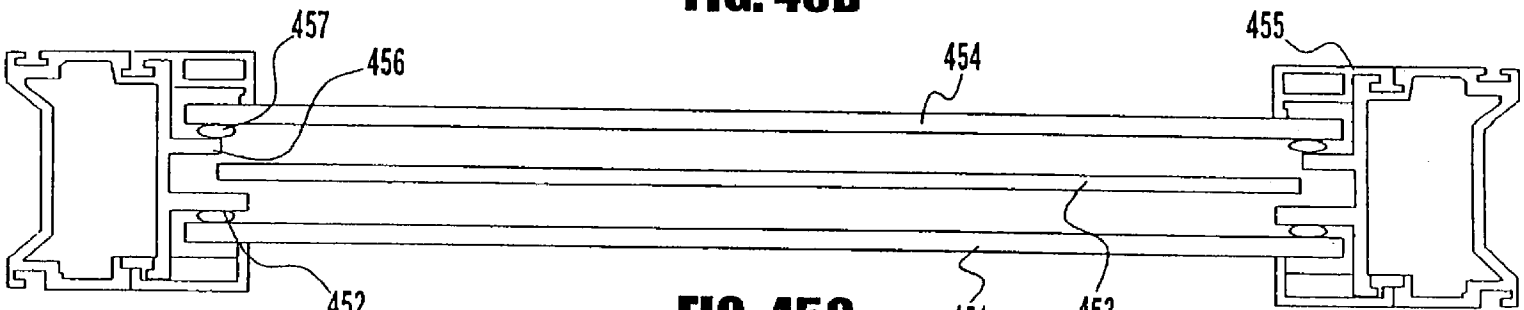

FIGS. 45A, 45B and 45C illustrate muntin grid access that is achieved by a stepped glazing leg mounting structure. A muntin retaining clip or mounting bracket may be required to properly locate and/or maintain the grid assembly within the air space. Any combination of clips and/or glazing leg configurations, such as notches or ratcheted legs (see FIGS. 41A and 41B) may be incorporated on either both or multiple (three or more) legs, exterior or interior, so as to adequately receive or fix the muntin grid assembly. The stepped leg structure may be used to incorporate more than one glazing panel in the sash frame. For example, a triple pane unit or combinations of insulating glass units side by side yet spaced apart with grids within the sash frame can be accommodated. A stepped structure may also allow the window or door to be assembled from one side of the frame, without the need to flip the frame over to mount glazing panes to different sides.

FIGS. 45A, 45B, and 45C illustrate the assembly of an insulating window, door or the like by first placing the sash frame side components 450 down as shown in FIG. 45A. The glazing sheet 451 has already been installed, and is held by sealant and/or glazing bead 452. Next, as shown in FIG. 45B, the muntin grid 453 is attached by a clip or other means, as previously described. Sealant 457 is applied between the leg 456 and the glazing sheet 454, and the glazing sheet 454 is mounted onto the leg 456. Finally, a glazing bead 455 is affixed to the sash frame.

Figure 46A:
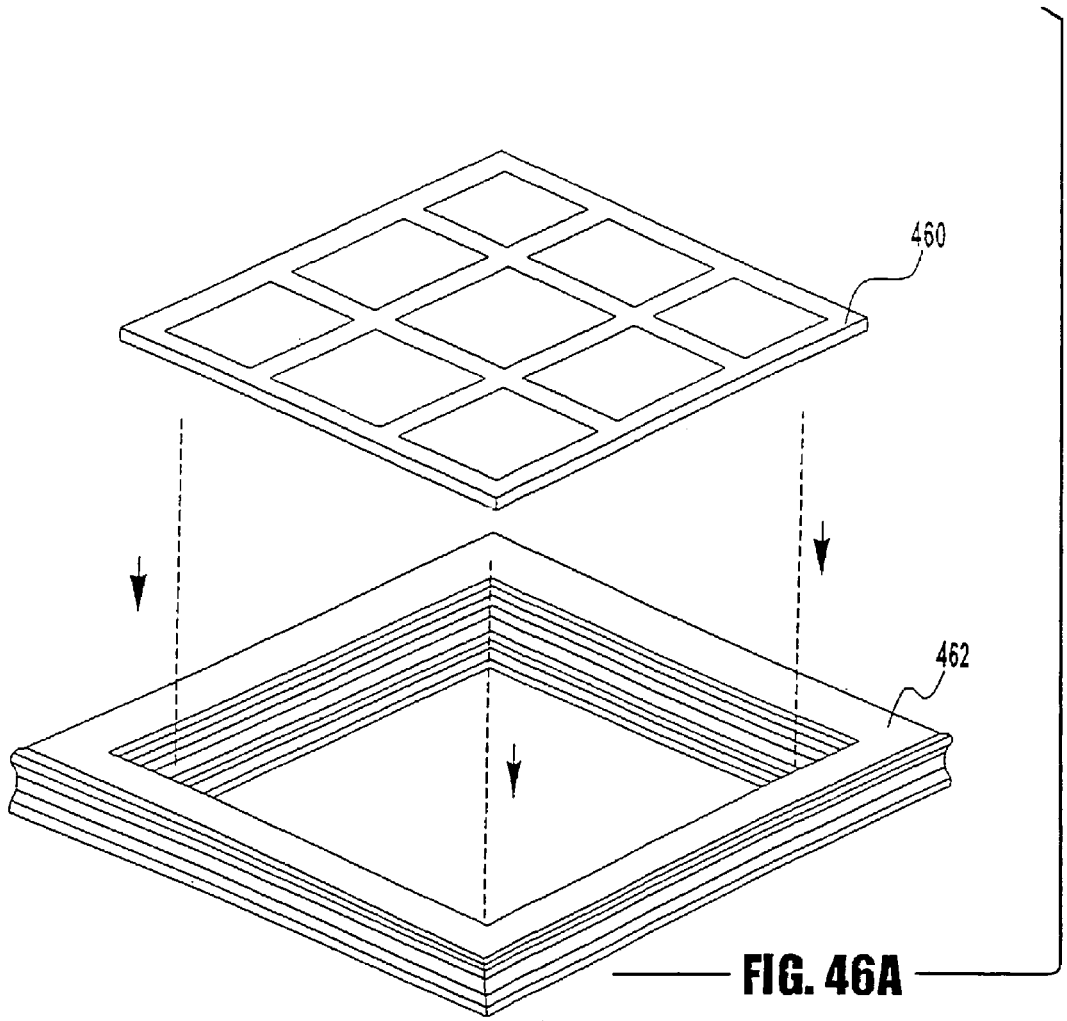
FIGS. 46A and 46B show a fully molded or formed grid frames.
Figure 46B:
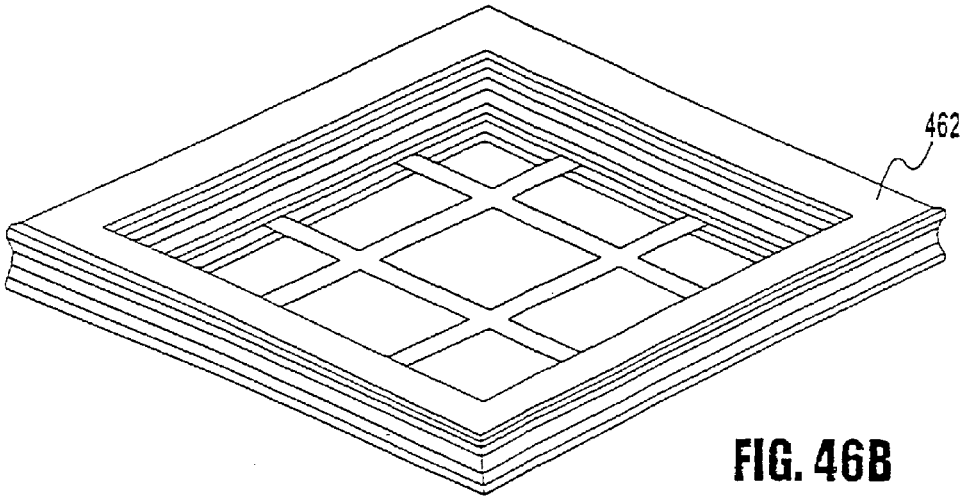
Figure 47:
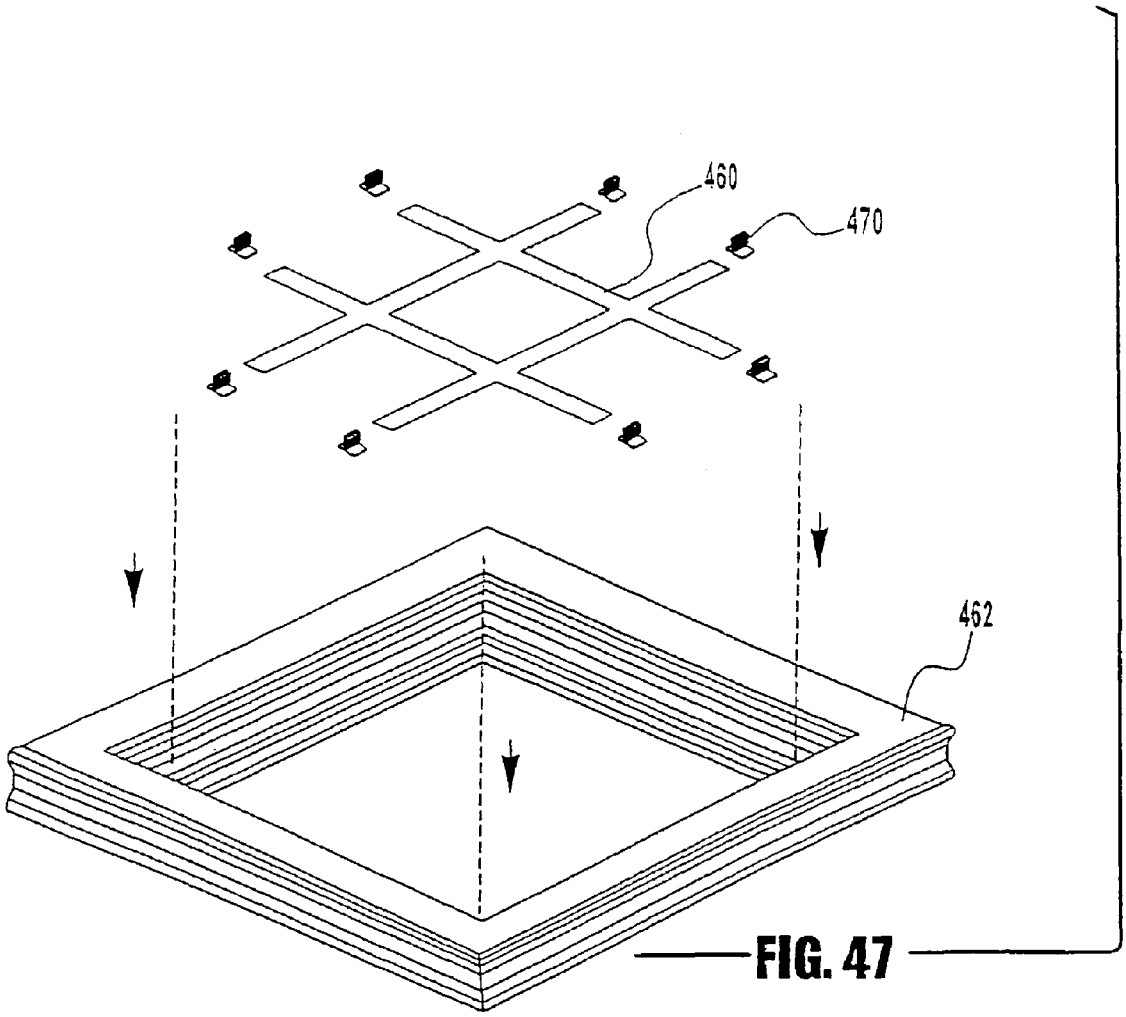
FIG. 47 shows the attachment of a complete grid assembly to a frame by the use of clips.
Figure 48:
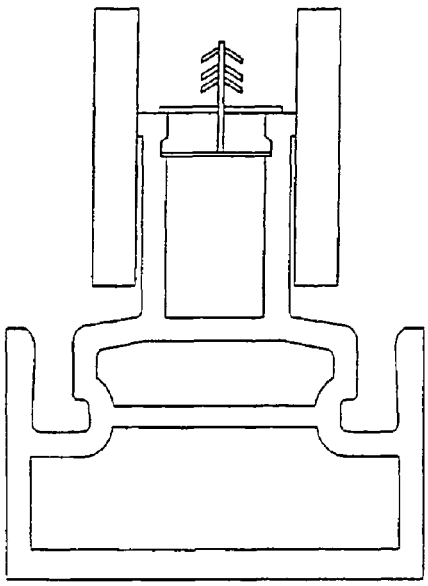
FIG. 48 shows the use of a muntin retaining clip to attach a muntin bar or muntin grid to a sash frame.
Figure 49A:
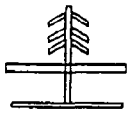
FIGS. 49A-49M show a plurality of muntin retaining clip configurations adapted to attach a muntin bar or muntin grid to a sash frame.
Figure 49B:
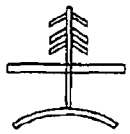
Figure 49C:
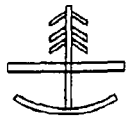
Figure 49D:
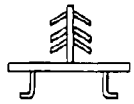
Figure 49E:
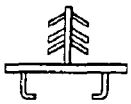
Figure 49F:
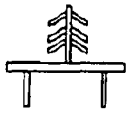
Figure 49G:
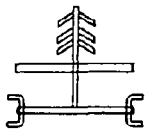
Figure 49H:
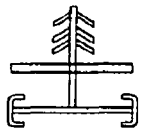
Figure 49I:
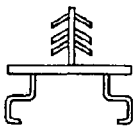
Figure 49J:
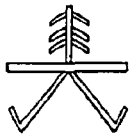
Figure 49K:
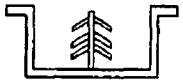
Figure 49L:
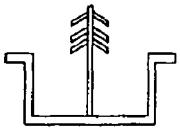
Figure 49M:
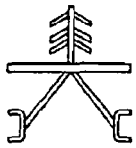
Figure 50A:
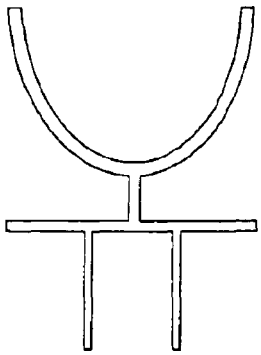
FIGS. 50A-50C show a plurality of clip configurations adapted to attach a muntin bar or grid to a sash profile.
Figure 50B:
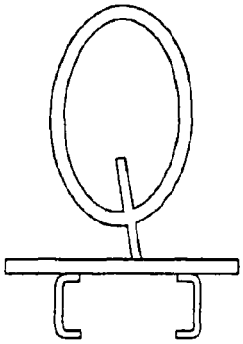
Figure 50C:
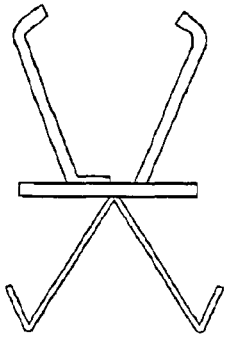

FIGS. 46A and 46B illustrate that fully molded or formed grid frames 460 may be used. Such means as injection molding may produce the complete grid assembly 460. The complete grid assembly 460 may be attached by the use of muntin clips 470 as illustrated in FIG. 47 and/or as otherwise depicted herein (e.g., by adhesive or mechanical snapping of the grid into the sash frame). The grid assembly 460 may by adhered to the sash frame 462 by an adhesive desiccant matrix, vapor barrier, and/or any combination of such materials or other suitable materials.

It is further noted that an embodiment is envisioned where the muntin grid is built directly into the sash frame 462. In particular, an integral sash and muntin grid assembly can be fabricated, e.g., by injection molding, which includes a complete window frame and muntin bars in one piece. Using the integrated sash technology discussed herein and in the aforementioned U.S. Pat. Nos. 6,286,288 and 6,536,182, a window having the muntin bars between the insulating glass sheets can be completed by simply applying sealant to the integral spacing and mounting structure of the sash (e.g., glazing legs or steps), and applying the glazing sheets. Alternatively, the sealant can be applied to the glazing sheets, which are then attached to the spacing and mounting structure of the sash. It is also possible to apply sealant to both the spacing and mounting structure and to the glazing sheets prior to mounting the glazing sheets. Since the muntins are an integral part of the sash frame, no clips or other muntin mounting components are required.

The grid attachment method may incorporate any means, e.g., as shown in FIG. 47, (including variations of the clips illustrated herein) to attach the grid to the spacing and mounting structure of the sash frame. The variations in muntin clips shown in FIGS. 49A-49M are illustrative and other clip designs which are adapted to attach the muntin bar or grid to the sash frame fall within the scope of this invention. Any combination of the structures as shown in FIGS. 49A-49M and methods illustrated herein can be used as desired. The grid muntin retaining clips illustrated in FIGS. 49A-49M, and 50A-50C are depicted to be conceptual by design. The grid muntin retaining clips may be of any material, combinations of material, any form or degree of flexibility, rigidity, softness, hardness, or other makeup so as to provide a secure seat for the grid assembly or grid structure. Any combination of flexibility, rigidity, softness, hardness or other makeup may be incorporated so as to provide appropriate means of securing the muntin retaining clip to the sash assembly. Any of the illustrations shown may incorporate any combination of features illustrated in any other design depicted.

FIGS. 51A-51H illustrate various means by which a grid assembly, muntin retaining clip or combination of grid assemblies or pre-molded grid units may be attached and/or adhered to or made integral to the sash member. Any combination of grid muntin retaining clips, no grid clips, or notched/machined and/or end manipulation of such grid bars for attachment or fastening to the sash member may be employed, and all such variations are intended to be within the scope of the present invention. The muntin retaining clip or grid bars for attachment or fastening to the sash member may be employed, and all such variations are intended to be within the scope of the present invention. The muntin retaining clip or grid member may be placed into and/or upon the desiccant matrix and/or sealant material that may serve as a desiccant and/or adhesive and/or vapor barrier and/or separate material solely for grid muntin retaining clip or grid member fastening.

Figure 51A:
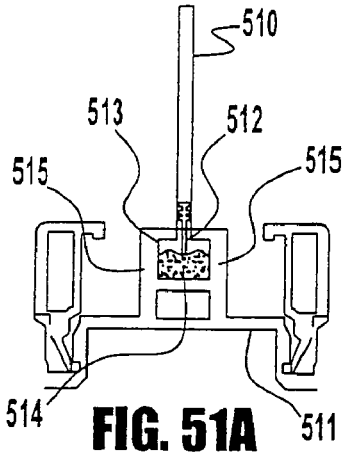
FIGS. 51A-51H show a plurality of sash frame structures to which a muntin bar or muntin grid assembly, muntin retaining clip or combination of grid assemblies or pre-molded grid units may be attached and/or adhered to or made integral to a sash frame.

For example, FIG. 51A shows a sash frame 511 adapted to receive parallel glazing sheets on a spacing and mounting structure having a base and two glazing legs. A muntin bar 510 is attached to a sash frame 511 with a muntin retaining clip 512 extending into the glazing box 513 of a spacing and mounting structure. A sealant material 514 is disposed between the two adjacent glazing legs to cover the muntin clip so that a muntin retainer projects outward from the base of the muntin clip to receive an end of a muntin bar. The muntin is held by the adhesive and supported by the glazing walls 515. The two glazing walls or legs 515 each have a support section at one end that extends in the direction of the other glazing leg and forms a slot there between. The muntin retainer projects outward of the slot so that the bottom of the muntin bar rests on the support sections.

Figure 51B:
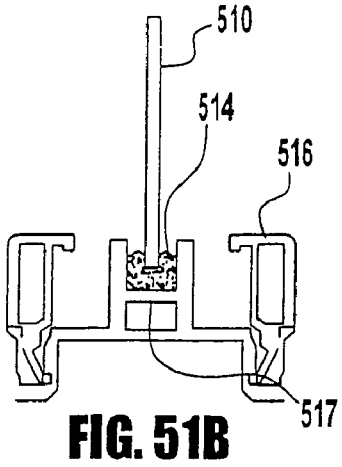

FIG. 51B shows a muntin bar 510 attached to a sash frame 516 by a sealant material 514 in the glazing box of the spacing and mounting structure having a base and two glazing lets. An interconnect structure is provided for mounting a muntin bar or muntin grid assembly in the space between the two glazing legs and the base. The adhesive material is disposed between the two adjacent glazing legs and around an end of a muntin bar to secure the muntin bar to the spacing and mounting structure. A support surface 517 is disposed above the base and between the two glazing legs. The sealant material is disposed between the two adjacent glazing legs and on the support surface and around an end of a muntin bar to secure the muntin bar to the spacing and mounting structure.

Figure 51C:
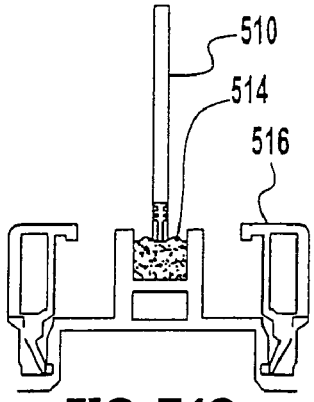

FIG. 51C shows a muntin bar 510 attached to a sash frame 516 with a muntin retaining clip extending into the glazing box. A sealant material 514 secures muntin bar 510 and the muntin clip without support of the glazing walls.

Figure 51D:
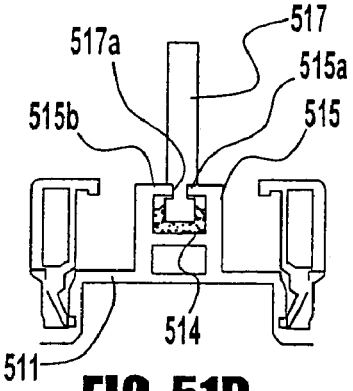

FIG. 51D shows a muntin bar 517 attached to a sash frame 511 with a portion of the muntin bar 517 extending into the glazing box. The muntin bar 517 has grooves 517*a* on the lower end to secure the muntin bar to glazing wall extensions 515*a*, 515*b* projecting towards each other and inserted within the grooves 517*a*. A sealant material 514 in combination with the glazing walls 515 supports the muntin bar 517. The sash frame 511 is adapted to receive parallel glazing sheets on a spacing and mounting structure having a base and two glazing legs forming the glazing walls. The sash frame includes interconnect structure for mounting the muntin bar or muntin grid assembly to the spacing and mounting structure. The interconnect structure includes a support section 515*a*,515*b* at one end of each of the two glazing legs that extends in the direction of the other glazing leg and forms a slot therebetween.

Figure 51E:
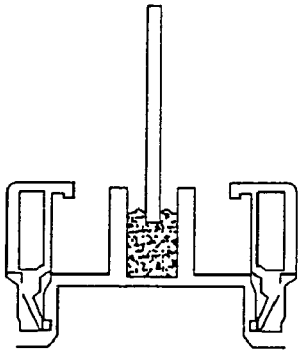

FIG. 51E shows a muntin bar attached to a sash frame by a sealant material in the glazing box, similar to the embodiment shown in FIG. 51B.

Figure 51F:
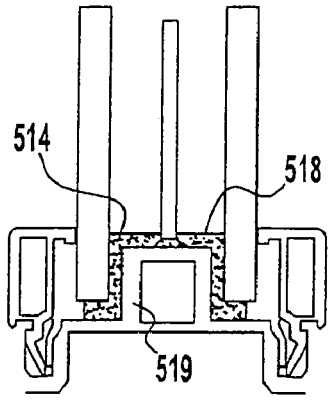

FIG. 51F shows a muntin bar mounted to a sash frame above the glazing box with a sealant 518 that also helps support the window panes. The sealant 518 forms a continuous seal from glazing pane to glazing pane, and can serve as a vapor barrier to prevent plasticizers or the like in the sash frame from migrating into the insulating air space and coating (e.g., fogging) the inside of the glazing panes. A sash frame is adapted to receive parallel glazing sheets on a spacing and mounting structure having a base with a rectangular support box 519 extending therefrom. The sash frame comprises an interconnect structure for mounting a muntin bar or muntin grid assembly atop the rectangular support box. A sealant material 514 is disposed on the base and around at least two sides and across the top of the rectangular support box to cover an end of a muntin bar so that the muntin bar projects outward from the rectangular support box. One glazing sheet is seated on the sealant material disposed on the base and against a first side of the rectangular box and another glazing sheet seated on the sealant material disposed on the base and against a second side of the rectangular box. A pair of clips engage the first and second glazing sheets and press the glazing sheets against the sealant material. A muntin clip can be attached to the end of the muntin bar.

Figure 51G:
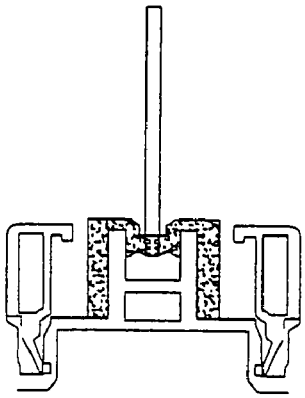

FIG. 51G shows a muntin bar and muntin clip mounted to a sash frame within the glazing box and surrounded with a sealant that also helps support the window panes while providing a vapor barrier. The sash frame is adapted to receive parallel glazing sheets on a spacing and mounting structure having a base and two glazing legs and a support surface disposed above the base and between the two glazing legs. The sash frame includes a muntin clip disposed between the two glazing legs and above the support surface. The sealant material is disposed on the outer surface of the glazing legs, between the two adjacent glazing legs and around the muntin clip to secure the muntin bar to the spacing and mounting structure.

Figure 51H:
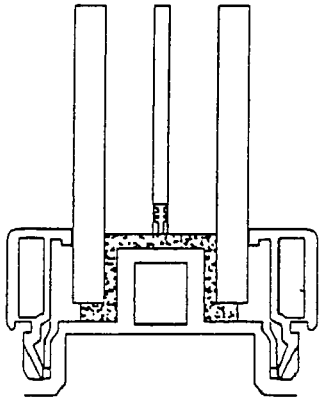

FIG. 51H is similar to FIG. 51F except it also incorporates a muntin clip to support the muntin bar.

Figure 52A:
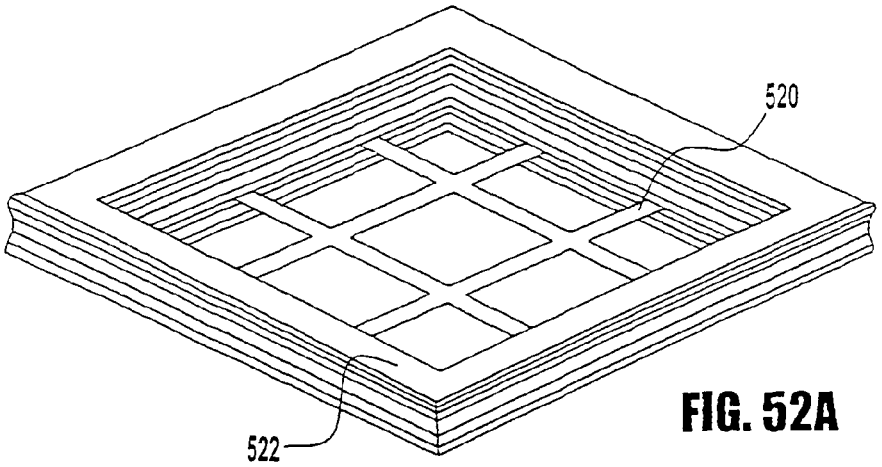
FIG. 52A shows an injection molded or molded or formed grid assembly as part of or integral to the sash frame.
Figure 52B:
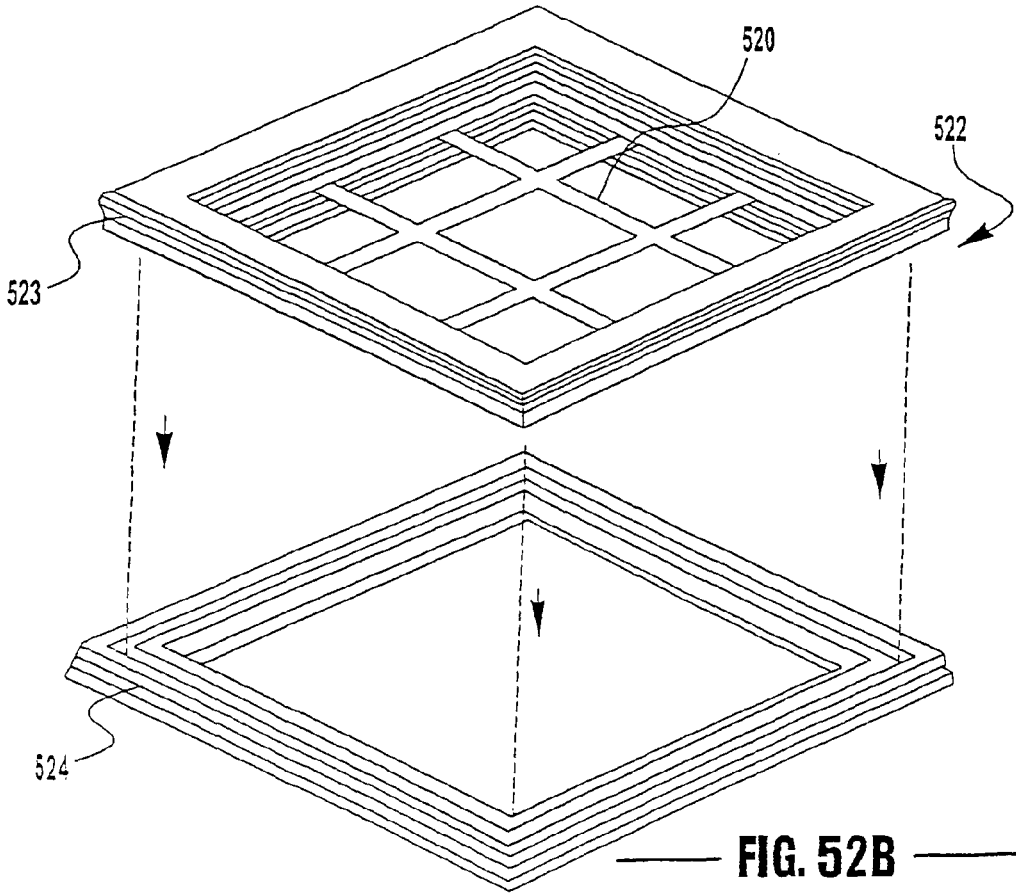
FIG. 52B shows that the grid assembly may be co-molded or formed similar to FIG. 52A.

FIG. 52A illustrates a grid assembly 520 that may be injection molded or molded or formed as part of or integral to one section of the sash frame 522. The assembly 520 mounts (e.g., snaps) into a second section 524 of the sash frame, to provide a completed sash frame shown in FIG. 52B to which glazing panes can be mounted.

Figure 53:
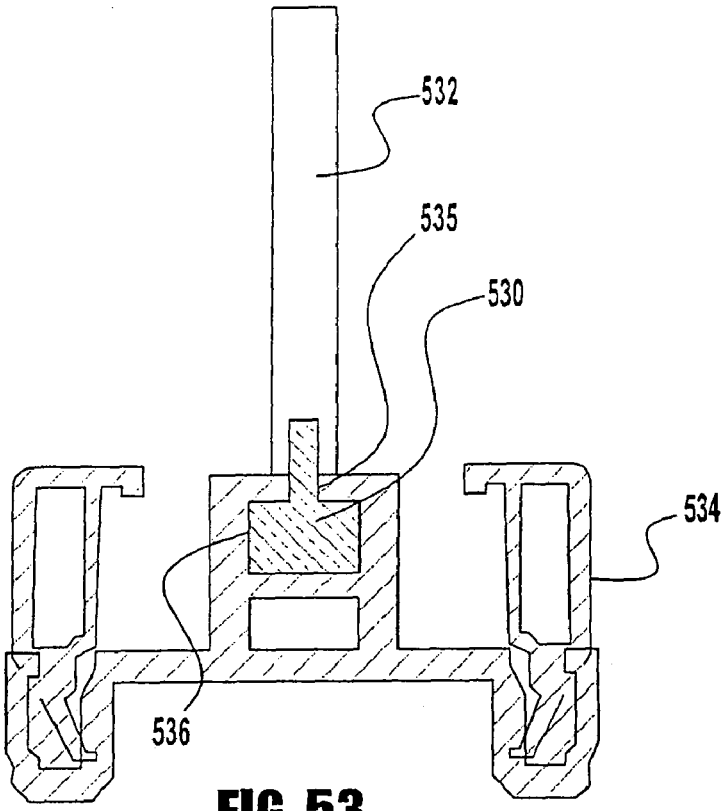
FIG. 53 shows a muntin retaining clip made or constructed from an expanding material.

FIG. 53 illustrates a concept (which may have any suitable size or shape) wherein the muntin retaining clip 530 for securing the muntin bar 532 to the sash frame 534 is constructed of an expanding material, such as a foam of any shape and/or dimension. The expanding muntin retaining clip 530 may be of any configuration such as those shown in FIGS. 49A-49M. Nevertheless, the concept revolves around the improved method of attaching the muntin grid to the sash frame 534 by the foam muntin retaining clip 530. This can be accomplished by an expanding foam pressure fit between the muntin retaining clip 530 and the sash frame 534 due to a configuration of the clip that allows for the oversized expanding foam to be seated into its corresponding location. The foam muntin retaining clip 530 will generally be larger or greater in size than the location into which it will rest. Due to the characteristic of the expanding material (such as foam), the muntin retaining clip 530 will first compress to fit into any (if any) narrowing slot or recess or way, for example slot 535 as shown in FIG. 53, and then expand back into its new seat dimension, shape, or location 536. In this manner, the pressure from the oversized foam muntin retaining clip 530 fitting into a smaller location seat 536 will provide the friction required to maintain the grid/muntin placement.

Figure 54:
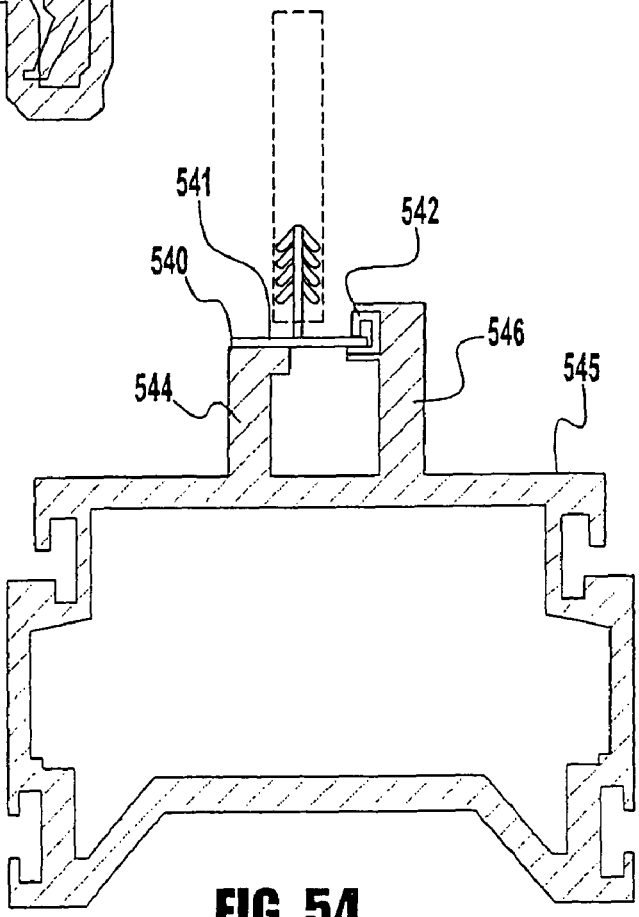
FIG. 54 shows a muntin retaining clip positioned into a recess or slot formed in the glazing leg that allows the muntin retaining clip to be wedged or friction set into position.

FIG. 54 illustrates that the muntin retaining clip 540 may have a base structure 541 that will fit or wedge or slide into or be positioned into a recess or slot 542 that allows the muntin retaining clip to be wedged or friction set into position. In this embodiment, the muntin retaining clip 540 has one side sitting on the top of glazing wall 544 of sash frame 545 and the other side wedged into the slot 542 formed in the other glazing wall 546.

Figure 55:
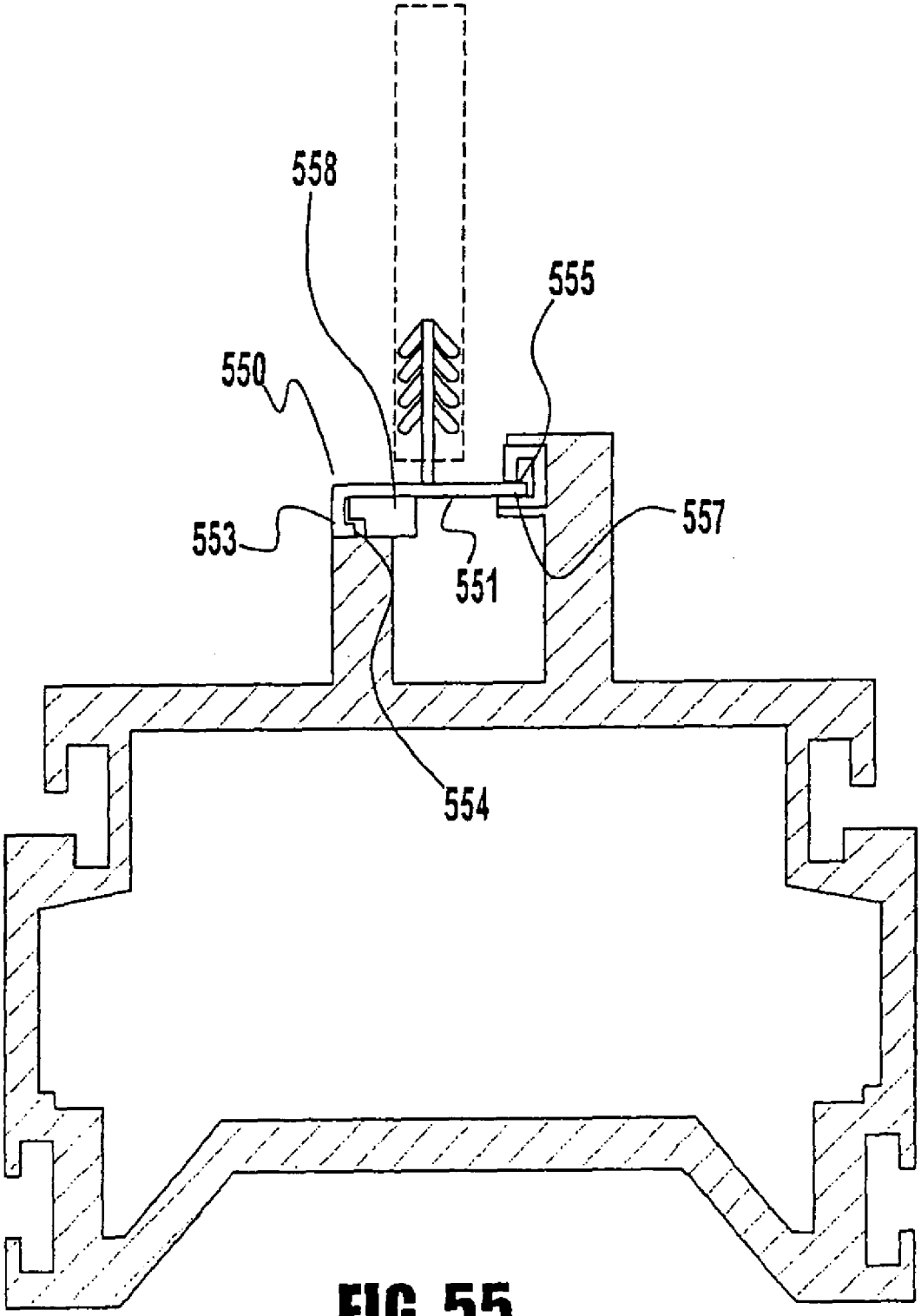
FIG. 55 shows a muntin retaining clip that is similar to that shown in FIG. 54 except that it is constructed to glazing legs are of different length.

In the embodiment of FIG. 55, the muntin retaining clip 550 has a base structure 551 with an end portion 552 that bends down and has a projection 554 that faces towards the opposite end 555 of the muntin retaining clip. The muntin retaining clip 550 is secured to a muntin bar and is wedged into a slot 557 and held by a block 558 so that the grid frame is secured to the sash frame whether mounted vertically, horizontally, or otherwise.

Figure 56A:
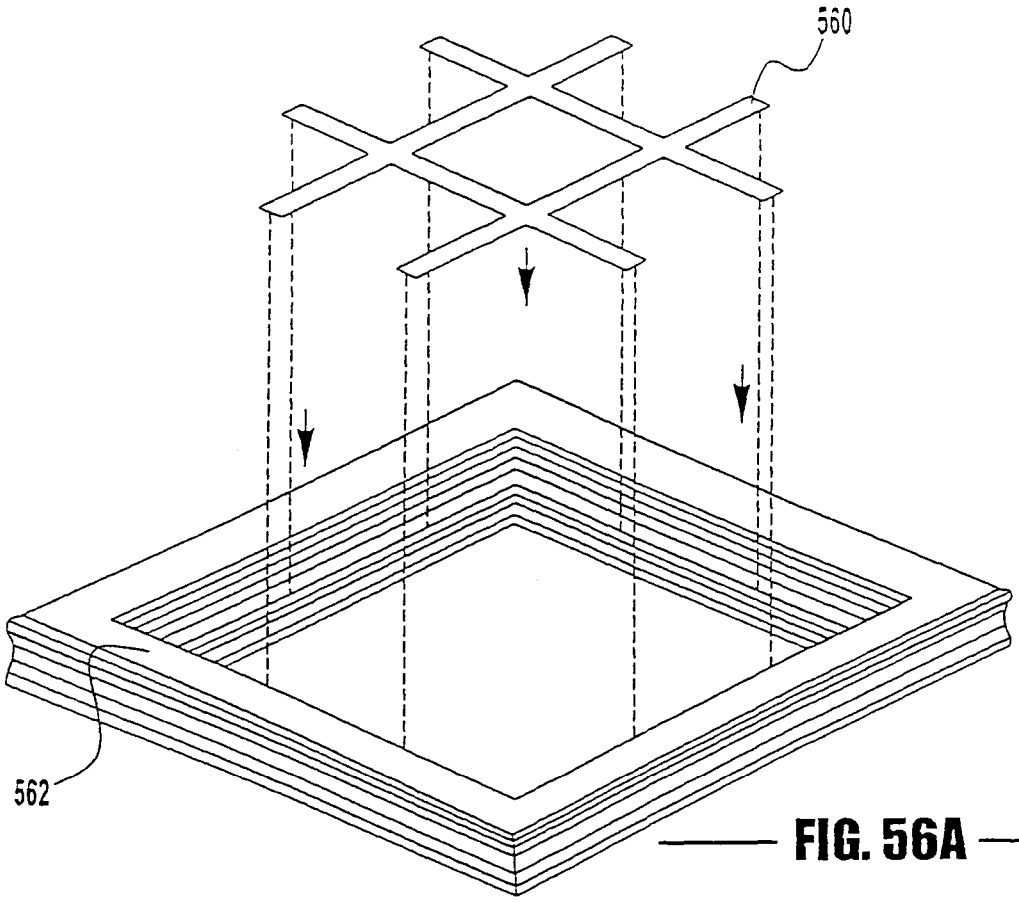
FIGS. 56A and 56B illustrate a method of applying grid frames or individual grid members into a sash frame.
Figure 56B:
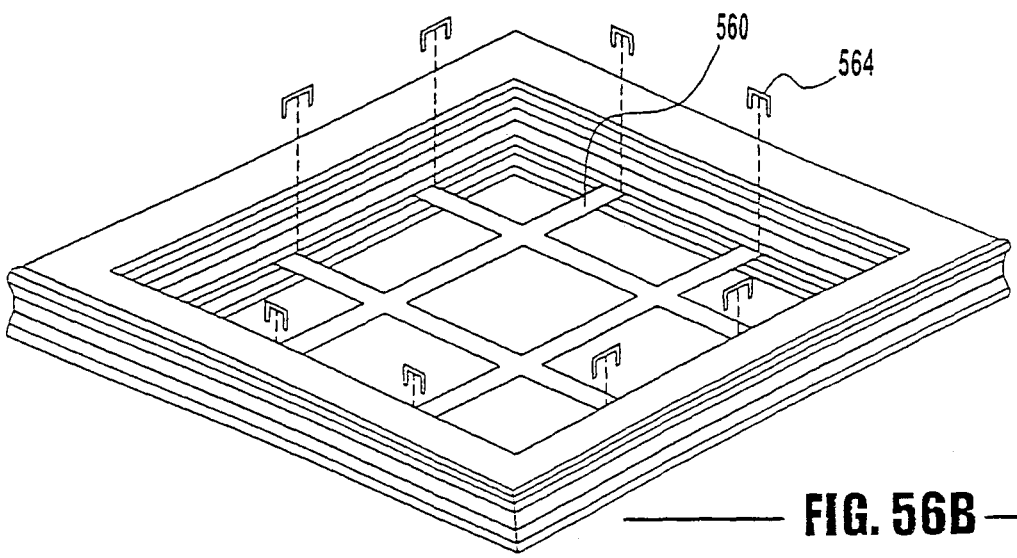

FIGS. 56A and 56B illustrate a method of applying grid frames or individual grid members 560 to a sash frame 562. The grid members 560 may be placed into the sash frame 562 to "build" the grid assembly or may be pre-built before insertion. A clip 564 or other securing means such as a staple, pin, screw, joining device, mechanism, fastener, glue, adhesive, tape or any other means may be used to attach or fasten or secure the grid assembly 560 after or simultaneously to the grid assembly insertion or placement. These functions or processes may be in any order, via a manual method, semi-automatic method, or completely automated operation.

Figure 57C:
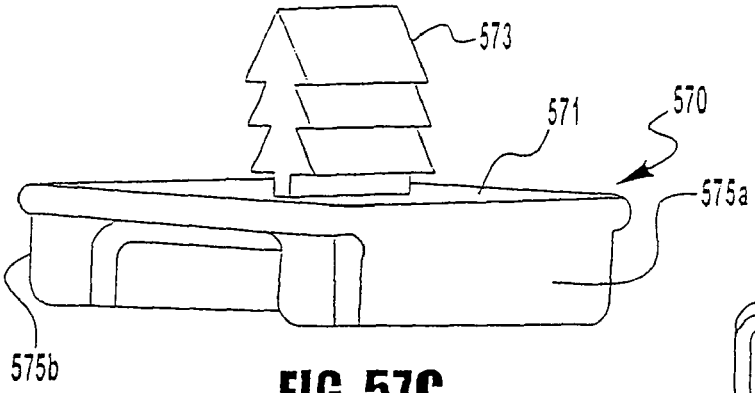
FIGS. 57A, 57B and 57C illustrate a muntin retaining clip with a central clip body adapted to fit within the space between the glazing legs that are integral with the sash frame.
Figure 57A:
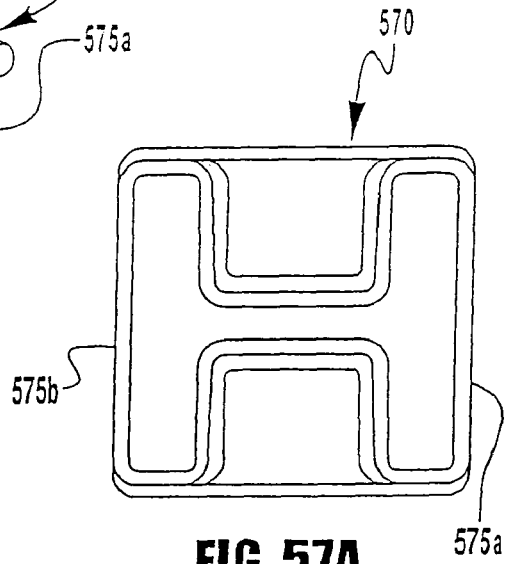
Figure 57B:
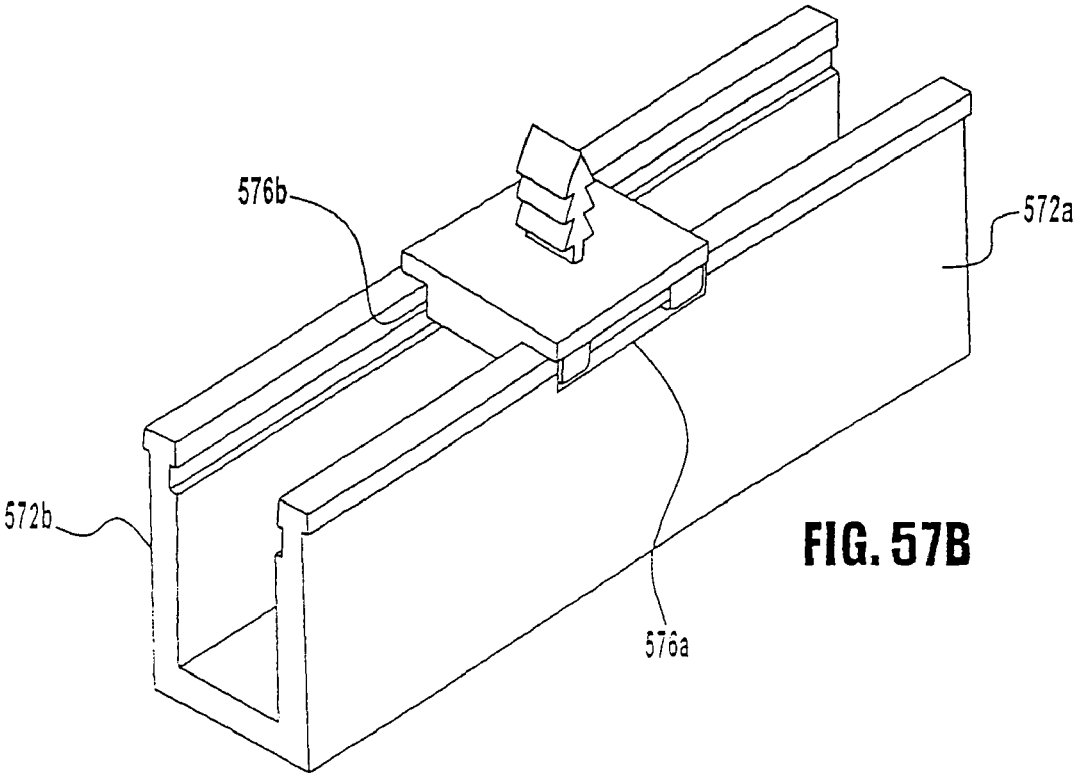

FIGS. 57A, 57B and 57C illustrate a muntin retaining clip 570 with a central clip body 571 adapted to fit within the space between the two glazing legs 572*a*, 572*b* that are integral with a sash frame of the type described herein. As shown in FIG. 57, the clip 570 has an upstanding retainer 573 disposed on the upper surface of central body 571 for holding the end of a muntin bar. The width of the central body 571 is selected to fit between glazing legs or walls 572*a* and 572*b* of the sash frame. The bottom of the retaining clip 570, as shown in FIG. 57A, has base support (e.g., H-shaped) that includes two side walls 575*a*, 575*b* extending the width of the clip. An interconnecting wall extends between the two side walls. As shown in FIG. 57B, the glazing legs 572*a*, 572*b* each have an oppositely disposed notch or slot 576*a*, 576*b*, respectively, formed in the upper portion of the glazing legs. The length of the slots 576*a*, 576*b* is slightly more than the width of the central body 571 so that the clip 570 can be inserted into the slots 576*a*, 576*b* and between the glazing walls 572*a*, 572*b*. The clip 570 is mounted between the glazing walls 572*a*, 572*b* so that the two side walls 575*a*, 575*b* are both disposed in the opposite facing slots 576*a*, 576*b* to secure the clip 570 in place (i.e., to prevent the clip from sliding along the length of the legs 572*a*, 572*b*). The clip can be designed to simply sit upon the legs, within the slots 576*a*, 576*b*, or can be dimensioned to snap or friction fit within the slots to hold the clip tightly. If the clip is not held tightly within the slots, the pressure of the muntin bars having clips at opposite ends can be relied on to maintain (e.g., bias) the clips within the notches.

Figure 58A:
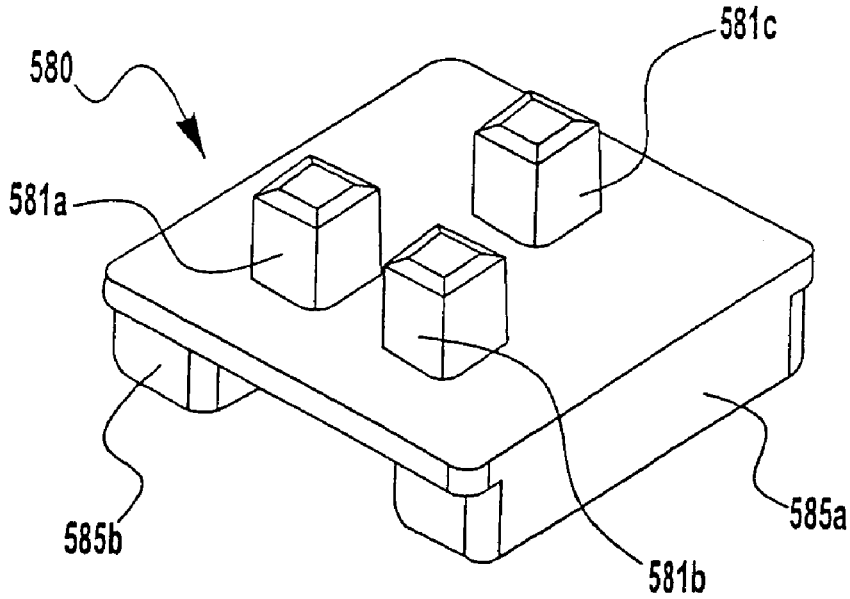
FIGS. 58A and 58B illustrate a triple glazing clip adapted to fit within the space between the glazing legs that are integral with the sash frame.
Figure 58B:
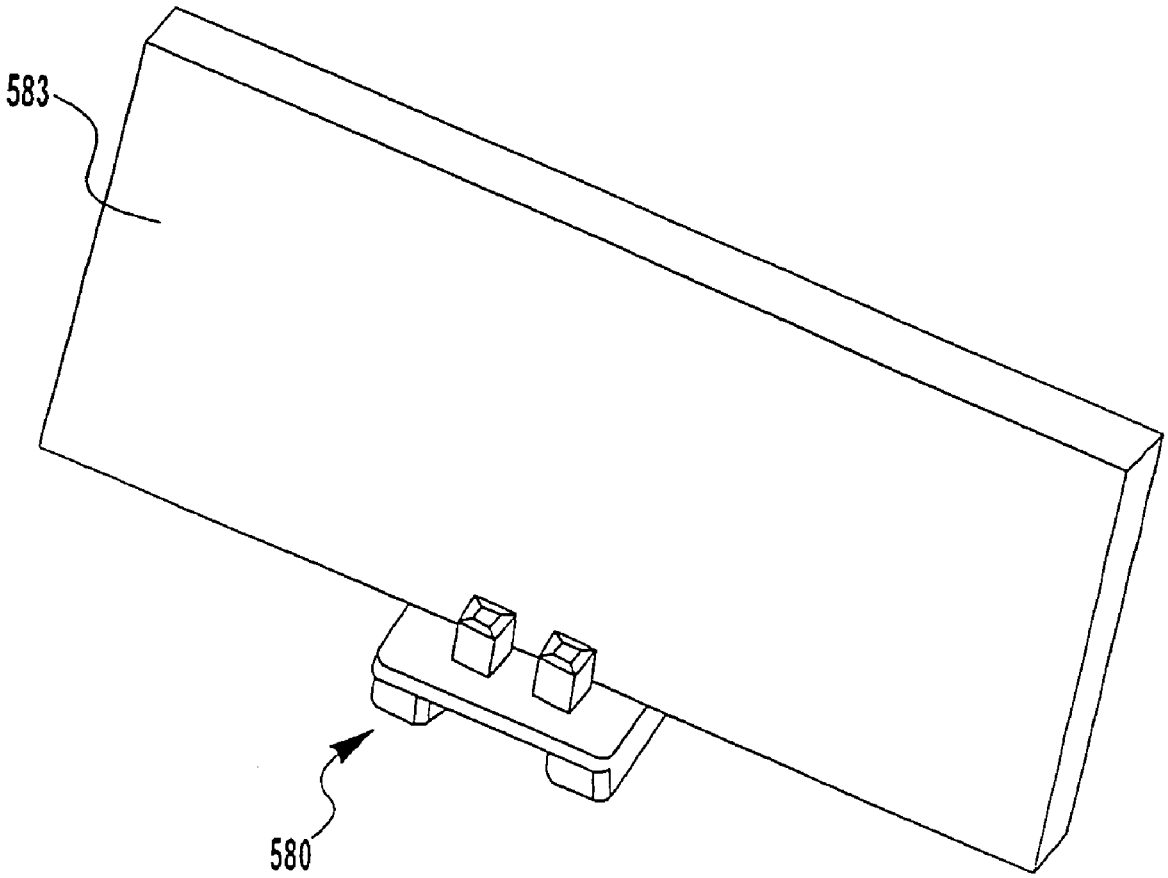

FIGS. 58A and 58B illustrate a triple glazing clip 580 with a central clip body adapted to fit within the space between the two glazing legs that are integral with a sash frame of the type described herein. As shown in FIG. 58A, the clip 580 has three upstanding blocks 581*a*, 581*b*, 581*c* disposed on the upper surface of the central body for holding a glazing pane 583, as shown in FIG. 58B. Preferably, the three blocks 581*a*, 581*b*, 581*c* are spaced so that two blocks 581*a* and 581*b* are aligned next to and spaced from each other and the third block 581*c* is spaced from the first two and aligned opposite the spacing between the first two blocks. The central body is constructed in the same manner as central body 571 of FIG. 57 in order to fit between two glazing legs or walls, each having a slot, of a sash frame. The bottom of the retaining clip 580 has, for example, an H-shaped base support that includes two side walls 585*a*, 585*b* that extend the width of the clip. In the same manner as shown in FIG. 57B, the central body portion of clip 580 can be mounted in the oppositely disposed slots of glazing legs to carry the weight of the glazing pane 583.

If desired, muntin bars can be mounted in the space between the two blocks 581*a* and 581*b* or alternatively on one or two of the blocks. In another alternative embodiment, additional clips of any of the designs described herein can be provided to retain the muntin bars, such as for example clips 570.

It should now be appreciated that the invention provides various embodiments for the mounting of muntin bars and/or grids to the spacing and mounting structure of an integrated sash for fabricating insulating windows, doors and the like. Embodiments both with and without clips and other mounting elements are provided. Methods of fabricating integrated sash units with muntin bars and grids are also disclosed. Moreover, the various clips of the present invention can also or alternatively be used to hold a glazing pane, e.g., to produce triple pane (or more) windows, doors and the like.

Although the invention has been described in connection with various embodiments, it should be appreciated that numerous modifications and adaptations may be made thereto without departing from the scope of the invention as set forth in the claims.

What is claimed is:

1. A clip for attachment to a glazing pane mounting structure, comprising:

a first platform having first and second opposite edges;

a second platform;

said first platform overlapping said second platform with a space therebetween;

said second platform being connected along a first end thereof to said first platform in a connection area adjacent to but not in contact with said first edge of said first platform, such that a lip of said first platform extends beyond the connection area in a direction away from the second edge of said first platform;

said second platform extending from its first end to a second, opposite end thereof substantially but not completely all the way to the second edge of said first platform, such that the second edge said first platform extends beyond the second end of said second platform in a direction away from the first edge of said first platform;

wherein said space extends from the first end of said second platform to the second end thereof.

2. A clip in accordance with claim 1 further comprising a muntin retainer attached to said first platform.

3. A clip in accordance with claim 2 wherein said muntin retainer is perpendicular to said first platform and extends away from said second platform.

4. A clip in accordance with claim 2 wherein at least one of said first platform, second platform and muntin retainer is desiccated.

5. A clip in accordance with claim 1 wherein at least one of said first and second platforms is desiccated.

6. A clip in accordance with claim 1 wherein said first platform is generally rectangular.

7. A clip in accordance with claim 6 wherein said second platform is generally rectangular.

8. A clip in accordance with claim 1 impregnated with a desiccant.

9. A glazing pane mounting structure having a clip attached thereto, said glazing pane mounting structure having first and second parallel glazing legs for receiving said clip at spaced apart free edges thereof and said clip comprising:

a first platform having first and second opposite edges;

a second platform;

said first platform overlapping said second platform with a space therebetween;

said second platform being connected along a first end thereof to said first platform in a connection area adjacent to but not in contact with said first edge of said first platform, such that a first lip of said first platform extends beyond the connection area in a direction away from the second edge of said first platform;

said second platform extending from its first end to a second, opposite end thereof substantially but not completely all the way to the second edge of said first platform, such that the second edge of said first platform extends beyond the second end of said second platform in a direction away from the first edge of said first platform to form a second lip;

wherein:

said space extends from the first end of said second platform to the second end thereof;

said first lip rests on the free edge of the first glazing leg; and said second lip rests on the free edge of the second glazing leg.

10. A glazing pane mounting structure and clip in accordance with claim 9 further comprising a muntin retainer attached to said first platform.

11. A glazing pane mounting structure and clip in accordance with claim 10 wherein said muntin retainer is perpendicular to said first platform and extends away from said second platform.

12. A glazing pane mounting structure and clip in accordance with claim 10 wherein at least one of said first platform, second platform and muntin retainer is desiccated.

13. A glazing pane mounting structure and clip in accordance with claim 9 wherein at least one of said first and second platforms is desiccated.

14. A glazing pane mounting structure and clip in accordance with claim 9 wherein said clip is impregnated with a desiccant.

* * * * *